US010012398B2

(12) United States Patent
Swanson

(10) Patent No.: US 10,012,398 B2
(45) Date of Patent: Jul. 3, 2018

(54) COMPACT AIR CONDITIONING AND FAN SYSTEM

(71) Applicant: Premium Home Comfort, Inc., Philadelphia, PA (US)

(72) Inventor: Kurt M. Swanson, Philadelphia, PA (US)

(73) Assignee: Premium Home Comfort, Inc., Philadelphia, PA (US)

( * ) Notice: Subject to any disclaimer, the term of this patent is extended or adjusted under 35 U.S.C. 154(b) by 5 days.

(21) Appl. No.: 14/826,135

(22) Filed: Aug. 13, 2015

(65) Prior Publication Data

US 2016/0047559 A1 Feb. 18, 2016

Related U.S. Application Data

(60) Provisional application No. 62/038,802, filed on Aug. 18, 2014.

(51) Int. Cl.

| | |
|---|---|
| ***F24F 1/02*** | (2011.01) |
| ***F24F 11/02*** | (2006.01) |
| ***F24F 1/04*** | (2011.01) |
| ***F24F 11/08*** | (2006.01) |
| ***F24F 11/30*** | (2018.01) |
| ***F24F 11/62*** | (2018.01) |
| ***F24F 11/81*** | (2018.01) |
| *F24F 140/40* | (2018.01) |
| *F24F 11/65* | (2018.01) |

(52) U.S. Cl.

CPC ..... *F24F 1/025* (2013.01); *F24F 1/04* (2013.01); *F24F 11/30* (2018.01); *F24F 11/62* (2018.01); *F24F 11/81* (2018.01); *F24F 11/65* (2018.01); *F24F 2140/40* (2018.01)

(58) Field of Classification Search

CPC ..... F24F 1/025; F24F 11/085; F24F 11/027; F24F 11/006; F24F 1/04; F24F 2011/0064; F24F 1/02; F24F 11/08

USPC ..... 62/115, 159, 401, 262

See application file for complete search history.

(56) References Cited

U.S. PATENT DOCUMENTS

| | | | | |
|---|---|---|---|---|
| 2,771,748 A * | 11/1956 | Prosek | F24F 11/085 | 62/160 |
| 3,040,543 A * | 6/1962 | Atchison | F24F 1/02 | 62/181 |
| 3,802,216 A * | 4/1974 | Brandimarte | F24F 1/025 | 165/58 |
| 5,005,372 A * | 4/1991 | King | B60H 1/00371 | 62/244 |

(Continued)

*Primary Examiner* — Mohammad M Ali

(74) *Attorney, Agent, or Firm* — Volpe and Koenig, P.C.

(57) ABSTRACT

A compact air conditioner is provided, the air conditioner having a housing with an internal cavity and an outer surface, an evaporator assembly arranged within a front portion of the internal cavity of the housing, a condenser assembly arranged within a back portion of the internal cavity of the housing, and a compressor associated with the evaporator and condenser assemblies. The evaporator assembly includes an evaporator fan, a front motor that drives the evaporator fan, and an evaporator arranged adjacent to the evaporator fan. The condenser assembly includes a condenser fan, a back motor that drives the condenser fan, and a condenser arranged adjacent to the condenser fan. The compressor includes a coolant adapted to circulate between the evaporator and the condenser.

8 Claims, 55 Drawing Sheets

(56) References Cited

U.S. PATENT DOCUMENTS

| | | | | |
|---|---|---|---|---|
| 5,069,041 | A * | 12/1991 | Thielman | H05K 7/20609 62/263 |
| 5,317,795 | A * | 6/1994 | Bolton | A47B 95/02 16/429 |
| 7,658,085 | B2 * | 2/2010 | Ha | F24F 1/027 165/122 |
| 2006/0021375 | A1 * | 2/2006 | Wetzel | F24F 1/025 62/419 |
| 2007/0056305 | A1 * | 3/2007 | Eom | F24F 1/027 62/262 |
| 2008/0000253 | A1 * | 1/2008 | Kim | F24F 13/20 62/291 |
| 2010/0212334 | A1 * | 8/2010 | DeMonte | F24F 1/04 62/93 |
| 2010/0275630 | A1 * | 11/2010 | DeMonte | F24F 1/04 62/272 |
| 2011/0113795 | A1 * | 5/2011 | Montminy | B64F 1/364 62/77 |
| 2011/0303755 | A1 * | 12/2011 | Ariga | F24F 1/02 237/2 A |
| 2012/0125037 | A1 * | 5/2012 | Asbra | F24F 1/025 62/426 |
| 2014/0069132 | A1 * | 3/2014 | Wong | F25B 30/02 62/238.6 |

* cited by examiner

EA
128
129
138
139
137
EA
EA
EA

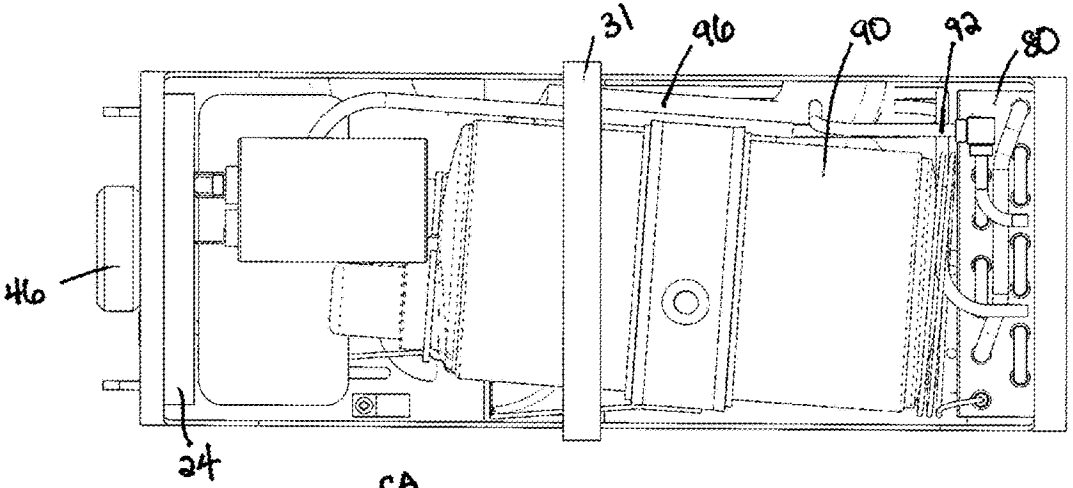
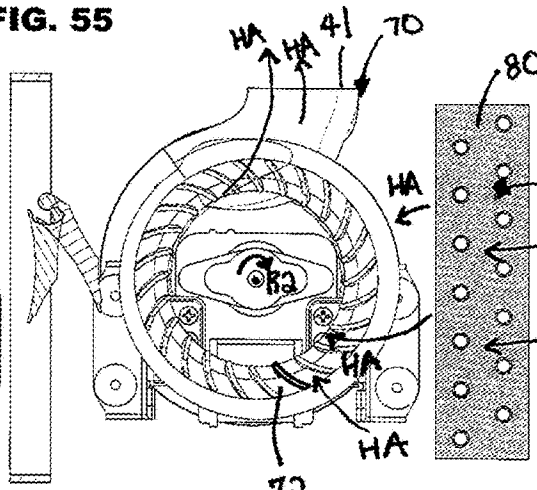
FIG. 55
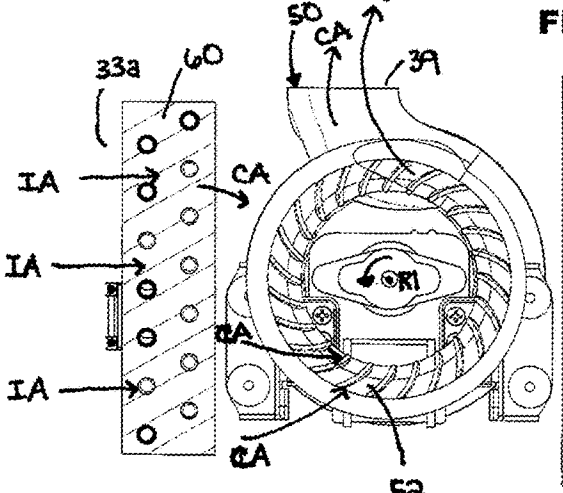
FIG. 56

COMPACT AIR CONDITIONING AND FAN SYSTEM

FIELD OF INVENTION

This application is generally related to air conditioning systems and devices, and more particularly related to a compact air conditioning and fan system that may be easily and safely mounted on a windowsill.

BACKGROUND

Air conditioning systems are in widespread use in homes, offices, and other buildings to cool the space in warm weather, circulate air, and control humidity. Existing air conditioning systems range from large central air conditioning systems with the capacity for cooling an entire building or home, to split or ductless air conditioning systems mounted through a wall in a home or hotel, to more portable and less permanent solutions such as standalone portable air conditioners in a mobile unit having a hose vent and window air conditioners that are mounted on a windowsill and removed during the cooler months of the year. Portable air conditioners, especially window air conditioners, are very popular for apartments and other rental properties, temporary or student housing, older homes without a central air conditioning system, as well as buildings in cooler climates that only require cooling occasionally, as such air conditioning units are generally cost-effective, can be installed, removed, and stored when not in use, and can be moved based on the owner's needs.

Given the popularity of window air conditioners and the large market for these appliances, there exist a number of disadvantages in existing window air conditioning units. These disadvantages including the significant size and weight of current window air conditioners, which makes installation difficult and potentially dangerous, especially for users attempting to install a unit by themselves. Existing window air conditioners often weigh between 50 to 120 pounds, range between 14"-48" in width, range between 18"-34" in height, and range between 18"-36" in depth. Accordingly, these existing units are often too large and heavy for an individual to carry and move safely and comfortably. In addition, installation of a window air conditioner requires lifting the unit and aligning it in a window opening, and then holding the unit in place until it is sufficiently secured, which can be made significantly more difficult by the size and weight of existing units. Removing a window air conditioner from a window is similarly demanding, causing many users to keep their window air conditioners installed even during colder weather such as the winter months, which leads to a significant loss of heat from the home and higher energy bills. The large dimensions of existing window air conditioners may not fit smaller windows, and large interior space with only one or a few windows that require particularly high levels of cooling capacity relative to the available window area are not well served by existing units. Furthermore, the large form factor of existing window air conditioners blocks much of the view and light from the window, and is commonly regarded as an eye sore from both inside and outside of the building. Existing window air conditioners also produce a large amount of noise during operation, and do not offer an efficient air circulation option to bring in fresh air from outside without utilizing all of the fans in the unit, which increases power consumption and noise.

Given the disadvantages discussed above and the prevalence of window air conditioners worldwide, a need exists for an air conditioning system that has a small and aesthetic pleasing form factor, high efficiency, low noise, a compact yet effective cooling system, and can be easily installed, uninstalled, moved, and stored by a user. A need further exists for an air conditioning system that offers an air circulation mode to bring fresh air in from outside of the building without utilizing the cooling components of the air conditioner, so that the air conditioner can be used as a fan when cooling is not necessary or desired. In addition, a need exists for a window air conditioner that offers a pleasant user experience, both from an aesthetic perspective as well as in the ease of use, including a well designed user interface and the ability to be incorporated into the user's home thermostat system or to be remotely controlled, such as via the user's computing device. Instead of being regarded as an eyesore, a window air conditioner should be a well-integrated part of a building that fits in with the user's décor, personal belongings, and the architecture of the space.

SUMMARY

A compact air conditioner is disclosed, the compact air conditioner having a housing with an internal cavity and an outer surface with a length that extends along a longitudinal direction, and a width that extends along a horizontal direction that is substantially perpendicular to the longitudinal direction. The compact air conditioner also includes an evaporator assembly arranged within a front portion of the internal cavity of the housing, a condenser assembly arranged within a back portion of the internal cavity of the housing, and a compressor associated with the evaporator assembly and the condenser assembly. The evaporator assembly includes an evaporator fan having a front rotational axis substantially aligned with the horizontal direction, a front motor that drives the evaporator fan to rotate about the front rotational axis, and an evaporator arranged adjacent to the evaporator fan. The condenser assembly similarly includes a condenser fan having a back rotational axis that is substantially aligned with the horizontal direction and substantially parallel to the front rotational axis, a back motor that drives the condenser fan to rotate about the back rotational axis, and a condenser arranged adjacent to the condenser fan. The compressor includes a coolant adapted to circulate between the evaporator and the condenser.

An alternative embodiment of a compact air conditioner is also disclosed. The compact air conditioner includes a housing having an internal cavity and an outer surface with a length that extends along a longitudinal direction, and a width that extends along a horizontal direction that is substantially perpendicular to the longitudinal direction. The compact air conditioner further includes an evaporator assembly arranged within a front portion of the internal cavity of the housing, the evaporator assembly having an evaporator fan, a front motor that drives the evaporator fan, and an evaporator arranged adjacent to the evaporator fan. A condenser assembly is arranged within a back portion of the internal cavity of the housing, the condenser assembly having a condenser fan, a back motor that drives the condenser fan, and a condenser arranged adjacent to the condenser fan. The compact air conditioner also includes a compressor associated with the evaporator assembly and the condenser assembly, an electrical control system, and a fresh air intake assembly that includes an actuation mechanism, a sensor, and an air valve. The fresh air intake assembly is configured to draw in external air from an external air intake grate located at a back portion of the outer surface of the housing, directing the external air through the housing, and expelling the external air out through an air exit vent located at a front portion of the outer surface of the housing.

A method of cooling air within a room using a compact air conditioner is also disclosed. The method includes the steps of providing a housing of the compact air conditioner having an internal cavity and an outer surface with a length that extends along a longitudinal direction and a width that extends along a horizontal direction that is substantially perpendicular to the longitudinal direction, providing an evaporator assembly arranged within a front portion of the internal cavity of the housing, providing a condenser assembly arranged within a back portion of the internal cavity of the housing, providing a compressor associated with the evaporator assembly and the condenser assembly, and providing an electrical control system associated with the evaporator assembly, the condenser assembly, and the compressor. The evaporator assembly includes two centrifugal evaporator fans arranged coaxially along a front rotational axis that is substantially aligned with the horizontal direction, a front motor associated with the evaporator fans, and an evaporator arranged adjacent to the evaporator fans. The condenser assembly includes two centrifugal condenser fans arranged coaxially along a back rotational axis that is substantially aligned with the horizontal direction and substantially parallel to the front rotational axis, a back motor associated with the condenser fans, and a condenser arranged adjacent to the condenser fans. The compressor includes a coolant adapted to circulate between the evaporator and the condenser. The method also includes the step of selectively activating the compact air conditioner to cool air within the room, which includes the sub-steps of selectively activating the compressor to move coolant between the evaporator and the condenser, selectively powering the front motor to drive the two centrifugal evaporator fans concurrently to rotate about the front rotational axis, and selectively powering the back motor to drive the two centrifugal condenser fans concurrently to rotate about the back rotational axis. When the two centrifugal evaporator fans are rotated, they draw air from within the room through a room intake grate located at the front portion of the housing into the internal cavity of the housing, drive that air through the evaporator to be cooled by the evaporator, and expel the cooled air through a cold air exit vent located on the front portion of the housing. When the two centrifugal condenser fans are rotated, they draw ambient air from outside of the room through an external air intake grate located at the back portion of the housing into the internal cavity of the housing, to drive ambient air through the condenser to remove heat from the condenser, and to expel the heated air outwardly along the longitudinal direction through a hot air exist vent located on the back portion of the housing.

For sake of brevity, this summary does not list all aspects of the present application, which are described in further detail below.

BRIEF DESCRIPTION OF THE DRAWINGS

The foregoing summary, as well as the following detailed description of the preferred embodiments of the present application, will be better understood when read in conjunction with the appended drawings. For the purpose of illustrating the invention, there is shown in the drawings embodiments that are presently preferred. It should be understood, however, that the inventions are not limited to the precise arrangements shown in the drawings.

FIG. 55 is a right elevation view of the compact air conditioner as shown in FIG. 54; and FIG. 56 is a cross-sectional view of the compact air conditioner as shown in FIG. 54 taken along line 56-56.

DETAILED DESCRIPTION OF THE PREFERRED EMBODIMENTS

Figure 1:
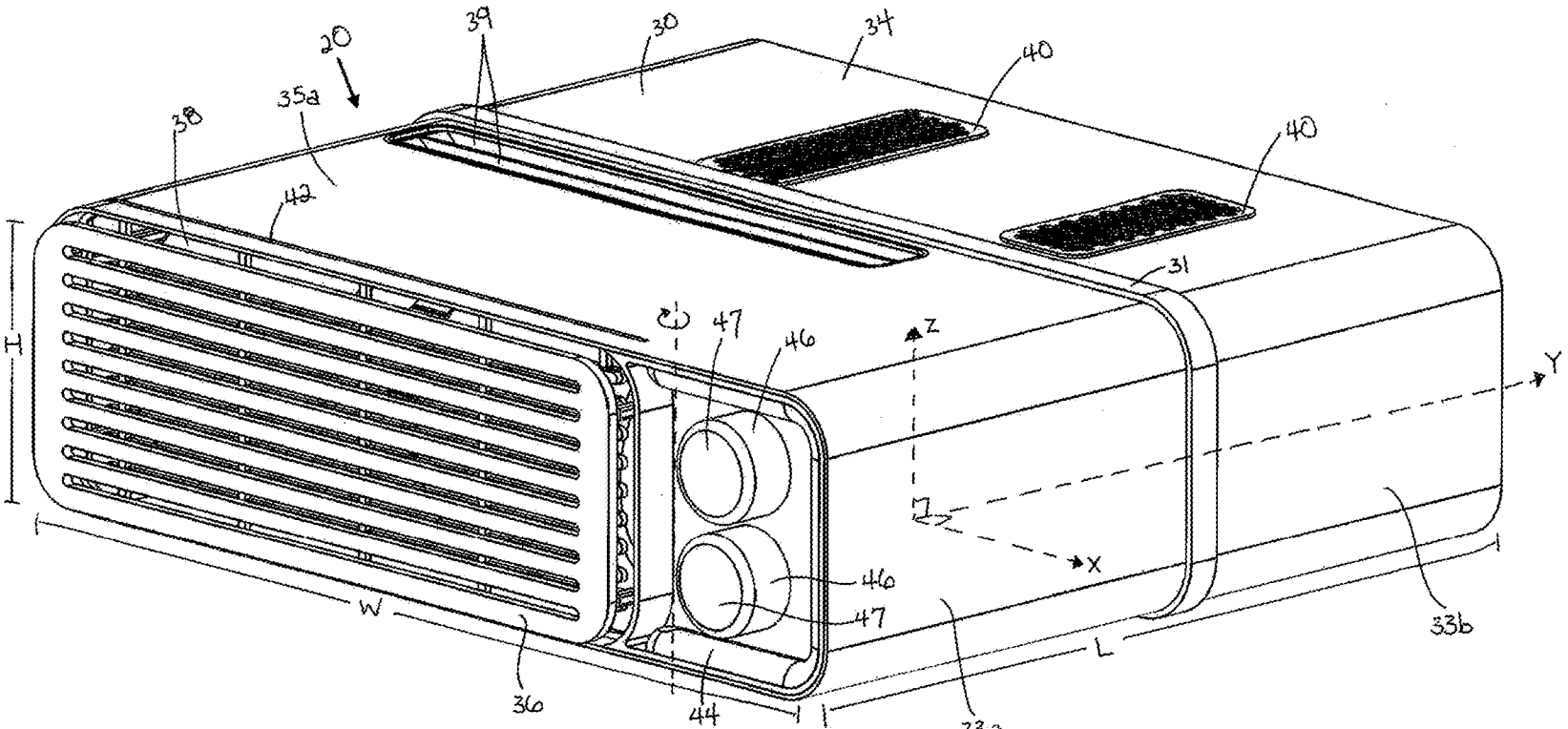
FIG. 1 is a front perspective view of an embodiment of a compact air conditioner.

Certain terminology is used in the following description for convenience only and is not limiting. The words "front," "back," "top," "bottom," "inner," "outer," "upper," "lower," "internal," and "external" designate directions in the drawings to which reference is made. The words "upward," "downward," "above," and "below" refer to directions towards a higher or lower position from the parts referenced in the drawings. The words "inward" and "outward" refer to directions towards an inner or outer portion of the element referenced in the drawings. The words "clockwise" and "counterclockwise" are used to indicate opposite relative directions of rotation, and may be used to specifically refer to directions of rotation about an axis in accordance with the well-known right hand rule. Additionally, the terms "a" and "one" are defined as including one or more of the referenced item unless specifically noted otherwise. A reference to a list of items that are cited as "at least one of a, b, or c" (where a, b, and c represent the items being listed) means any single one of the items a, b, or c, or combinations thereof. The terminology includes the words specifically noted above, derivatives thereof, and words of similar import.

Figure 6:
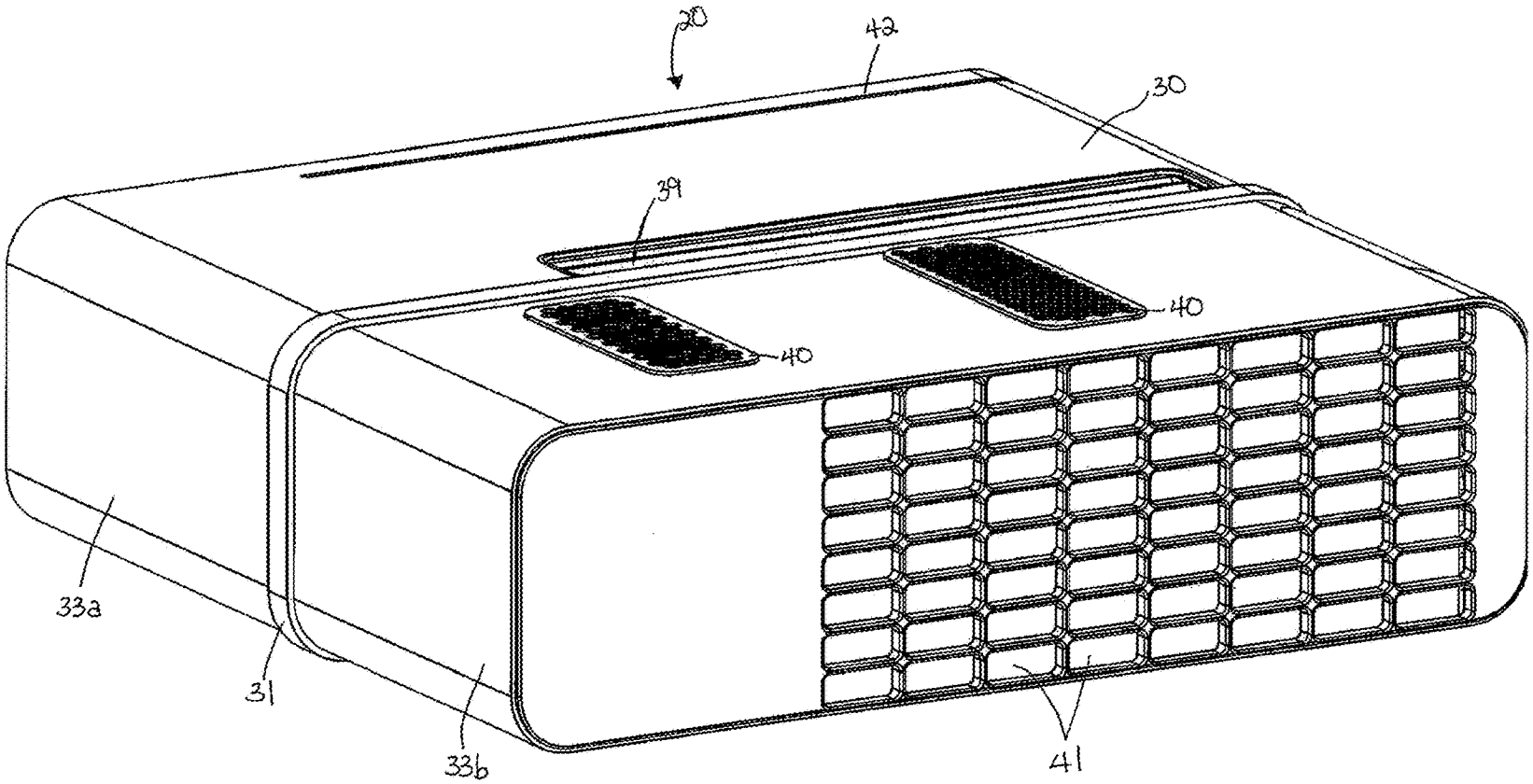
Figure 7:
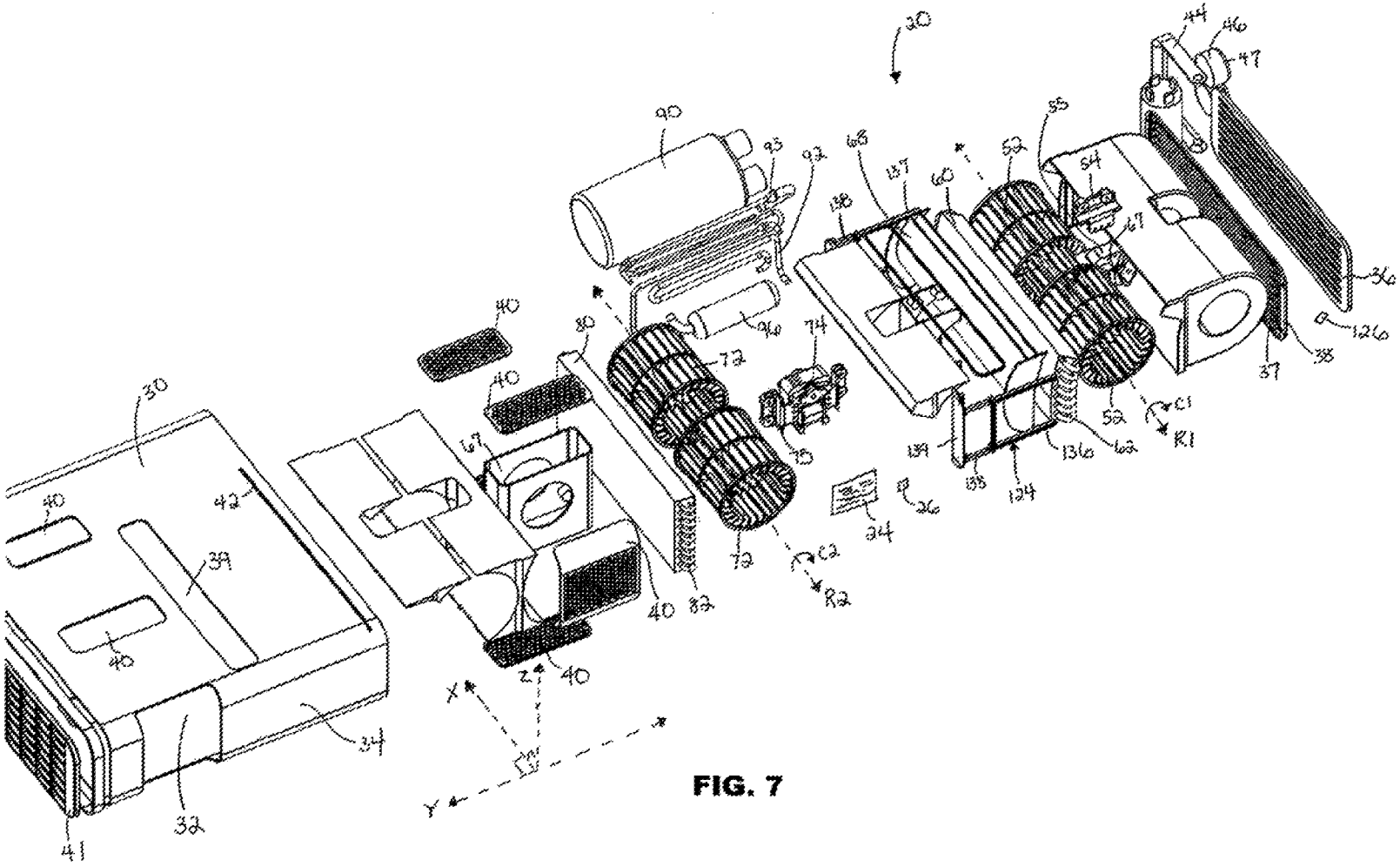
FIGS. 7-9 are exploded views of the compact air conditioner shown in FIG. 1.
Figure 12:
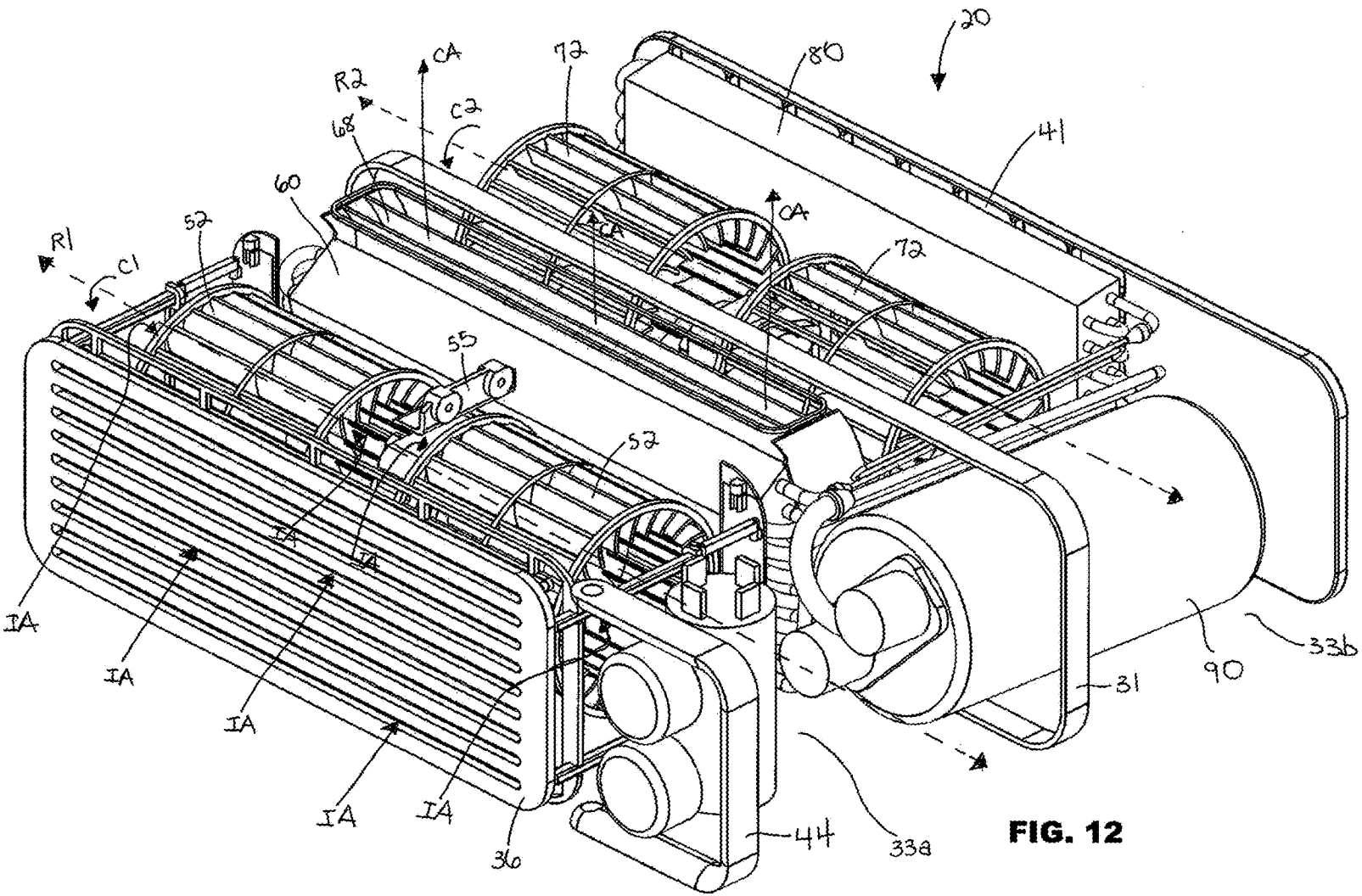
FIG. 12 is a front perspective view of the compact air conditioner shown in FIG. 1, with certain portions of the housing and internal fairings.
Figure 13:
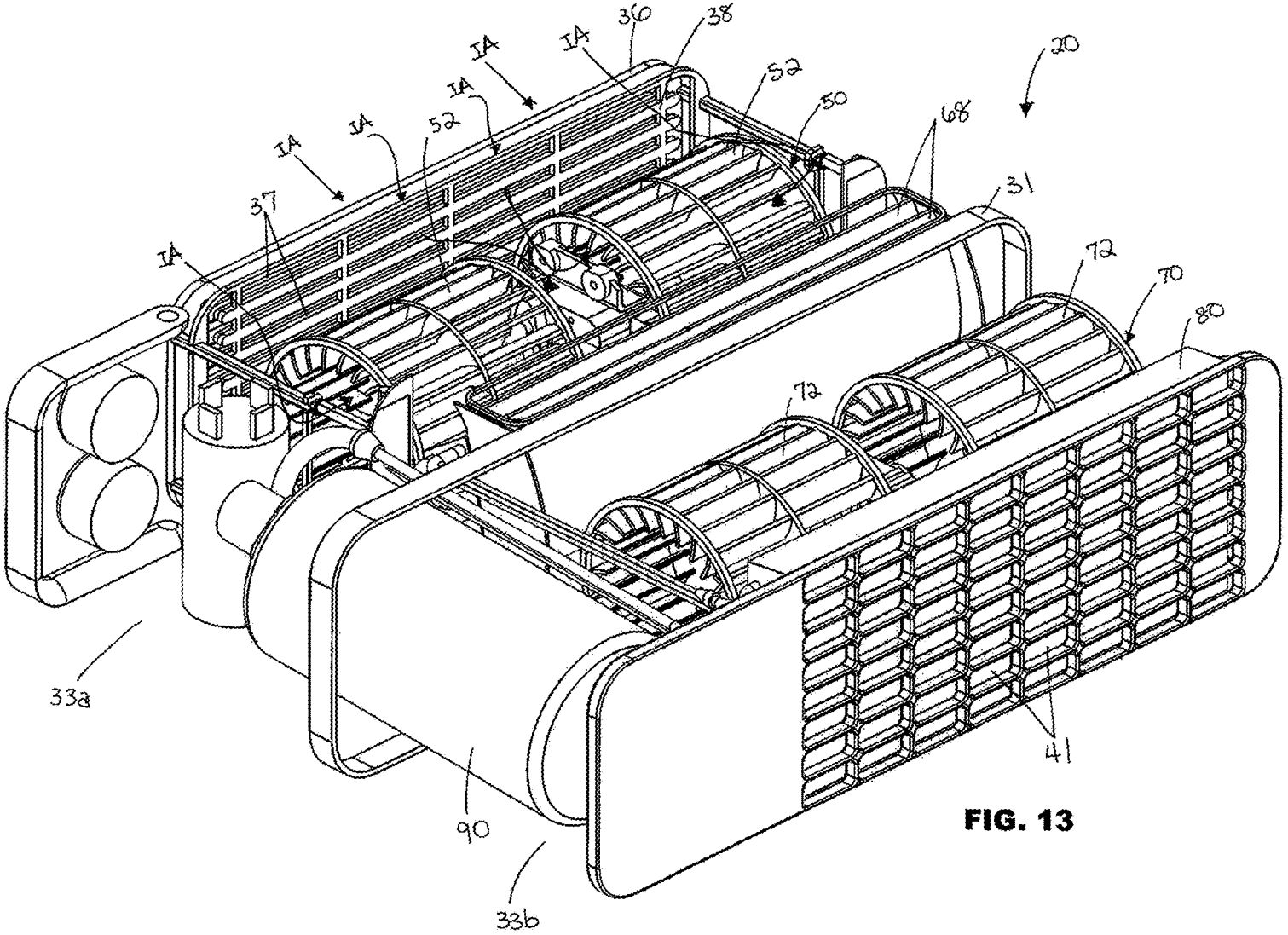
FIG. 13 is a back perspective view of the compact air conditioner shown in FIG. 1, with certain portions of the housing and internal fairings removed.
Figure 14:
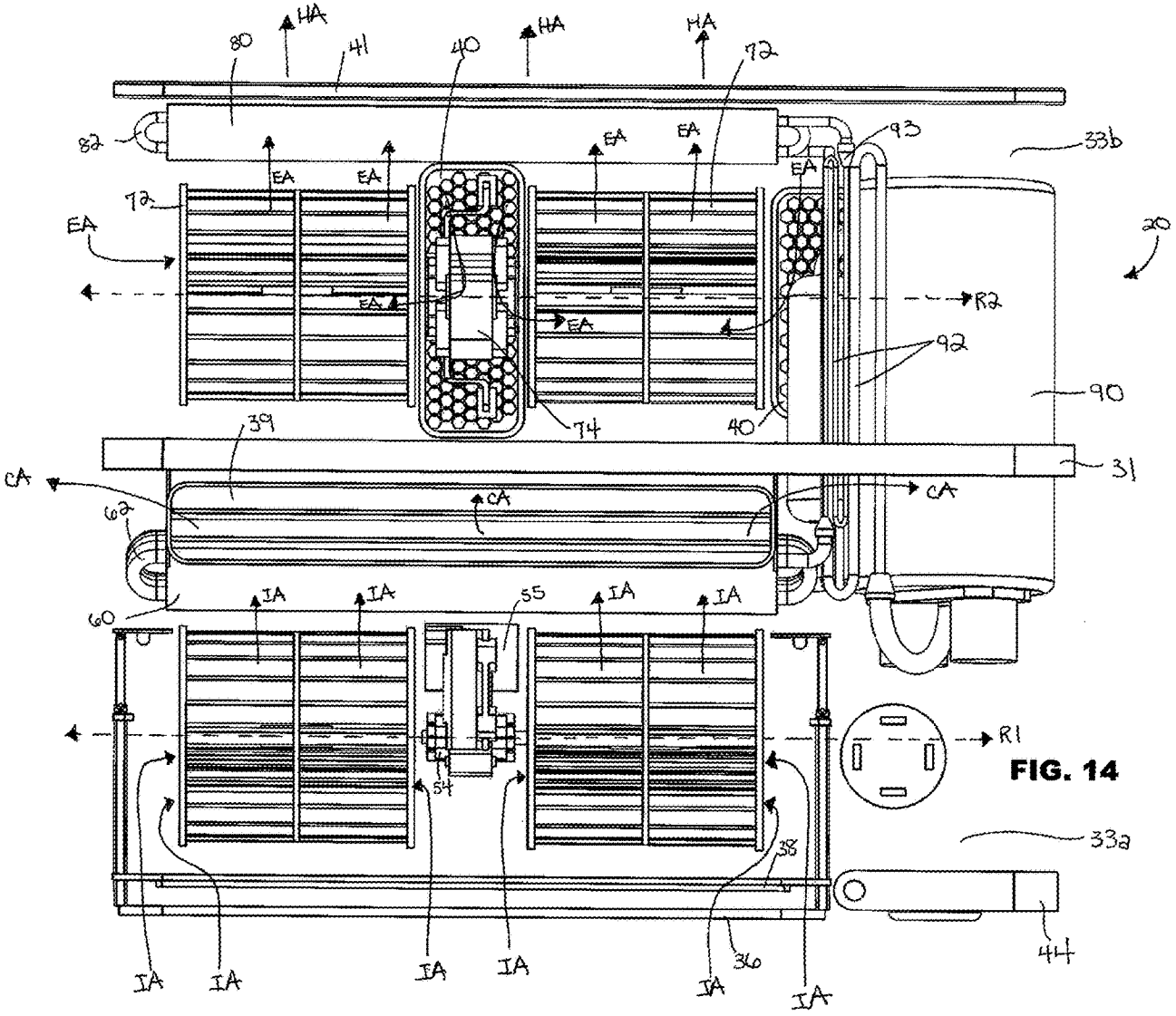
FIG. 14 is a top plan view of the compact air conditioner as shown in FIG. 12.
Figure 20:
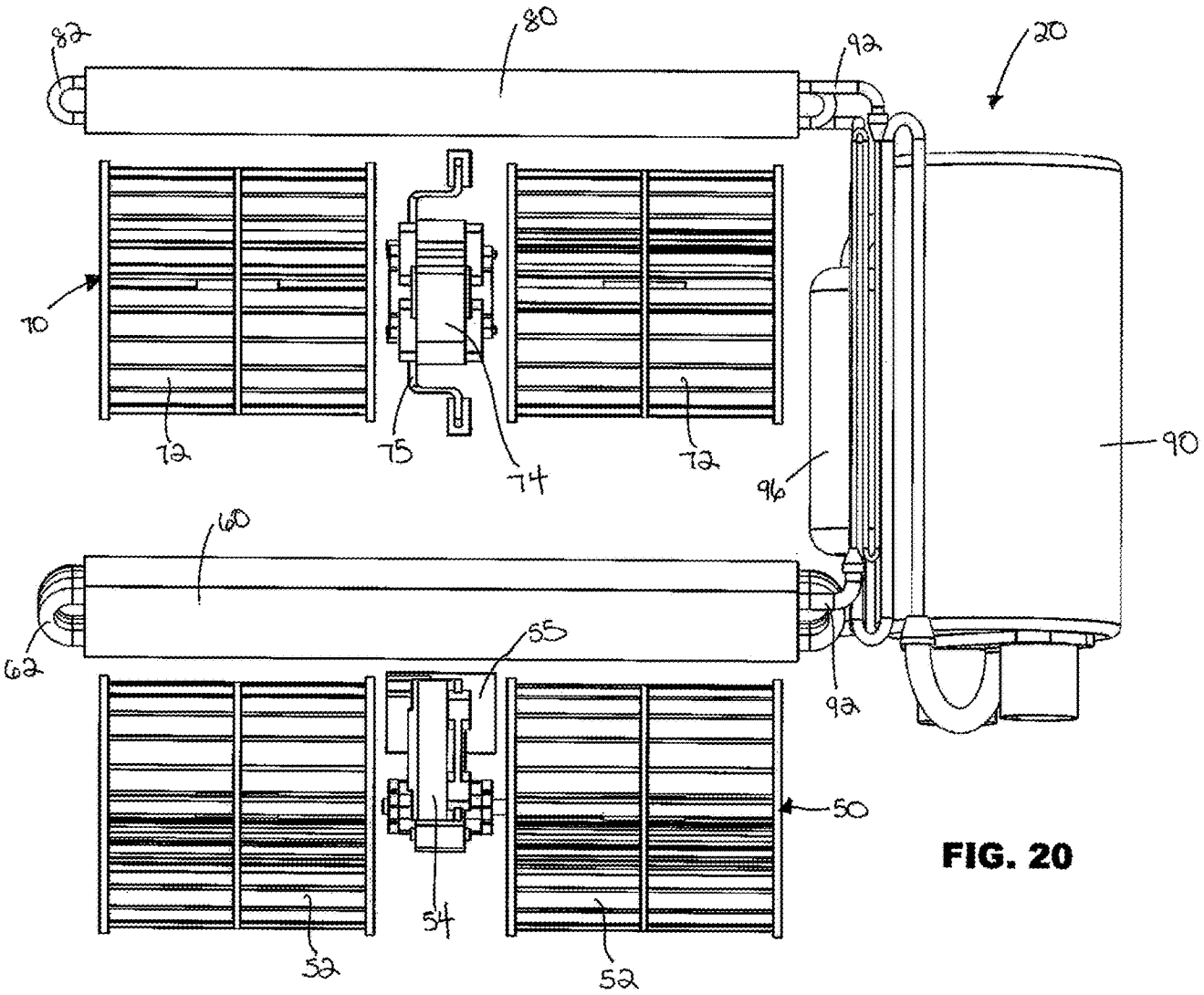
FIG. 20 is a top plan view of the evaporator assembly, condenser assembly, and compressor shown in FIG. 18.
Figure 21:
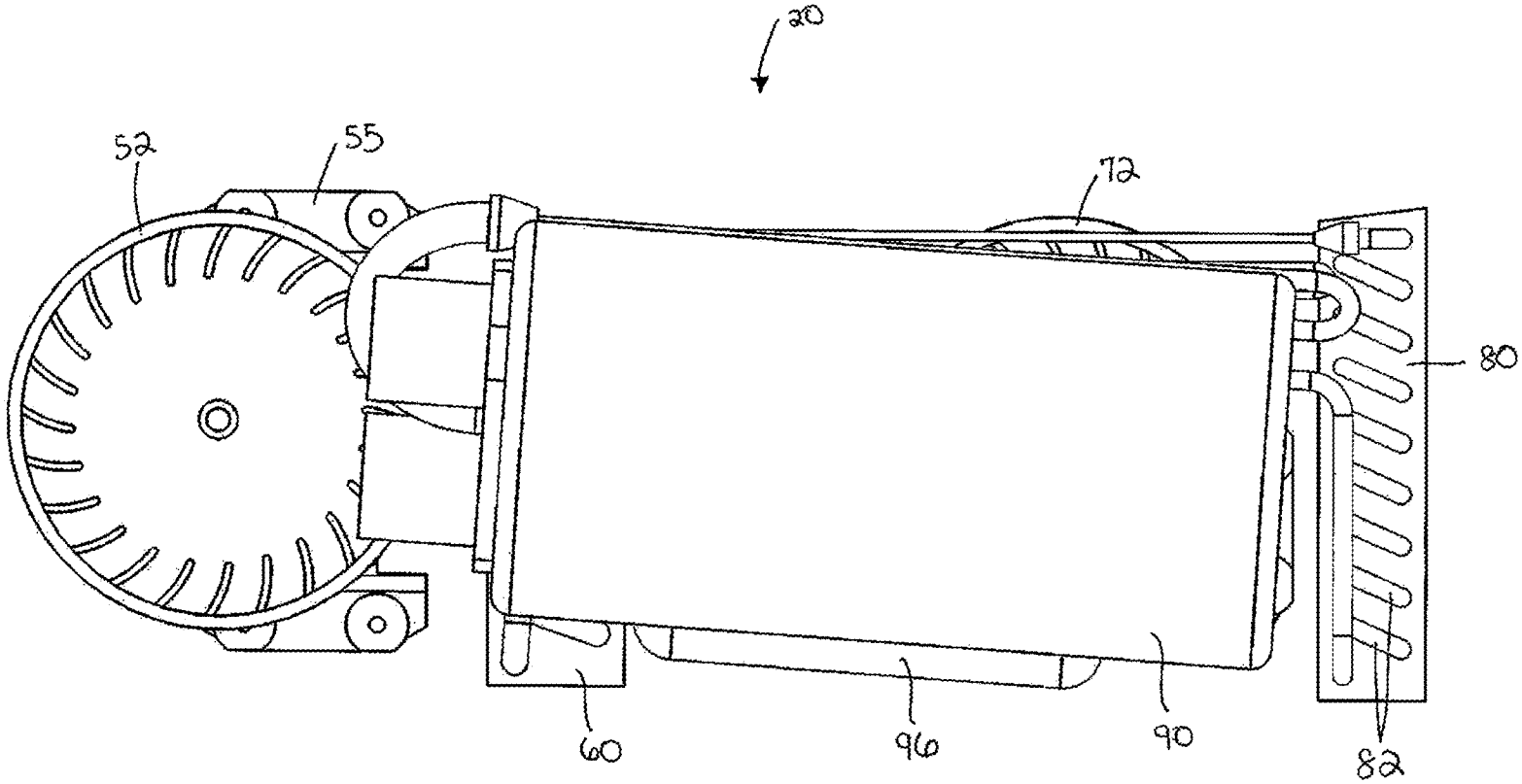
FIG. 21 is a right elevation view of the evaporator assembly, condenser assembly, and compressor shown in FIG. 18.
Figure 22:
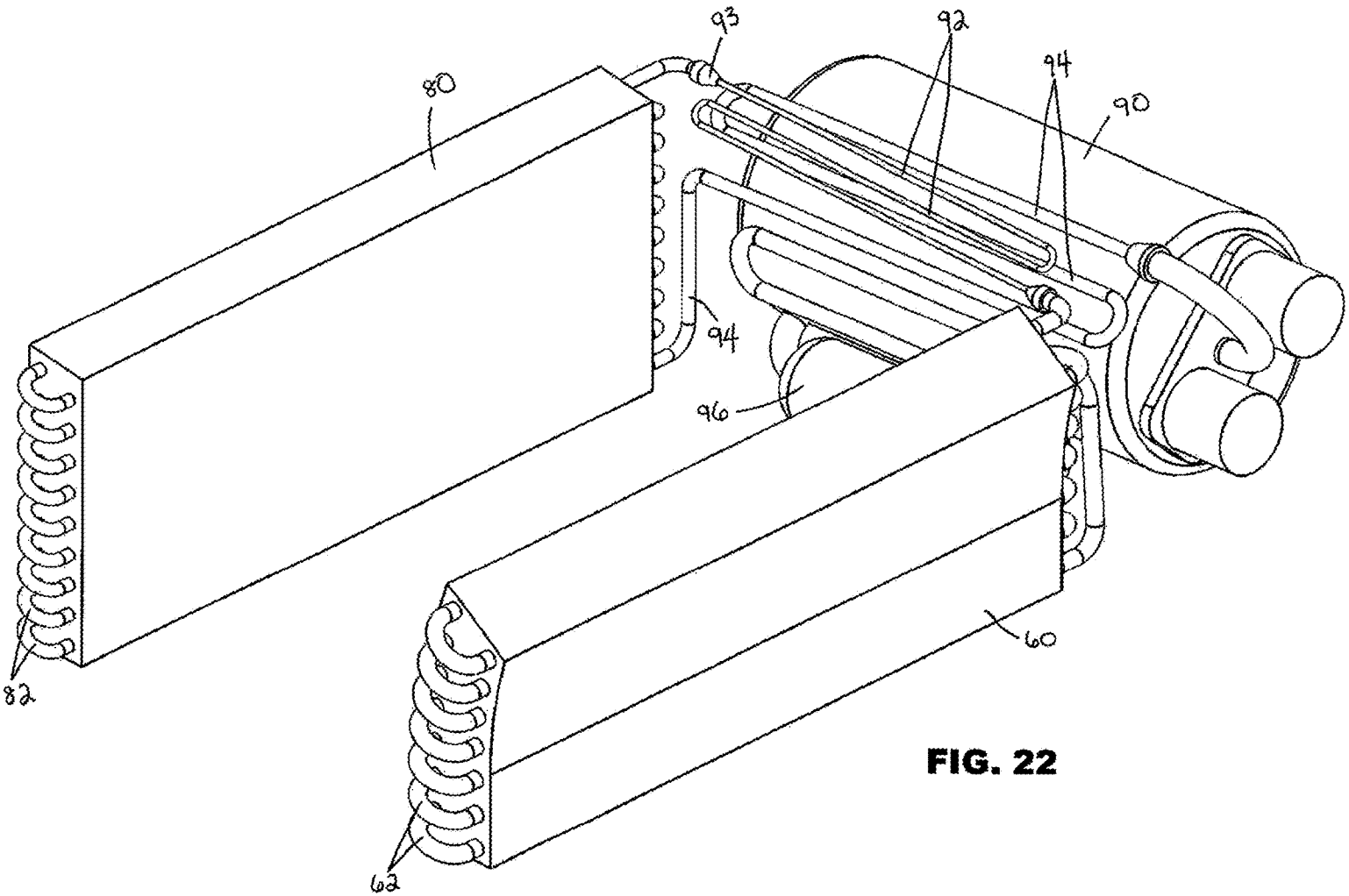
FIGS. 22 and 23 are front perspective views of an evaporator, a condenser, a compressor, and an accumulator of the compact air conditioner shown in FIG. 1.
Figure 23:
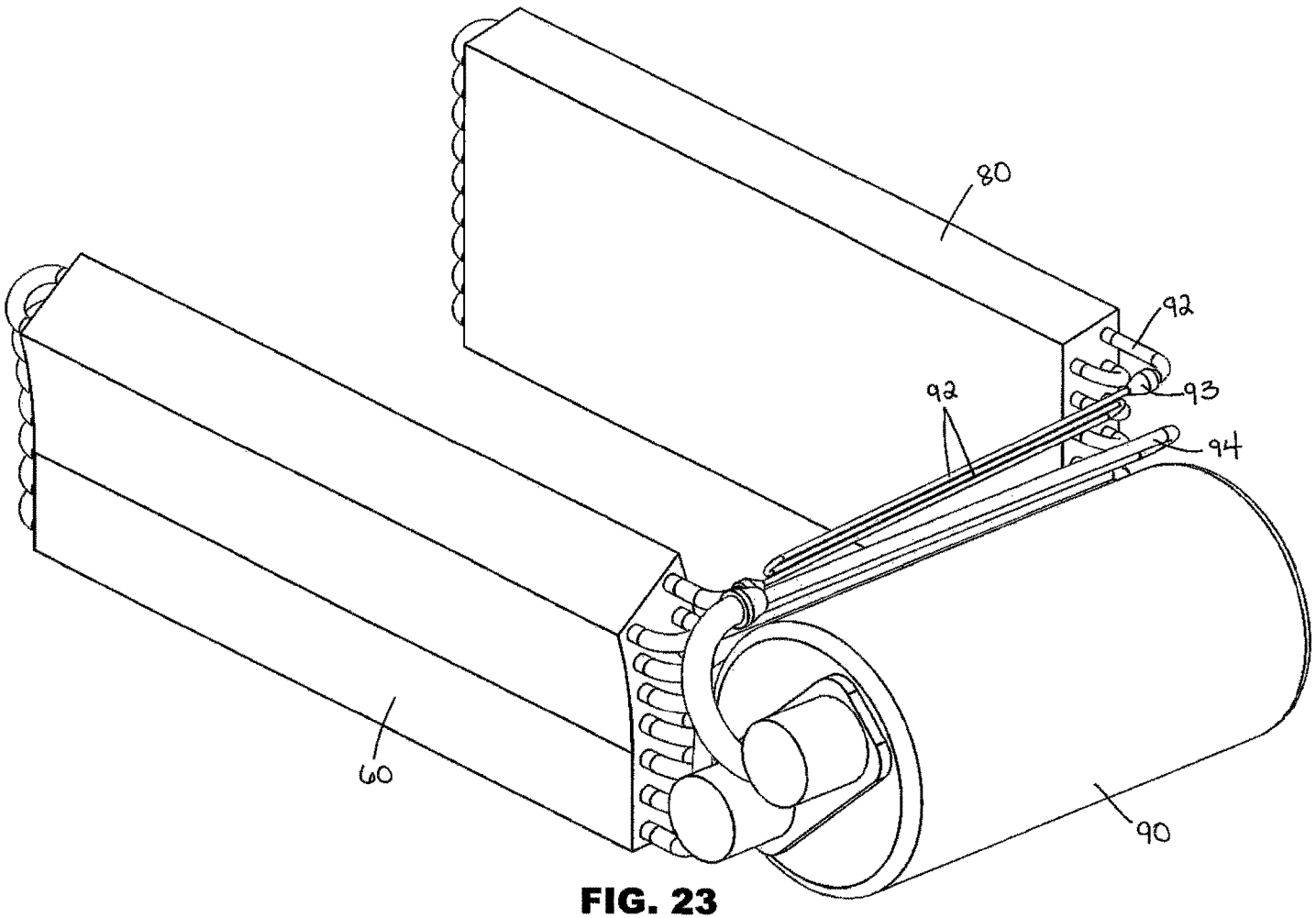
Figure 24:
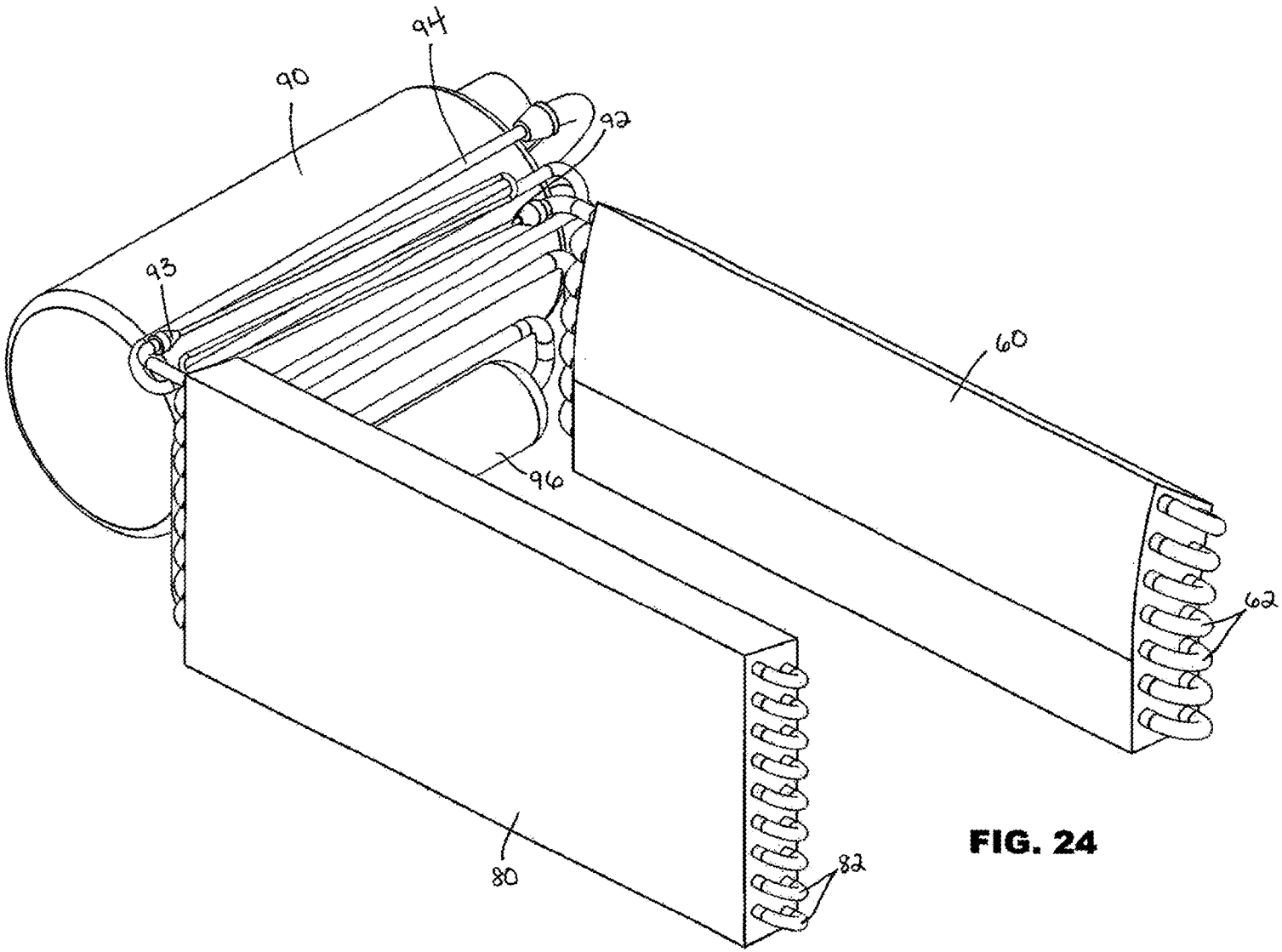
FIGS. 24 and 25 are back perspective views of the evaporator, condenser, compressor, and accumulator shown in FIG. 22.
Figure 25:
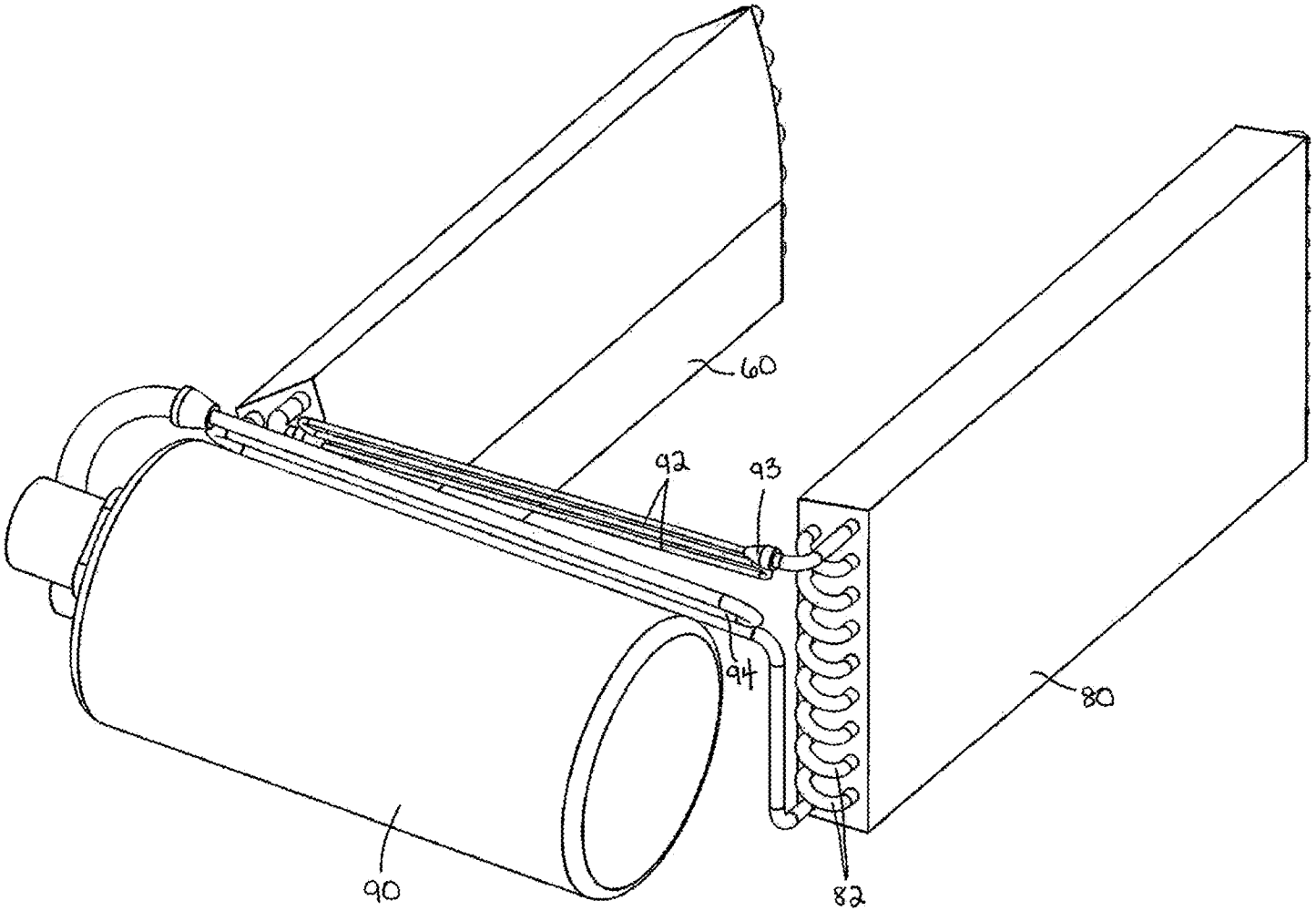
Figure 26:
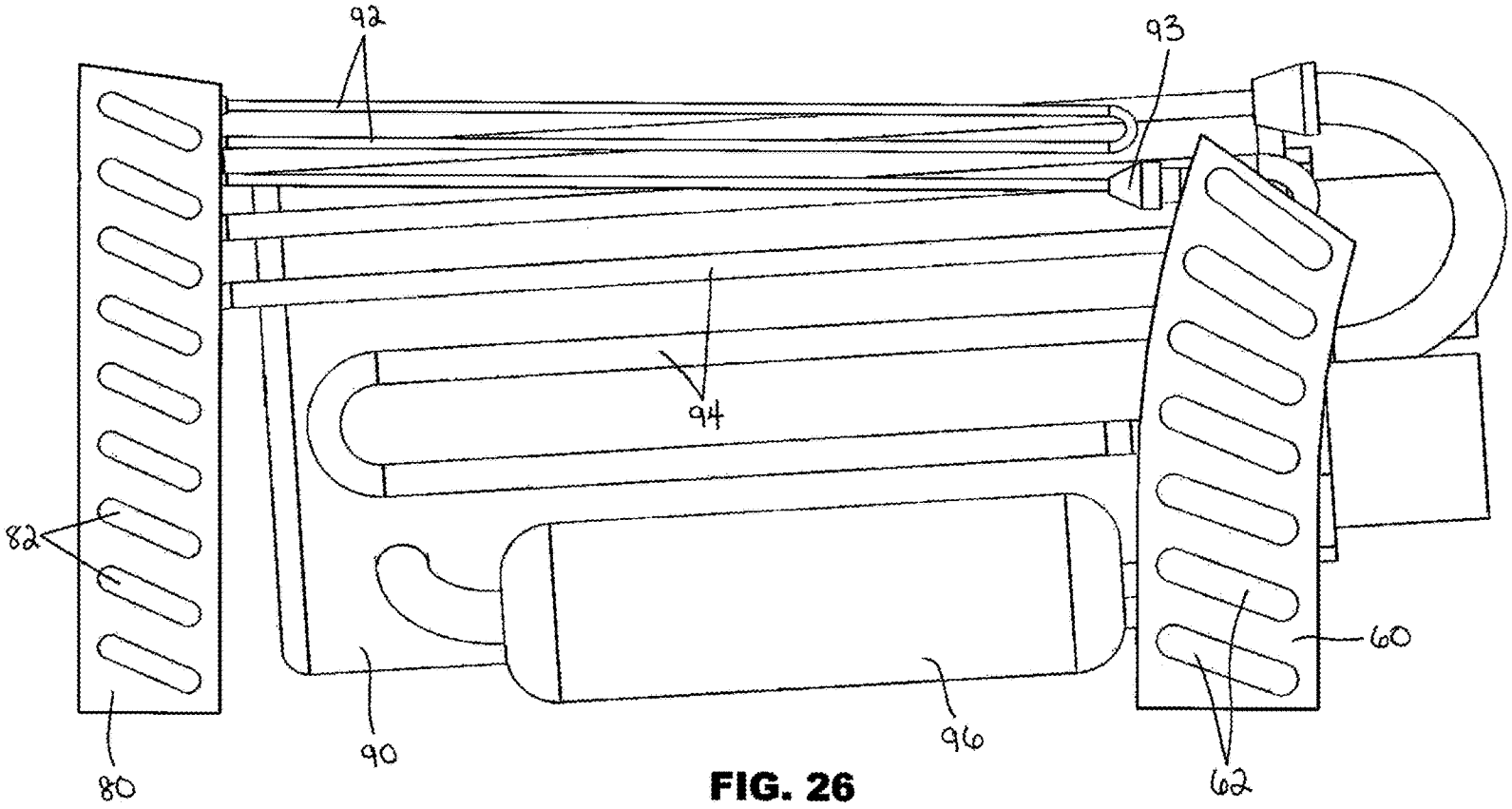
FIG. 26 is a left elevation view of the evaporator, condenser, compressor, and accumulator shown in FIG. 22.
Figure 27:
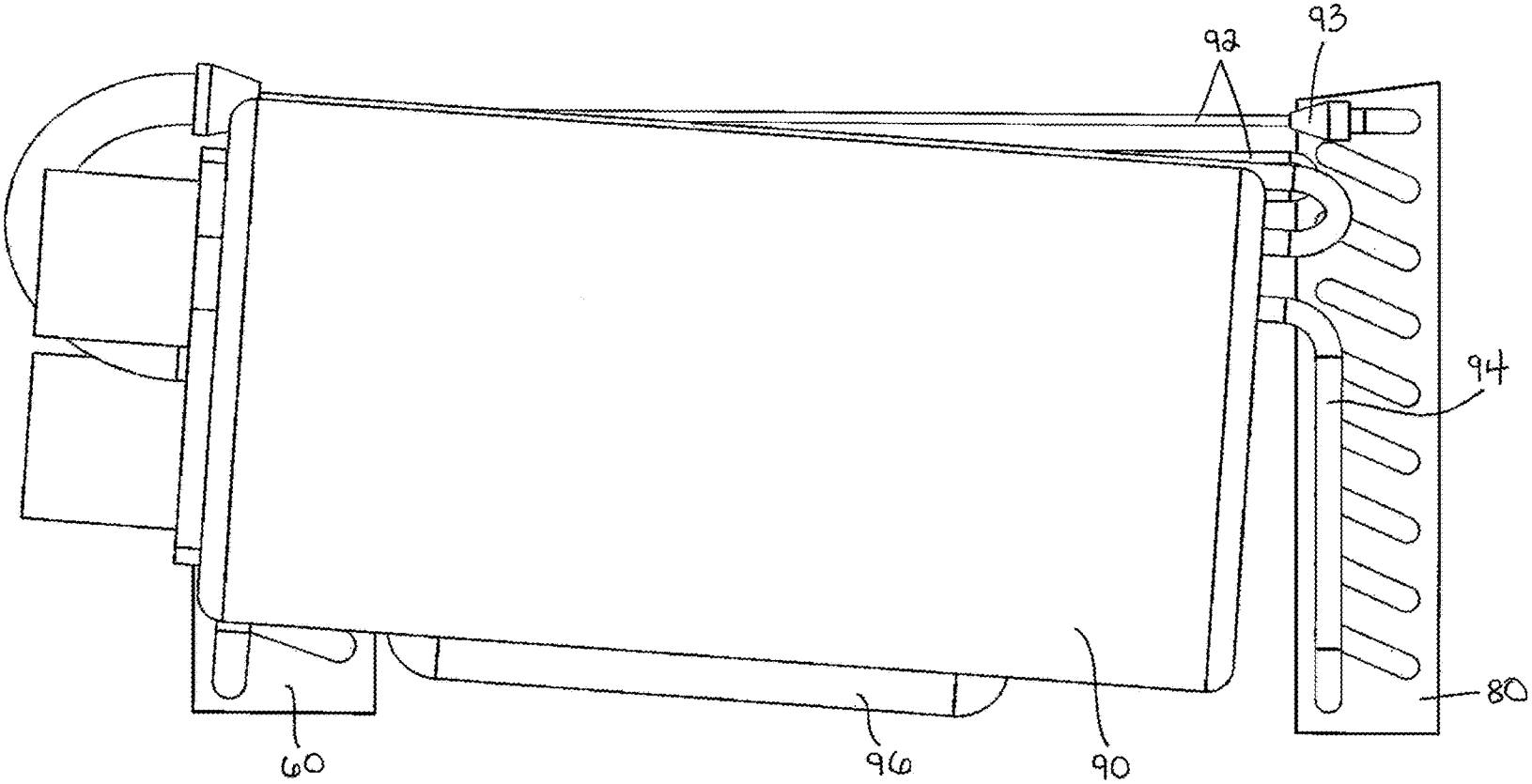
FIG. 27 is a right elevation view of the evaporator, condenser, compressor, and accumulator shown in FIG. 22.
Figure 28:
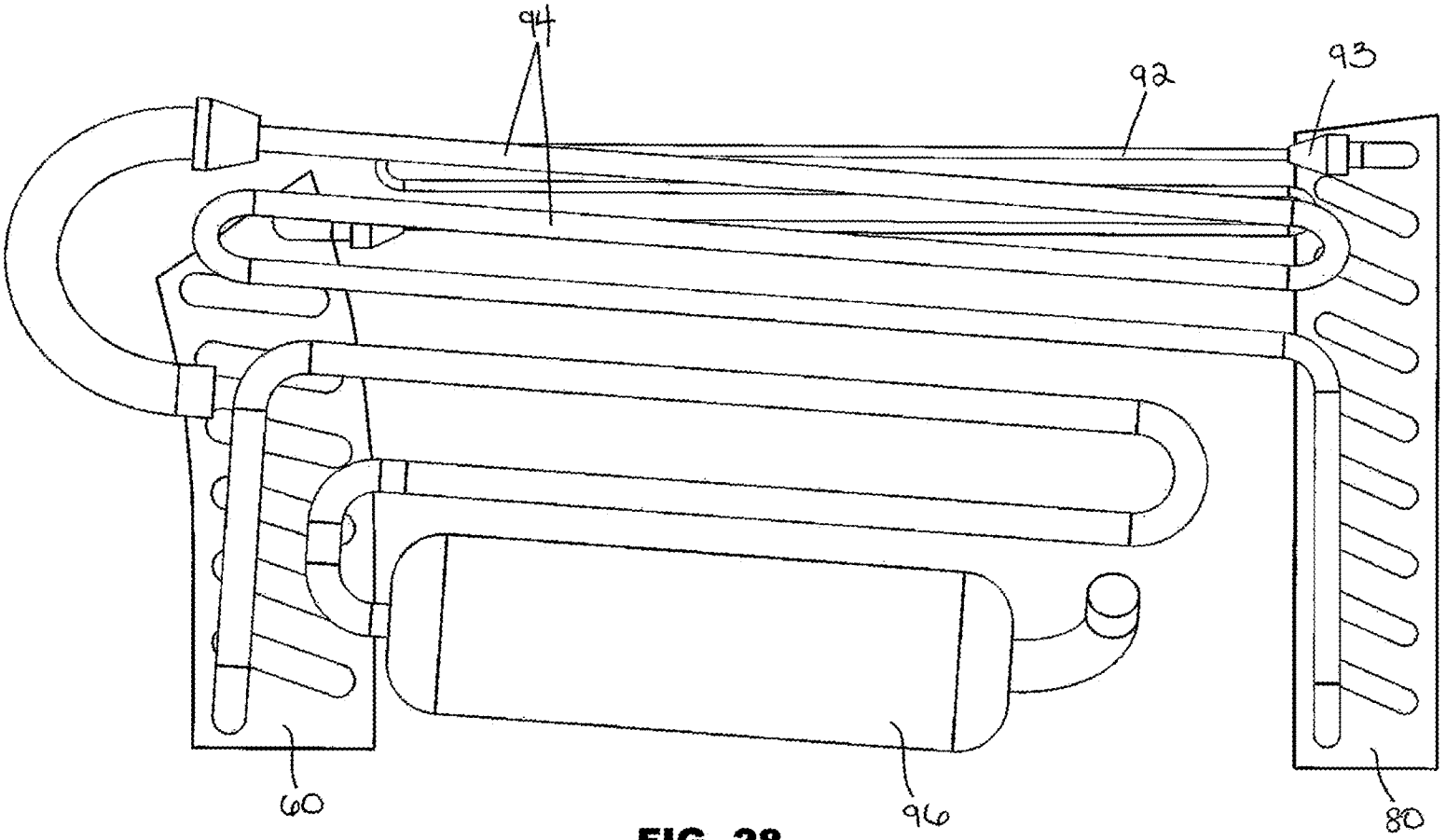
FIG. 28 is a right elevation view of the evaporator, condenser, and accumulator shown in FIG. 22, with the compressor removed.
Figure 29:
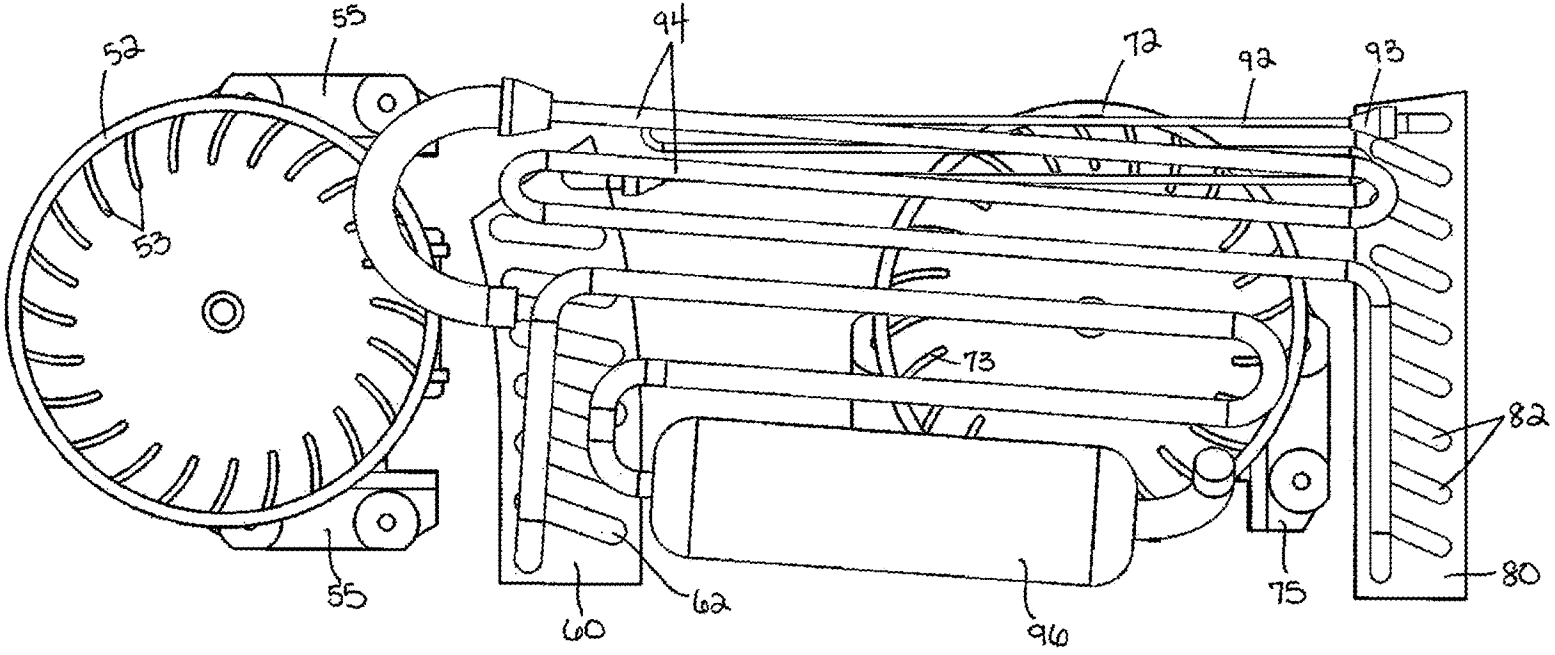
FIG. 29 is a right elevation view of the evaporator assembly, condenser assembly, and accumulator of the compact air conditioner shown in FIG. 1, with the compressor removed.
Figure 30:
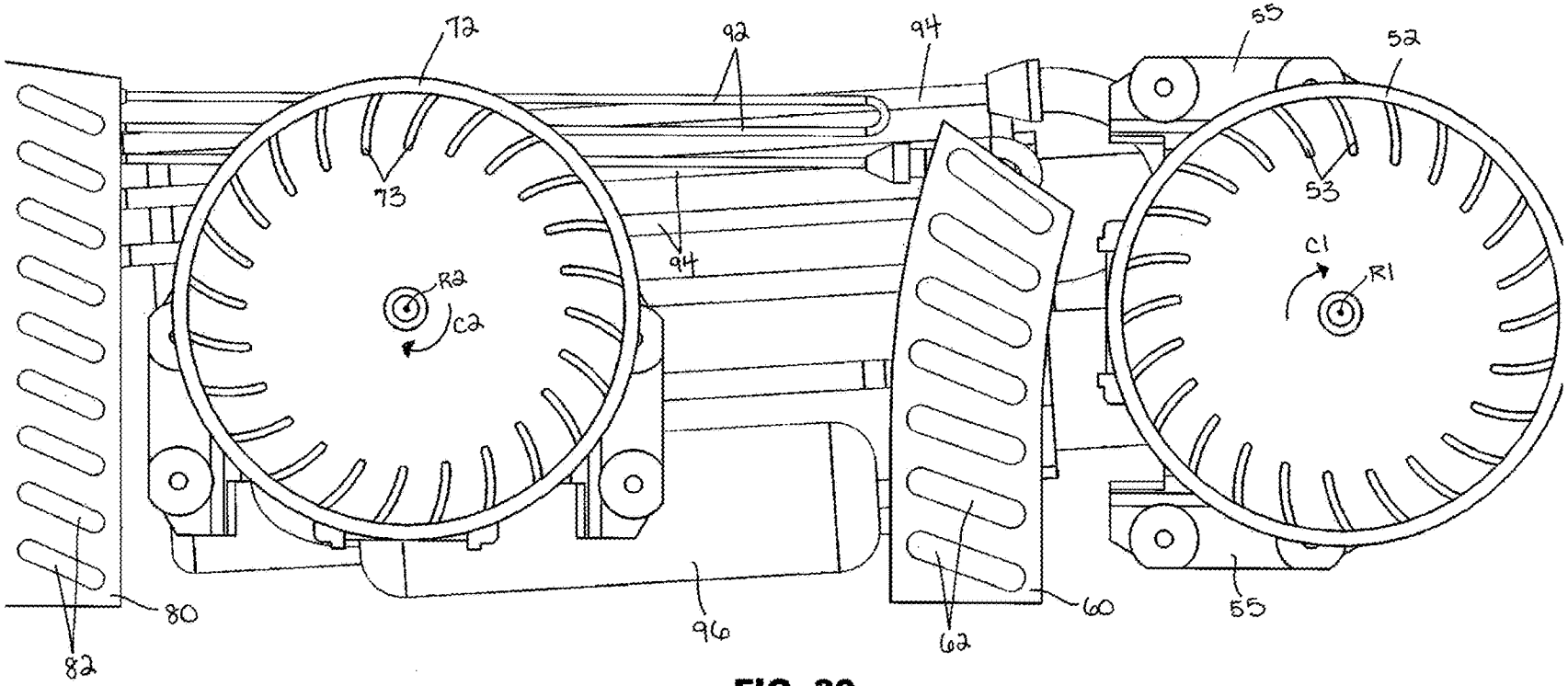
FIG. 30 is a left elevation view of the evaporator assembly, condenser assembly, and accumulator shown in FIG. 29.

FIGS. 1-14 show an embodiment of a compact air conditioner 20 according to the present application, which may include a fresh air intake assembly 120 and may be mounted in a window opening to cool the interior of a building or room. As shown in FIGS. 1 and 7, the compact air conditioner 20 includes a housing 30 having an internal cavity 32 and an outer surface 34 with a length L that extends along a longitudinal direction (shown by the arrow Y), and a width W that extends along a horizontal direction (shown by the arrow X) that is substantially perpendicular to the longitudinal direction Y. The housing 30 may further include a height H that extends along a vertical direction (shown by the arrow Z) that is substantially perpendicular to both the horizontal direction X and the longitudinal direction Y. As shown in FIG. 12, the compact air conditioner 20 further includes an evaporator assembly 50 arranged within a front portion 33*a* of the internal cavity 32 of the housing 30, a condenser assembly 70 arranged within a back portion 33*b* of the internal cavity 32 of the housing 30, and a compressor 90 or a thermoelectric heat pump associated with the evaporator assembly 50 and the condenser assembly 70. The compressor 90 or thermoelectric heat pump includes a coolant adapted to transfer heat between the evaporator assembly 50 and the condenser assembly 70. Where a compressor 90 is used, the coolant is configured to circulate between the evaporator assembly 50 and the condenser assembly 70. Where a thermoelectric heat pump is used, the evaporator 60 and the condenser 80 each contains its own coolant, which does not circulate between the two elements but rather interacts with the thermoelectric heat pump to transfer heat therebetween. As shown in FIGS. 7 and 20, the compact air conditioner 20 may also include an accumulator 96 associated with the compressor 90. One of ordinary skill in the art will appreciate that there are many different types of compressors, including without limitation rotary compressors, piston compressors, and electrolytic compressors, any of which may be used with the present compact air conditioner 20. Furthermore, a variety of coolants having the requisite heat transfer characteristics may be used in the present compact air conditioner 20, including without limitation coolants that undergo phase transitions as it circulate throughout the system, which are common known as refrigerants. In an embodiment of the present compact air conditioner 20 where a thermoelectric heat pump is used in place of the compressor 90, the coolant does not circulate between the evaporator 60 and the condenser 80, but rather is separately contained in the evaporator 60 and the condenser 80 individually, as will be described in detail below. For purposes of the present application, the reference to a "refrigerant" is used for convenience only, and does not limit the specific coolant that may be used to a known AC refrigerant or a coolant that undergoes phase transitions, and instead may refer broadly to any coolant or heat transfer fluid that is capable of being circulated to transfer heat between components of the present compact air conditioner 20, including coolants that keep its phase or the use of solid materials as coolants.

Figure 2:
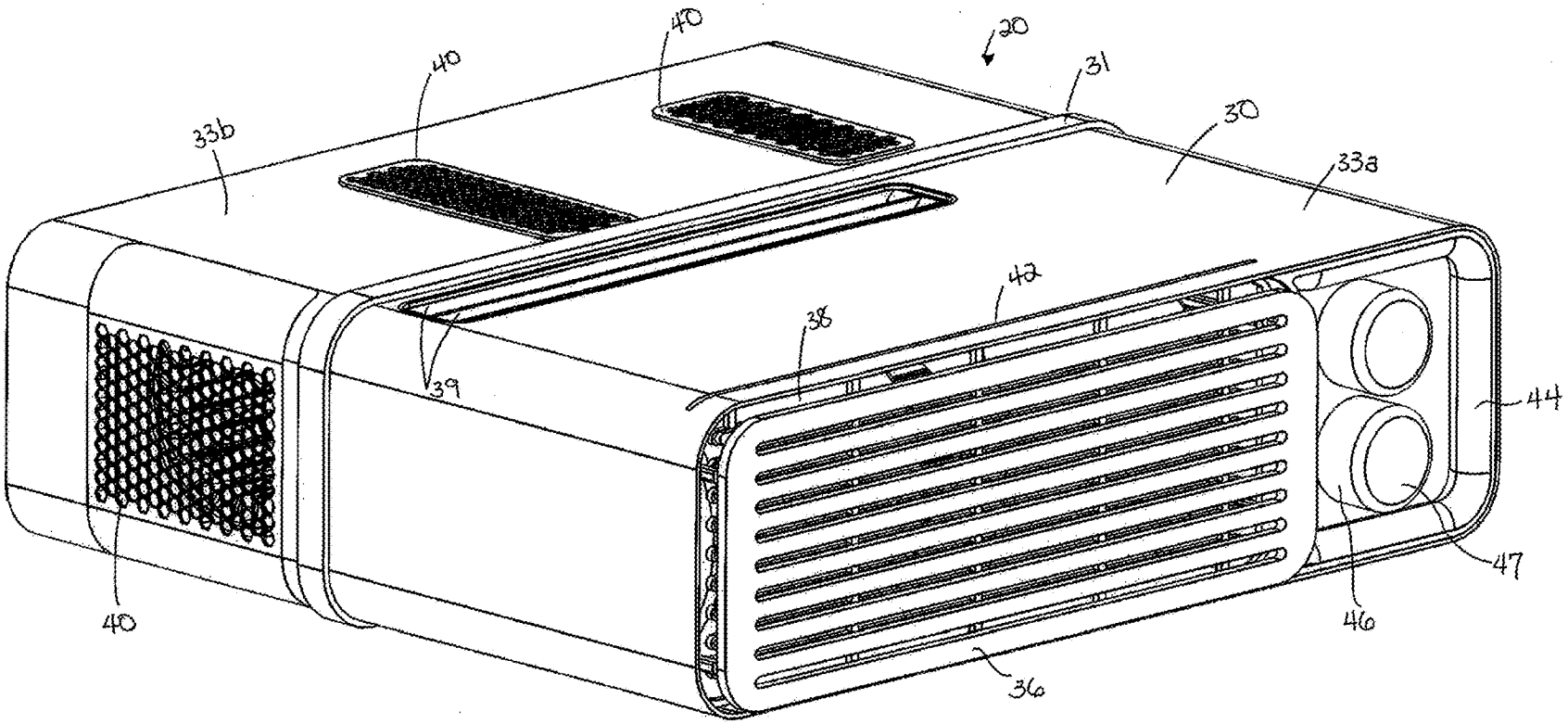
FIG. 2 is another front perspective view of the compact air conditioner shown in FIG. 1.
Figure 3:
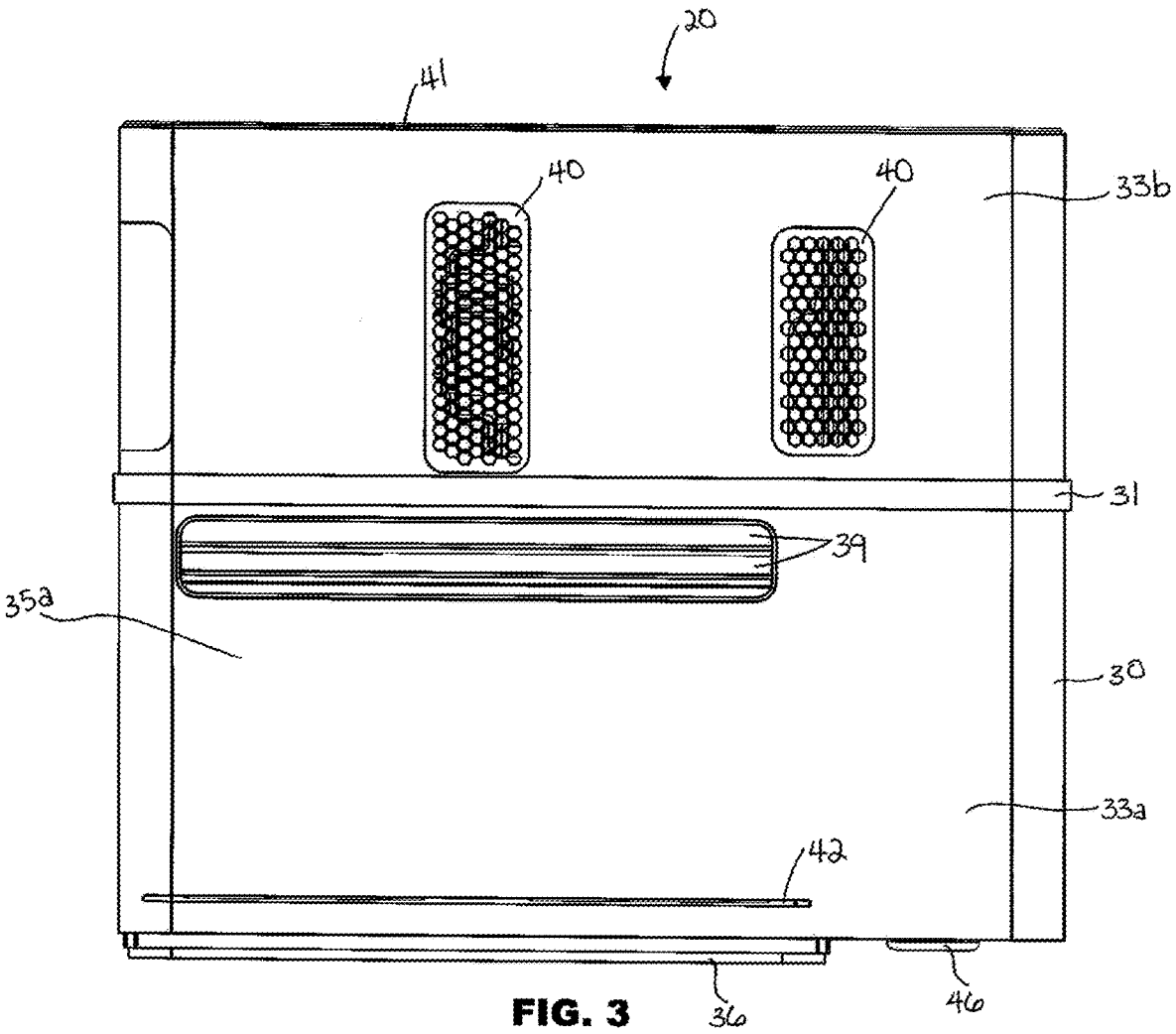
FIG. 3 is a top plan view of the compact air conditioner shown in FIG. 1.
Figure 4:
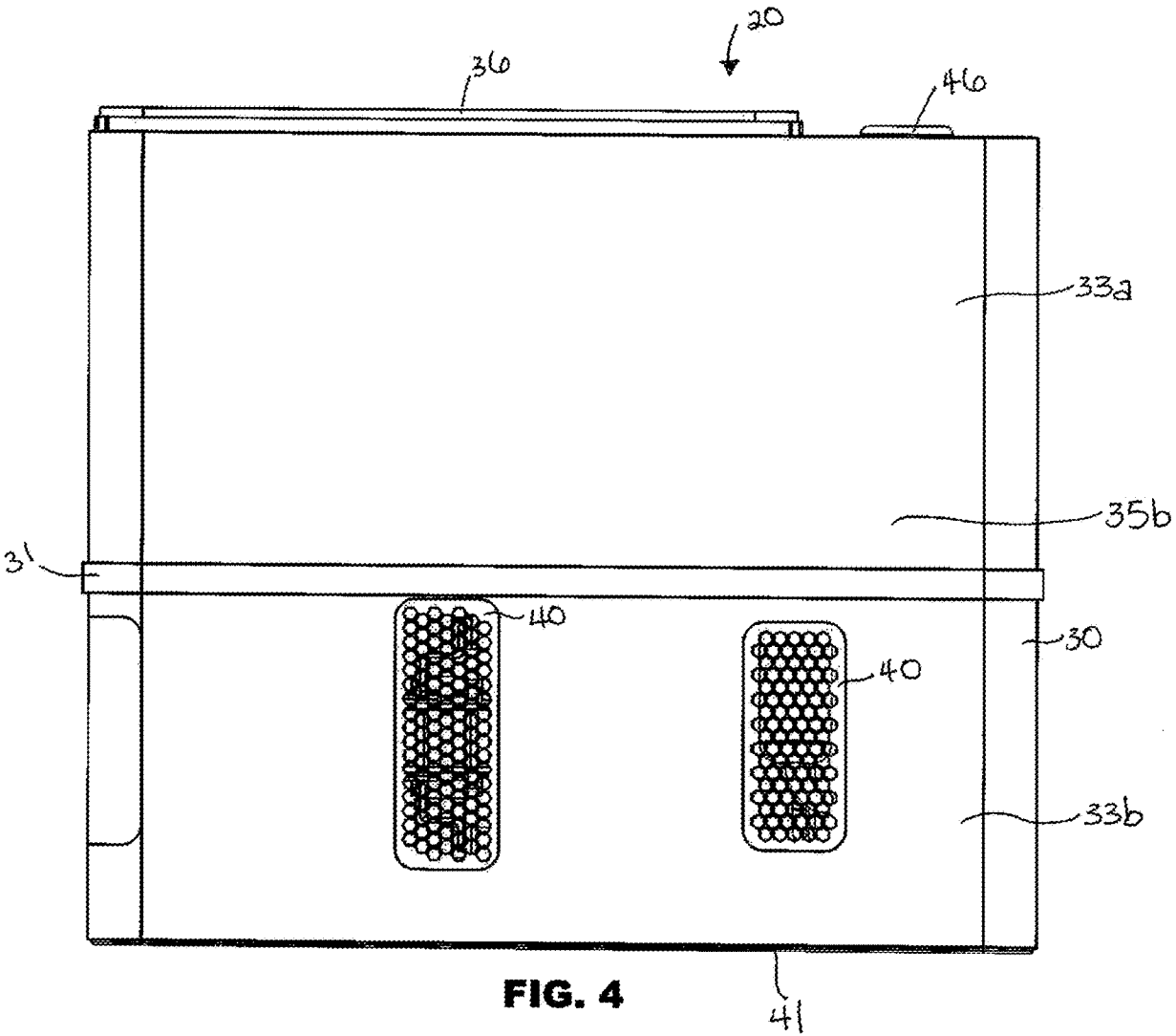
FIG. 4 is a bottom plan view of the compact air conditioner shown in FIG. 1.
Figure 45:
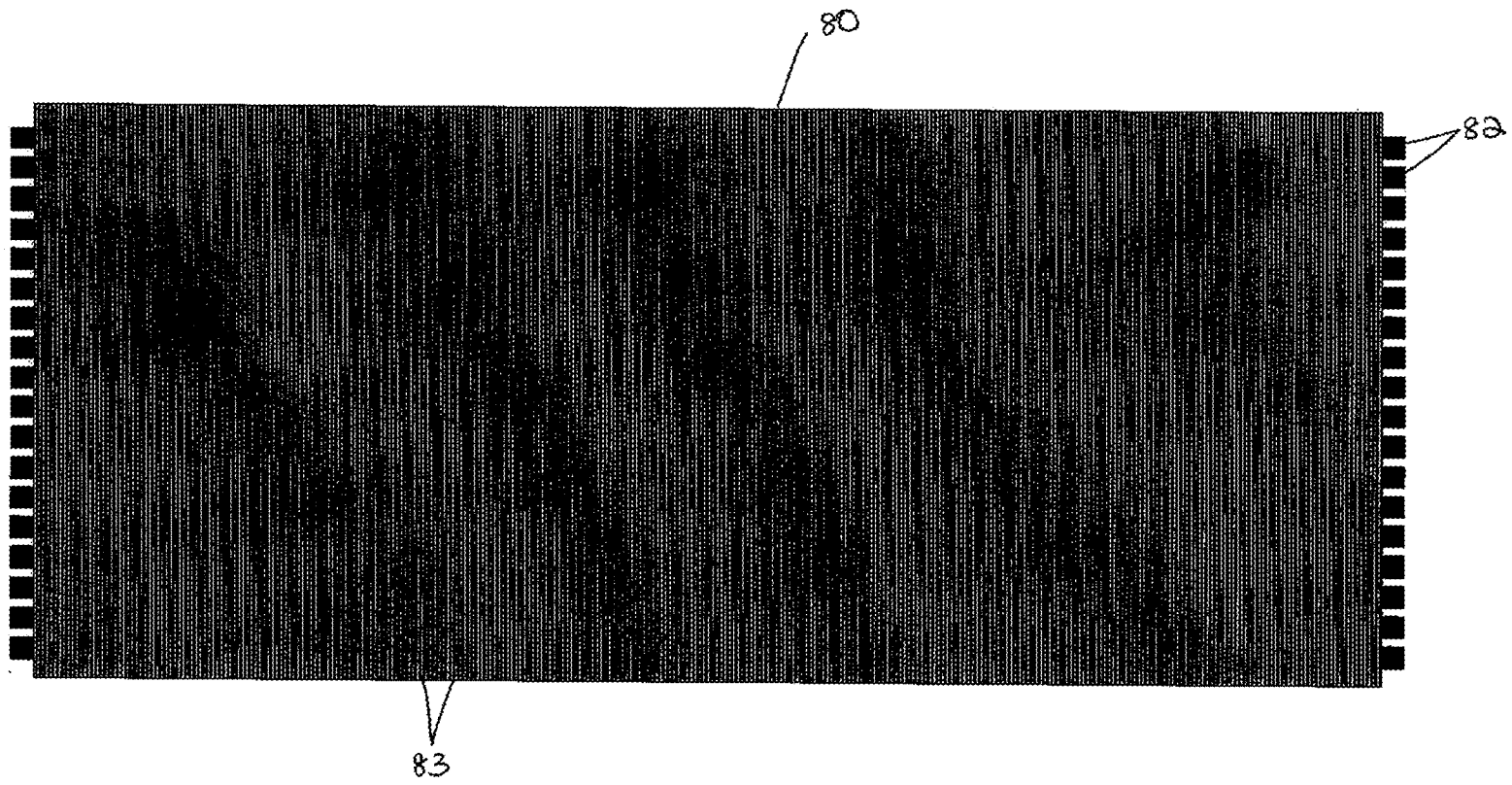
FIG. 45 is a front elevation view of the condenser of the compact air conditioner shown in FIG. 1, showing the fins of the condenser.
Figure 46:
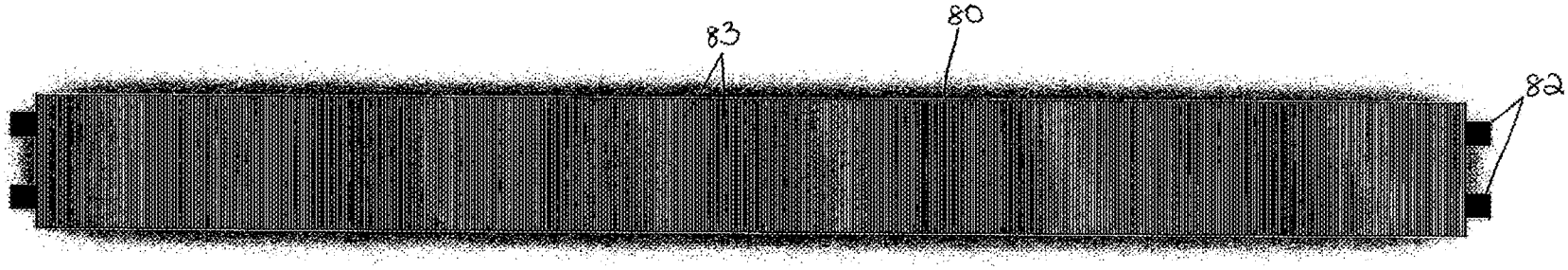
FIG. 46 is a top plan view of the condenser shown in FIG. 45.

The evaporator assembly 50 is shown in greater detail in FIGS. 7-9 and 12-20, and includes an evaporator fan 52 having a front rotation axis R1 that is substantially aligned with the horizontal direction X, a front motor 54 that drives the evaporator fan 52 to rotate about the front rotational axis R1, and an evaporator 60 arranged adjacent to the evaporator fan 52. Similarly, the condenser assembly 70 includes a condenser fan 72 having a back rotational axis R2 that is substantially aligned with the horizontal direction X and substantially parallel to the front rotational axis R1, a back motor 74 that drives the condenser fan 72 to rotate about the back rotational axis R2, and a condenser 80 arranged adjacent to the condenser fan 72. Although the evaporator 60 and condenser 80 are shown in the figures as having solid rectangular bodies, one of ordinary skill in the art would appreciate that each of the evaporator 60 and condenser 80 may be a heat sink, which is well-known in the art and made up of a plurality of fins through which air can flow. The fins of the evaporator 60 and condenser 80 heat sinks are preferably formed from a material having good heat transfer properties, and may be arranged vertically such that air may flow between adjacent fins. An example of the fin orientation of the condenser 80 is shown in FIGS. 45 and 46, in which the fins 83 are very thin and are arranged vertically along the body 81 of the condenser 80, to maximize the surface area of the fins 83 as external air EA is blown through the body 81 of the condenser 80 to cool down the refrigerant or other coolant circulating through the condenser tubing 82.

Where a thermoelectric heat pump is used in place of a traditional compressor 90, each of the evaporator 60 and condenser 80 may include a heat pipe containing a suitable coolant, and be thermally associated with the thermoelectric heat pump, such that the coolant within the heat pipes of the evaporator 60 and condenser 80 is being heated or cooled by the thermoelectric heat pump to transfer heat out of the interior of the room to be cooled. As shown in FIG. 7, the compact air conditioner 20 may also include an electrical control system 24 associated with at least one of the evaporator assembly 50, condenser assembly 70, or compressor 90. The electrical control system 24 may specifically be configured to control the front motor 54 and back motor 74 independently of each other. The compact air conditioner 20 may further include a control interface 46 associated with the electrical control system 24 for the user to control the compact air conditioner 20, which may take a variety of different forms, including for example and without limitation a display, a touch screen, buttons, a keypad, knobs as shown in FIGS. 1 and 2, or a combination of these elements. By way of further example, the knobs 46 that form part of the user control interface 46 shown in FIGS. 1 and 2 may each include a display screen 47 built into the knobs themselves, so that as a user utilizes the knobs to adjust settings of the compact air conditioner 20 relevant information is displayed to the user on the knobs 46 themselves. The user control interface 46 may further be in communication with a local wireless network, so that a user may interact with the control interface 46 via a personal computing device, such as a computer or a mobile device such as the user's smart phone, to adjust the settings of the compact air conditioner 20. The user's personal computing device may include a specific application configured to operate the compact air conditioner 20, so that it can be operated when the user is not in the same location as the unit, such as when the user leaves home and forgets to turn the air conditioner 20 off or when the user is returning home and want the air conditioner 20 to begin cooling the room before the user arrives. As described in further detail below, the composition and layout of the evaporator assembly 50 and condenser assembly 70 in the present compact air conditioner 20 contributes to the compact form factor of the present invention, while the separate front and back motors 54, 74 allow the evaporator and condenser fans 52, 72 to be individually driven to maximize performance while reducing power consumption and noise.

Figure 42:
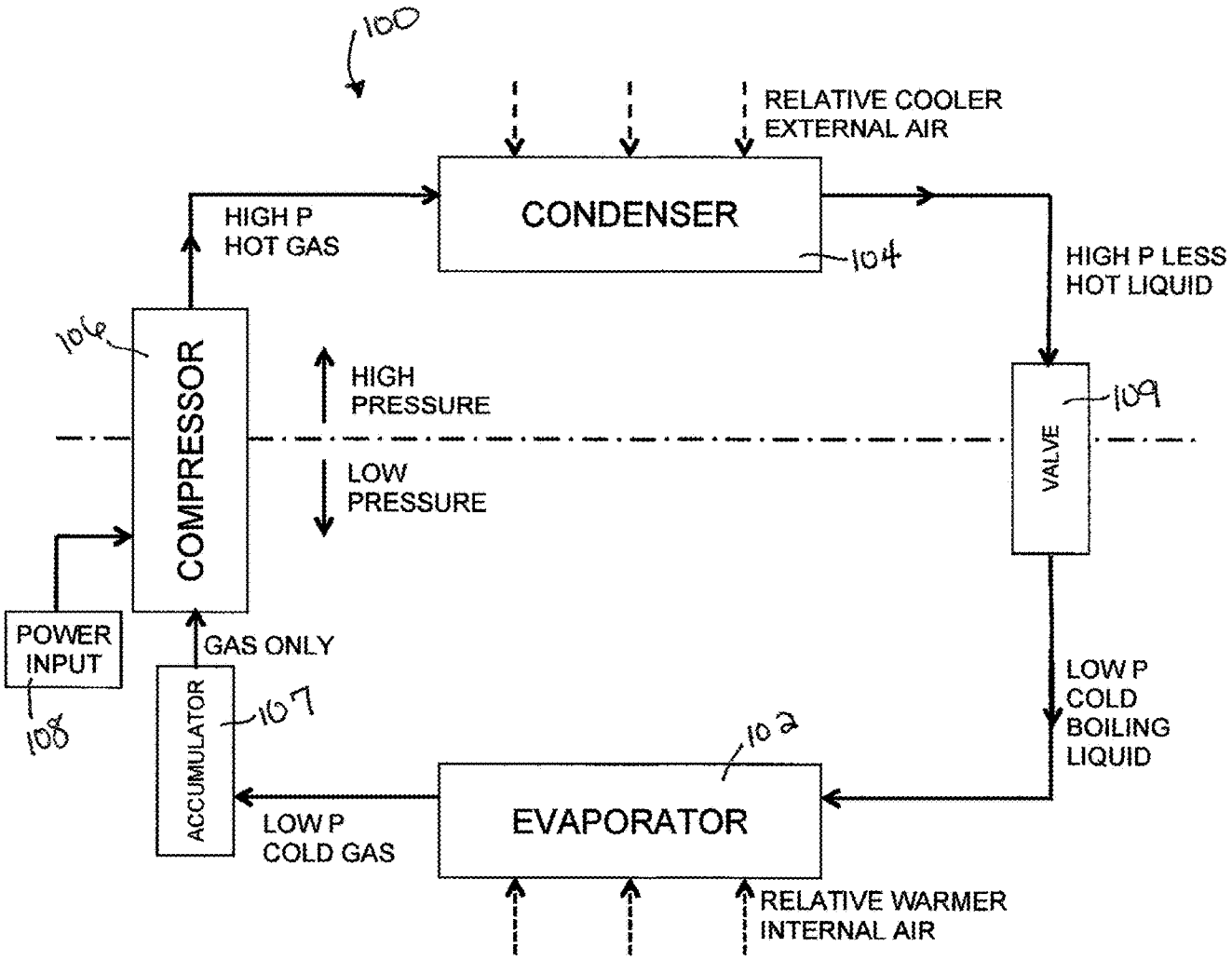
FIG. 42 is a simplified schematic of the refrigeration cycle in an air conditioner.

To aid in an understanding of the present application and compact air conditioner 20, a brief description of how the refrigeration cycle of a simple air conditioning system 100 operates is provided below and shown in FIG. 42. On a basic level an air conditioning system is doing work supplied by a power source to move heat from the interior of a room or building to the external atmosphere, by taking advantage of the phase changes of a coolant or refrigerant that is circulated between the evaporator, compressor, and condenser. As shown in FIG. 42, the air conditioning system 100 includes an evaporator 102 located in the interior of a room, building, or other space to be cooled, a condenser 104 located outside of the room, building, or other space to be cooled and in communication with external air, a compressor 106 associated with both the evaporator 102 and condenser 104, and a power input 108 that powers the system 100. A suitable coolant or refrigerant is circulated between the evaporator 102, condenser 104, and compressor 106 and undergoes various temperature, pressure, and phase changes throughout the refrigeration cycle. One of ordinary skill in the art would understand that many different types of coolants and refrigerants may be suitable for use with an air conditioning system, which will not be discussed in detail in the present application. The energy provided by the power input 108 associated with the compressor 106 pressurizes and heats the refrigerant within the compressor 106, such that the refrigerant exits the compressor 106 is in a high pressure hot gaseous state as it enters the condenser 104, which is a heat sink that usually includes coiled tubing through which the refrigerant circulates in a serpentine path. As the refrigerant makes its way through the tubing in the condenser 104, external air that is cooler relative to the refrigerant moves over and through the heat sink fins of the condenser 104 (usually blown by a fan) and cools the refrigerant such that when it exits the condenser 104 the refrigerant is in a high pressure less hot liquid state. The refrigerant then flows through a valve 109, such as an expansion valve (including without limitation a capillary expansion valve), which quickly decreases the cross-sectional area of the tubing that the refrigerant flows through, resulting in a sudden drop in pressure. After flowing through the expansion valve 109, the refrigerant is in a low-pressure cold boiling liquid state as it enters the evaporator 102. Like the condenser 104, the evaporator 102 is a heat sink that usually includes coiled tubing through which the refrigerant circulates in a serpentine path. As the cold boiling liquid refrigerant makes its way through the tubing in the evaporator 102, internal air of the room or building that is warmer relative to the refrigerant moves over and through the heat sink fins of the evaporator 102 (usually blown by a fan) and is cooled by the refrigerant and blown back into the room or building, thus cooling the interior of the space. Due to the increase in temperature as the refrigerant moves through the evaporator 102, the refrigerant leaves the evaporator 102 in a low-pressure warmer gaseous state. The refrigerant may then flow through an accumulator 107, which traps any liquid left in the refrigerant before it flows back into the compressor to be heated and pressurized. Although the refrigeration cycle for air conditioning systems 100 such as the one shown in FIG. 42 is well known, there are still many improvements to be made in terms of efficiency, form factor, functionality, ease of use, and aesthetic design of air conditioning units.

As shown in FIGS. 7-9 and 12-20, although only a single evaporator fan 52 and single condenser fan 72 may be utilized, the present compact air conditioner 20 preferably includes two separate evaporator fans 52 that are arranged coaxially along the front rotational axis R1 to be driven concurrently by the front motor 54, as well as two separate condenser fans 72 that are arranged coaxially along the back rotational axis R2 to be driven concurrently by the back motor 74. Where two sets of evaporator fans 52 and condenser fans 72 are utilized, each of the front and back motors 54, 74 may be arranged between the first and second evaporator fans 52 and first and second condenser fans 72 respectively, and each be connected to a motor mount 55, 75, which may in turn be associated with the housing 30 or another component of the present compact air conditioner 20. Where a single evaporator fan 52 and a single condenser fan 72 is utilized, each of the front and back motors 54, 74 may be arranged on the side of the evaporator fan 52 or condenser fan 72 to drive the fan 52, 72 rotatably about the front and back rotational axis R1, R2, and be similarly connected to a motor mount 55, 75 that is associated with the housing 30 or another component of the compact air conditioner 20. While using a single evaporator fan 52 and a single condenser fan 72 decreases the number of components and complexity of the present compact air conditioner 20, using two separate evaporator fans 52 and two separate condenser fans 72 allows more air to be drawn in at the axial ends of the fans 52, 72 (four axial ends for air entry for each set of fans 52, 72 instead of only two for each set of fans 52, 72), and more efficient airflow through and operation of, the evaporator assembly 50 and condenser assembly 70, as discussed in further detail below. Furthermore, the use of two evaporator fans 52 and two condenser fans 72 allows the front and back motors 54, 74 to be mounted in the middle of each set of fans 52, 72 thus better balancing the load of the fans 52, 72 and reducing vibration and noise. Mounting the motors 54, 74 between each set of fans 52, 72 also only requires a single bearing in the motor 54, 74, rather than a second bearing to carry any offset loads. When a single evaporator fan 52 and a single condenser fan 72 is utilized, there is no good way to mount the front and motors 54, 74 in a way that is balanced with respect to the load of the fans 52, 72.

Regardless of whether single or double evaporator and condenser fans 52, 72 are used, the front and back motors 54, 74 may be controlled or configured to rotate in the same direction, such as through the electrical control system 24. Where the front and back motors 54, 74 are configured to rotate towards the front portion 33*a* of the internal cavity 32 of the housing 30, such direction will be considered to be clockwise about the front and back rotational axes R1, R2 according to the right hand rule (assuming the thumb is pointing in the direction of the arrow X shown in FIG. 13). Where the front and back motors 54, 74 are configured to rotate towards the back portion 33*b* of the internal cavity 32 of the housing 30, such direction will be considered to be counterclockwise about the front and back rotational axes R1, R2 according to the right hand rule. Although the configuration and operation of the compact air conditioner 20 in the present application will be described with clockwise rotation of the evaporator and condenser fans 52, 72, one of ordinary skill in the art would appreciate that the present compact air conditioner 20 may be reconfigured such that the evaporator and condenser fans 52, 72 rotate in the counterclockwise direction, or rotate in opposite directions instead without departing from the spirit of the application or the inventive concepts herein. If the rotation of the evaporator and condenser fans 52, 72 are altered, only minor changes need to be made to the other components of the present compact air conditioner 20 to accommodate a change in the direction of rotation, such as changing the locations of the room air intake grate, external air intake grate, cold air exit vent, and hot air exit vent (each of which will be discussed in further detail below).

Figure 5:
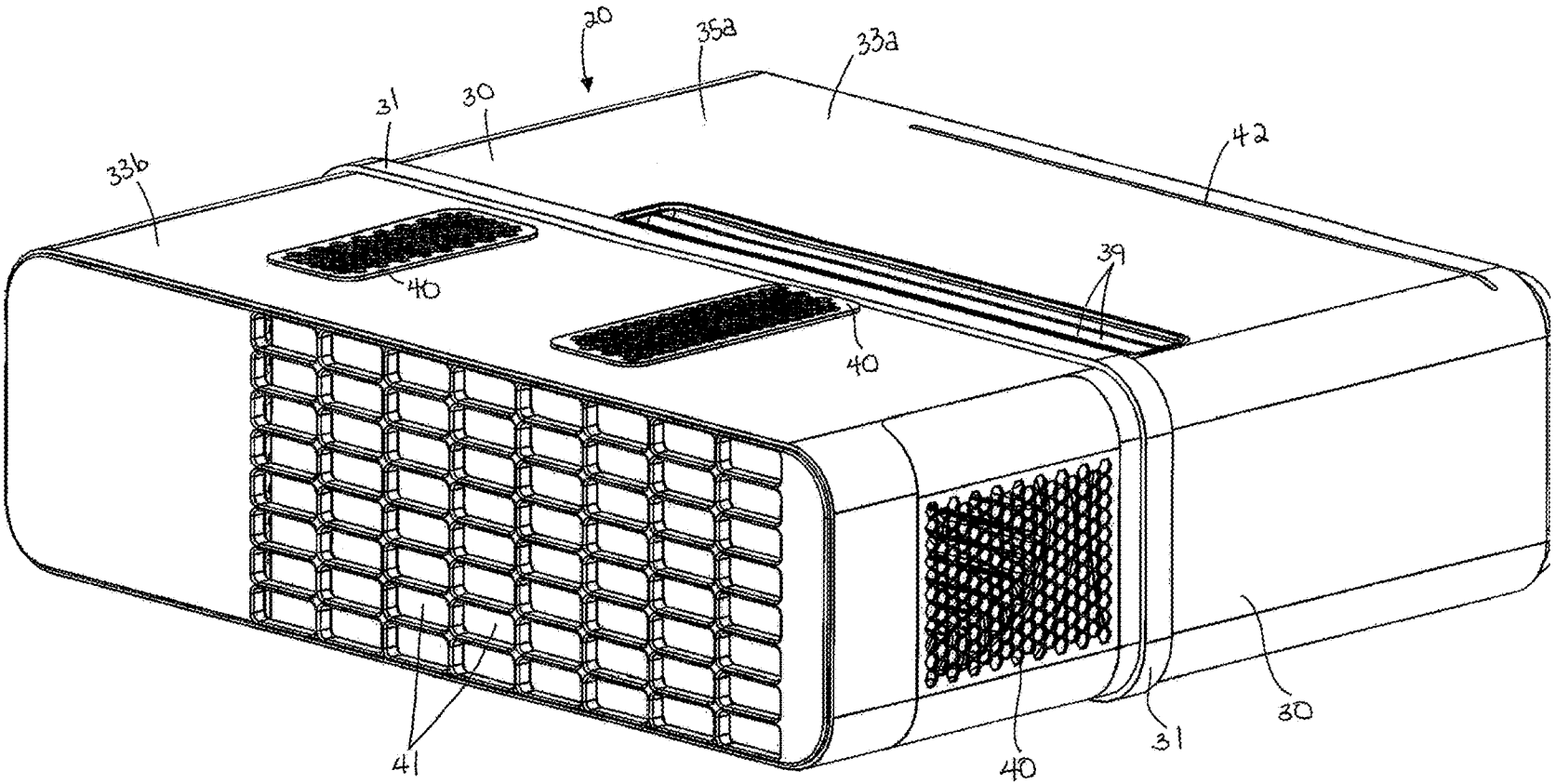
FIGS. 5 and 6 are back perspective views of the compact air conditioner shown in FIG. 1.

The details of the evaporator assembly 50 and condenser assembly 70 are shown in FIGS. 12-20, in which certain portions of the housing 30 and internal fairings to guide airflow have been removed to better show the evaporator and condenser components. As discussed above, for the purpose of describing the present compact air conditioner 20, the direction of rotation of the evaporator and condenser fans 52, 72 will be assumed to be in the clockwise direction about the front and back rotational axis R1, R2 according to the right hand rule, as shown by the rotational arrows C1 and C2 in FIG. 12. As shown in FIGS. 1-2 and 7-12, the housing 30 may include a face plate 36, which may be located adjacent to and/or form part of a room air intake grate 38 through which air from inside of the room or building to be cooled may be drawn into the internal cavity 32 of the housing 30. The room air intake grate 38 may also be referred to as the "evaporator fan air intake" in the present application, as the air flowing through the room air intake grate 38 is being drawn into the internal cavity 32 of the housing by the evaporator fans 52. The housing 30 may further include a cold air exit vent 39, through which air that has been cooled by the evaporator assembly 50 may be expelled back into the interior of the room or building to be cooled. When the present compact air conditioner 20 is set to a fresh air circulation mode in which the evaporator assembly 50 is not cooling the internal air, and fresh air from an exterior of the room or building is brought in instead, the fresh external air may also be expelled through the cold air exit vent 39, even though the external air isn't being "cooled." The cold air exit vent 39 may also be referred to as the "evaporator fan air outlet" in the present application, as the air (whether cooled interior air or fresh external air) flowing through the cold air exist vent 39 is being expelled out from the internal cavity 32 of the housing 30 by the evaporator fans 52. The cold air exit vent 39 may be located at the front portion 33*a* of the housing 30, such as, for example and without limitation, on a top portion 35*a* of the outer surface 34 of the housing 30 as shown in FIGS. 1-3 and 5-6. The housing 30 may also include one or more external air intake grates 40, which may also be referred to as "condenser fan air intakes," as shown in FIGS. 1-6. The external air intake grates 40 are located at the back portion 33*b* of the housing 30, and may further be arranged on at least one of the top portion 35*a*, the bottom portion 35*b*, or the sides of the outer surface 34 of the housing 30. Air from an exterior of the room or building to be cooled is drawn into the internal cavity 32 of the housing through the external air intake grates 40 to cool the condenser 80, and then the heated external air is expelled back out to the exterior atmosphere through a hot air exit vent 41 (also known as the "condenser fan air outlet") located at the back portion 33*b* of the housing 30 as shown in FIGS. 5-7.

Figure 15:
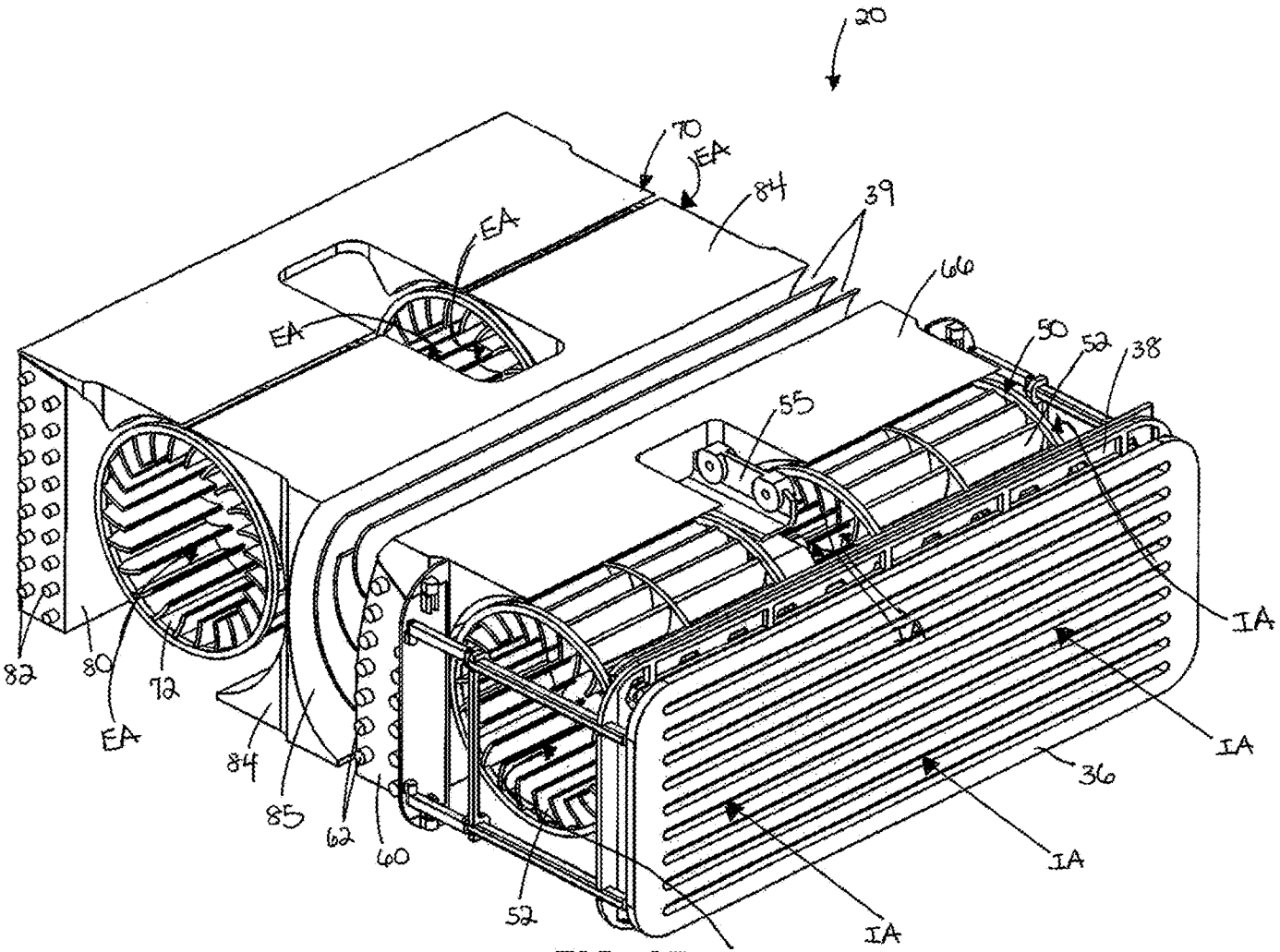
FIG. 15 is a front perspective view of the compact air conditioner shown in FIG. 1, with certain portions of the housing and the condenser removed.
Figure 16:
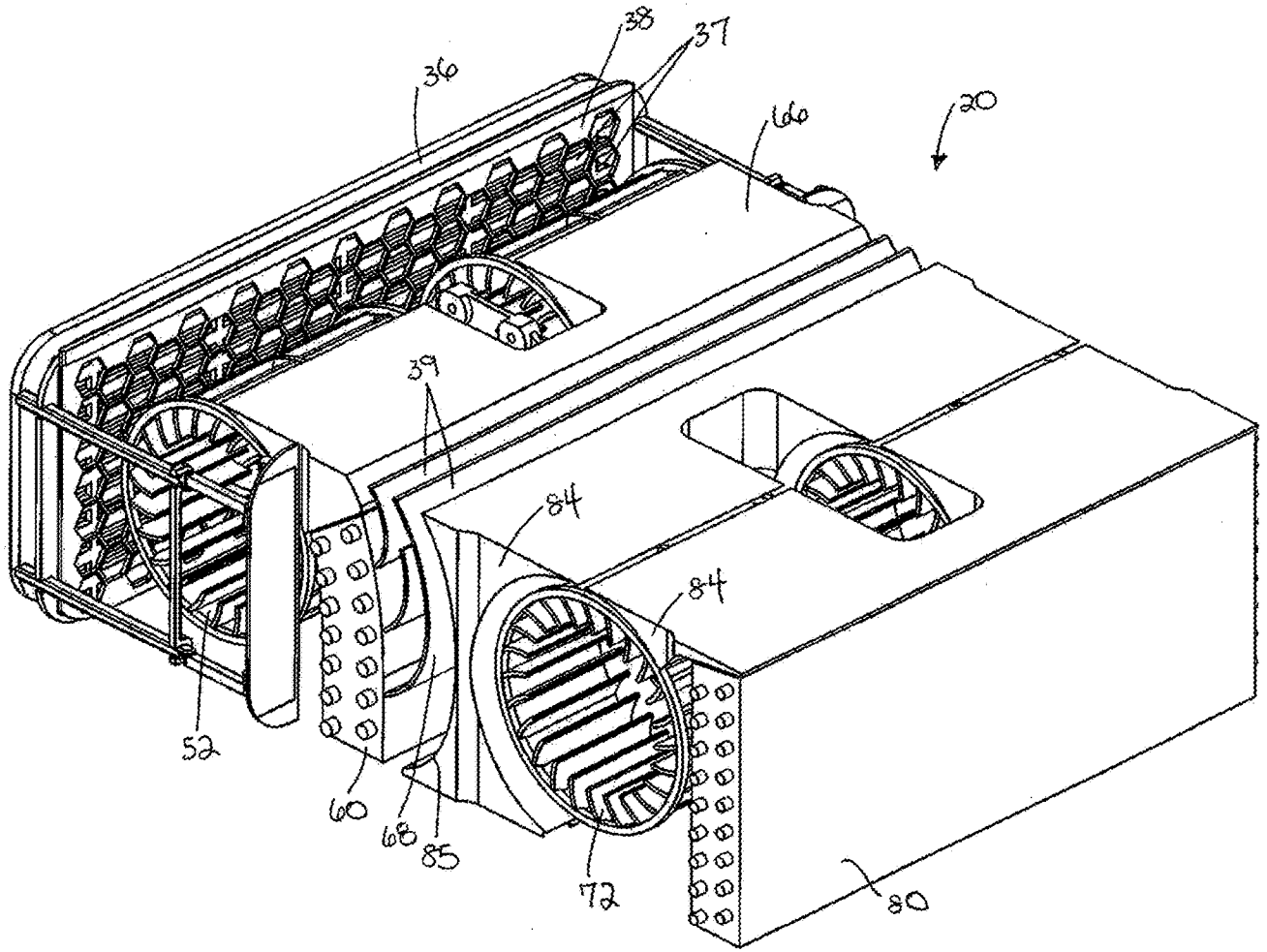
FIG. 16 is a back perspective view of the compact air conditioner as shown in FIG. 15.
Figure 17:
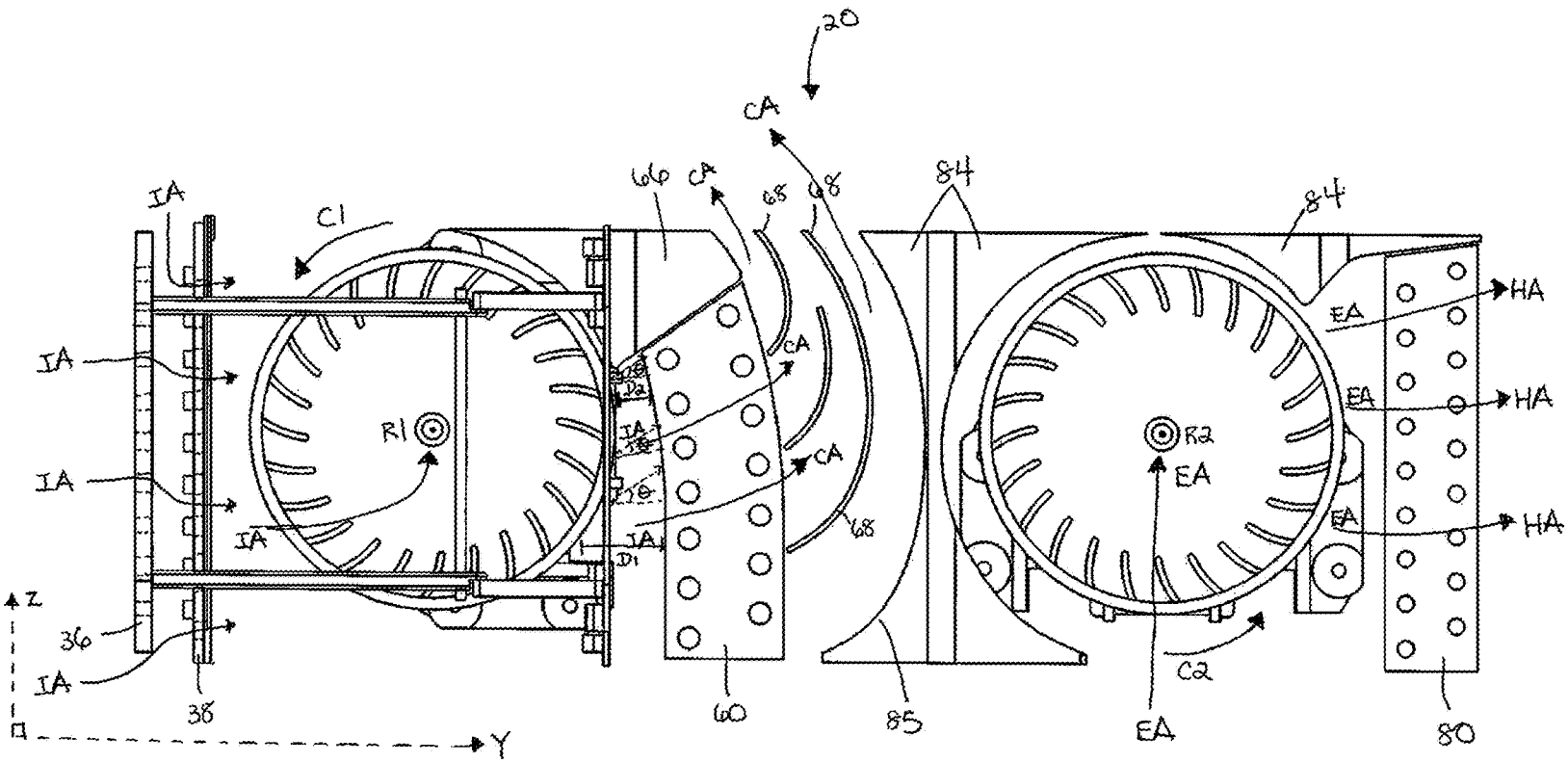
FIG. 17 is a right elevation view of the compact air conditioner as shown in FIG. 15.
Figure 18:
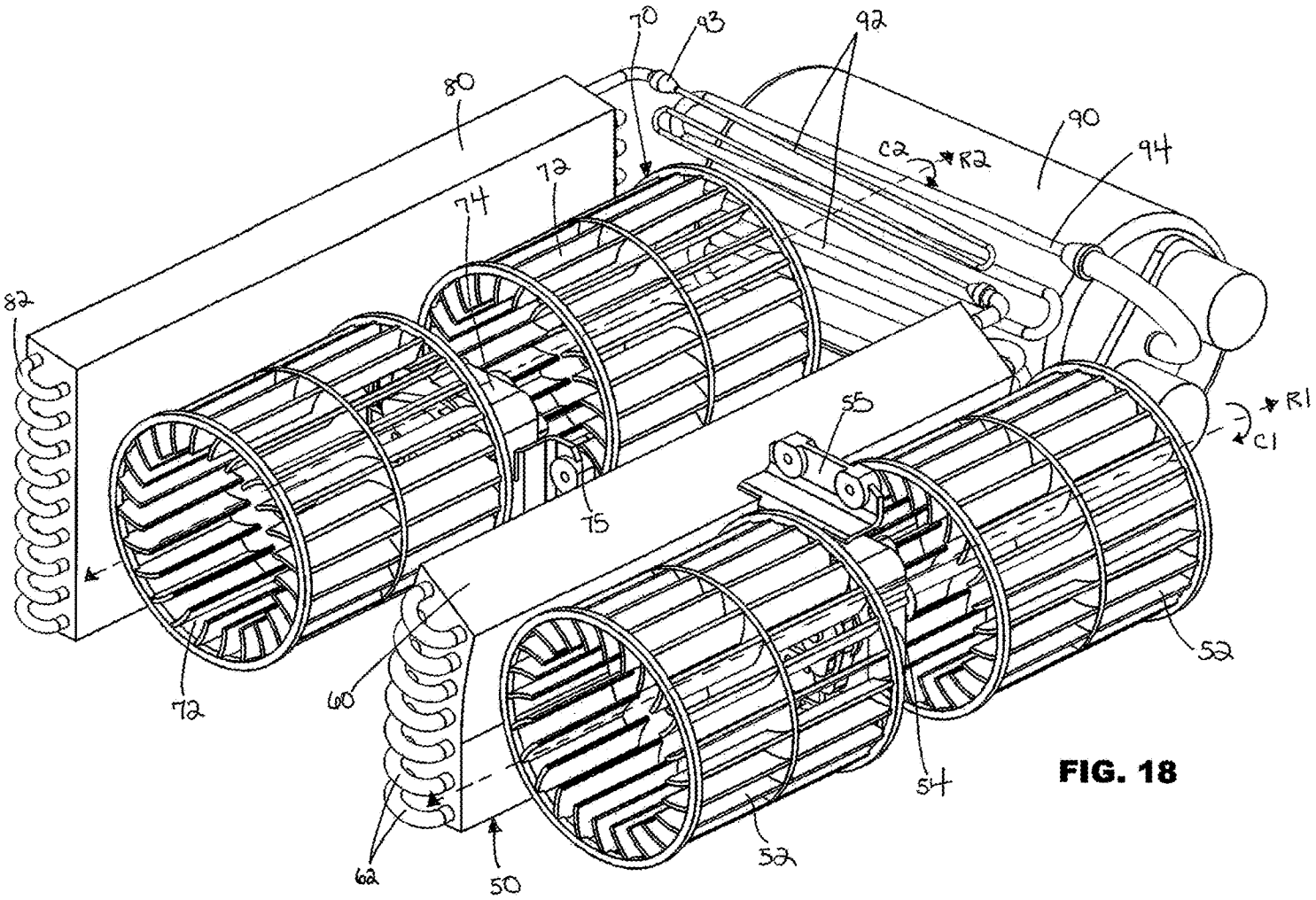
FIG. 18 is a front perspective view of an evaporator assembly, a condenser assembly, and a compressor of the compact air conditioner shown in FIG. 1.
Figure 19:
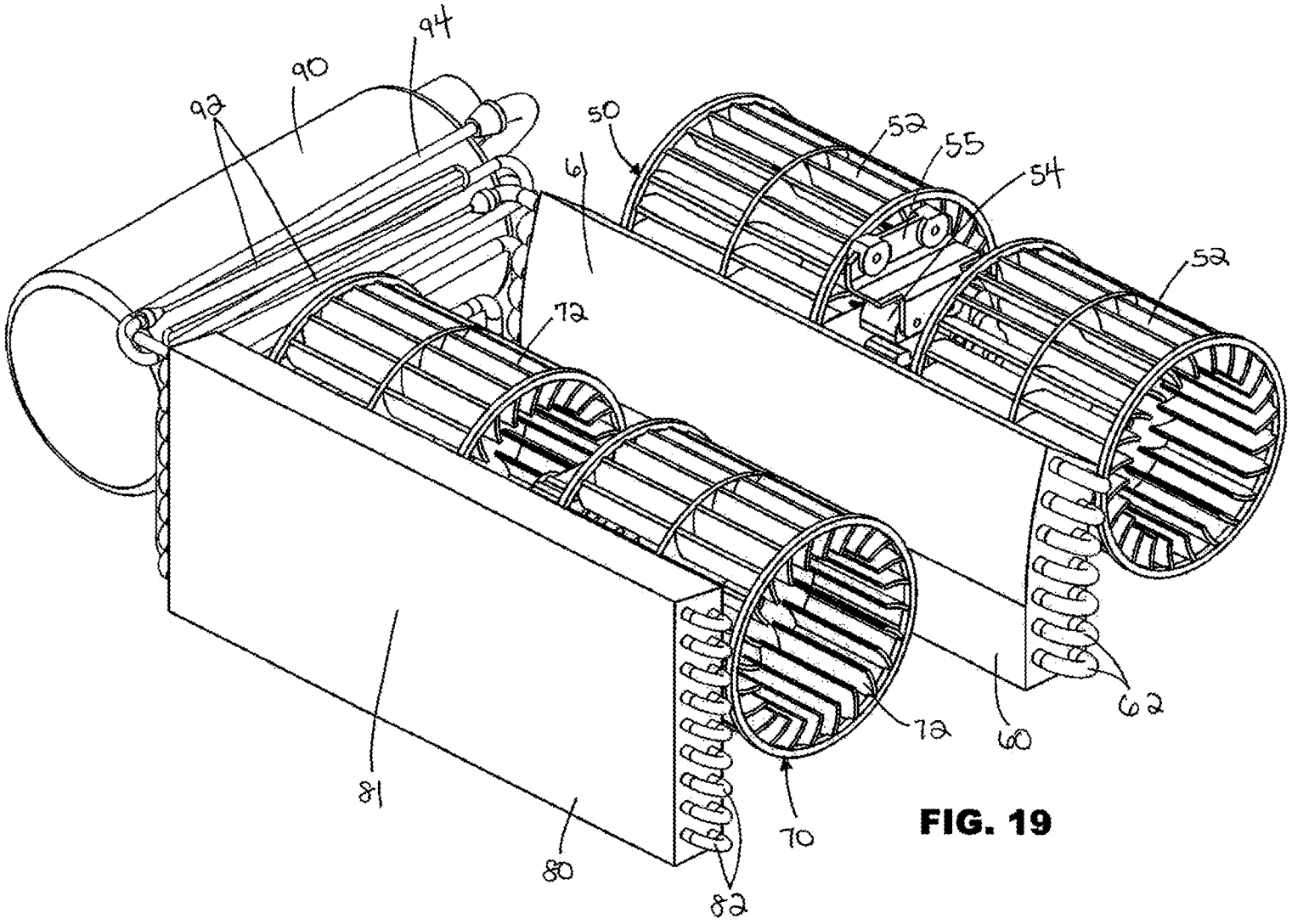
FIG. 19 is a back perspective view of the evaporator assembly, condenser assembly, and compressor shown in FIG. 18.
Figure 44:
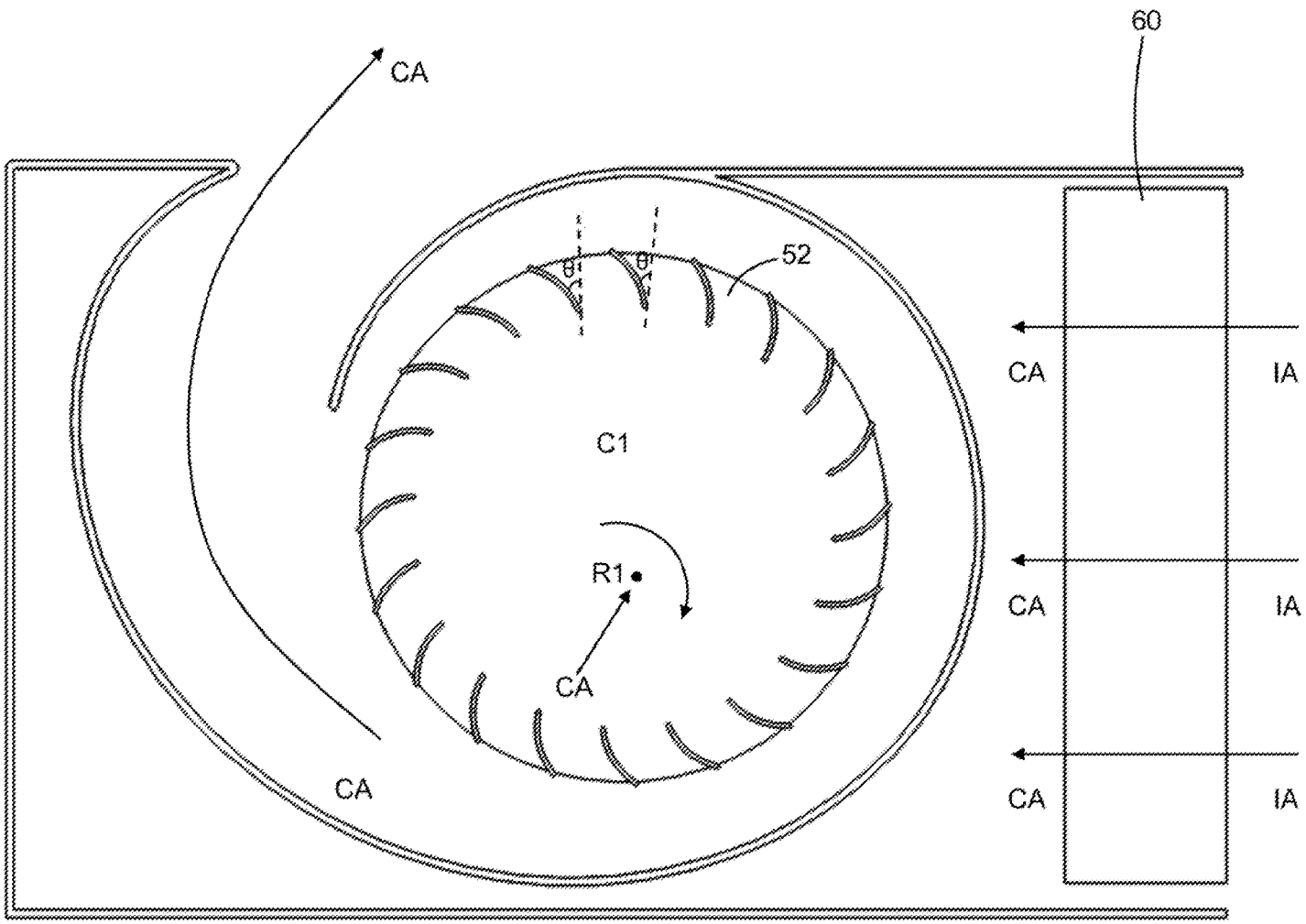
FIG. 44 is a left elevation view of an alternative embodiment of the evaporator assembly of a compact air conditioner.
Figure 47A:
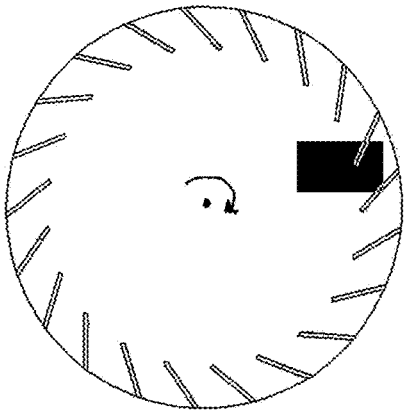
FIGS. 47*a*-47*e* are examples of different fan blade configurations.
Figure 47B:
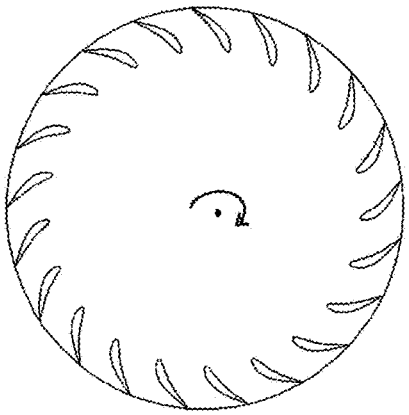
Figure 47C:
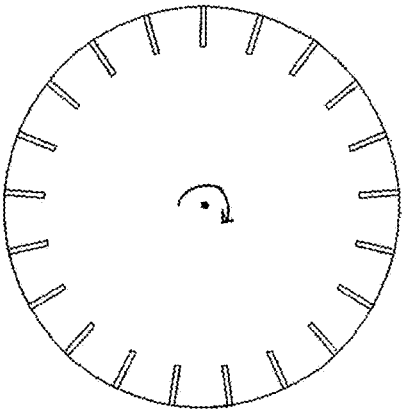
Figure 47D:
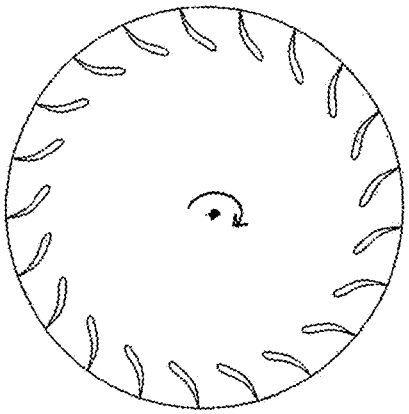
Figure 47E:
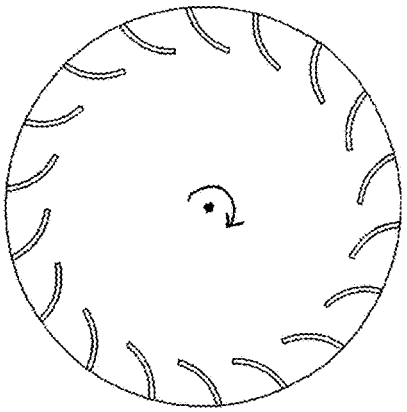
Figure 48:
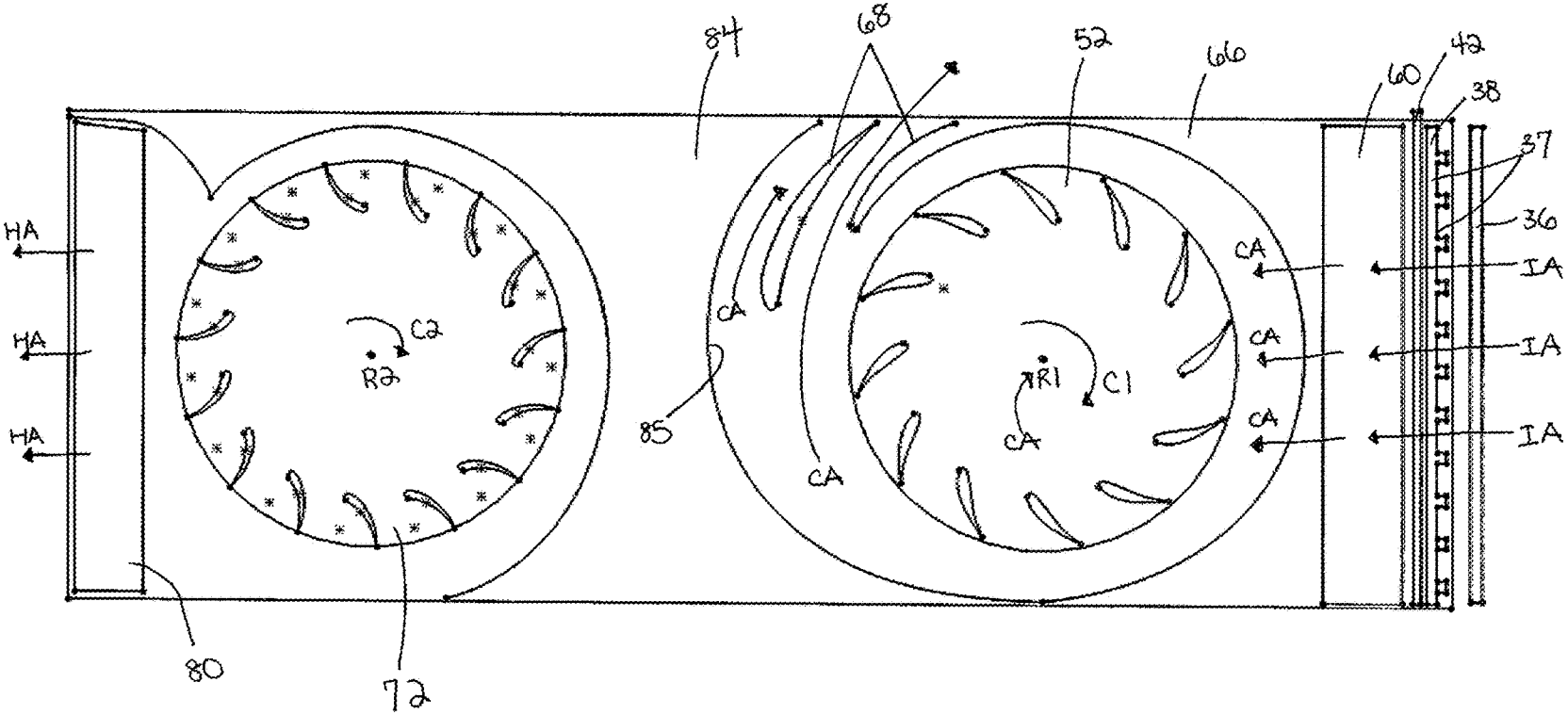
FIG. 48 is a left elevation view of the compact air conditioner shown in FIG. 44.

FIGS. 10-17 help illustrate the airflow through the present compact air conditioner 20. When rotating in the clockwise direction about the front rotational axis R1, the evaporator fans 52 draw in air through the face plate 36 and/or room air intake grate 38 into the internal cavity 32 of the housing 30. As shown in FIGS. 1-3 and 7-9, the housing 30 may further include an air filter slot 42 located adjacent to the face plate 36 and room air intake grate 38, in which an air filter (not shown) may be inserted. The air filter inserted in the air filler slot 42 helps filler out dust and other impurities in the interior room air being drawn in by the evaporator fans 52 before such air is cooled by the evaporator 60 and expelled back into the room through the cold air exit vent 39. As shown in FIG. 12, the interior room air (IA) is drawn through the face plate 36 and/or the room intake grate 38 substantially along the longitudinal direction Y, and enters the axial ends of the evaporator fans 52 substantially along the horizontal direction X, which is aligned with the front rotational axis R1, as shown by the arrows IA. The evaporator and condenser fans 52, 72 are each a centrifugal fan, which includes a plurality of blades or impellers 53, 73 that extend along a radial direction that is substantially perpendicular to the front and back rotational axes R1, R2. The rotating blades 53, 73 of the evaporator and condenser fans 52, 72 increase the speed of the air stream that flows through the fans, and accelerate the airflow radially to change the direction of airflow by approximately 90°. As shown in FIGS. 12 and 15, the internal room air IA drawn into the internal cavity 32 of the housing 30 flows into the evaporator fans 52 in the axial direction along the front rotational axis R1, but is then expelled by the evaporator fans 52 along the radial direction towards the evaporator 60 to be cooled.

Where the evaporator and condenser assemblies 50, 70 are configured so that the evaporator and condenser fans 52, 72 all rotate in the clockwise direction, the blades 53 of the evaporator fans 52 may be formed as backward curved or backward inclined (which are straight instead of curved) blades as shown in FIGS. 12-19, meaning that the blades 53 curve or incline away from the direction of rotation. Meanwhile, the blades 73 of the evaporator fans 73 may be formed as forward curved or forward inclined blades, meaning that the blades 73 curve or incline towards the direction of rotation as shown in FIG. 17. One of ordinary skill in the art would recognized that if the evaporator and condenser fans 52, 72 were configured to all rotate in the counterclockwise direction instead, the direction of the curvature or inclination of the blades 53, 73 of the fans 52, 72 would be reversed accordingly. Using oppositely curved or inclined blades 53, 73 on the evaporator and condenser fans 52, 72 allow the present compact air conditioner 20 to be optimized for performance, as the evaporator fans 52 and condenser fans 72 have different performance objectives. The evaporator fans 52 need high pressure but less overall airflow, as the goal of the evaporator fans 52 is to pull air through the face plate 36 and/or room air intake grate 38, possibly through a filter in the air filter slot 42. The backward curved or inclined blades 53 of the evaporator fans 52 is well suited to this need, and provide more energy efficient than straight radial blades, which extend straight out from the center of the fan axis. On the other hand, the condenser fans 72 do not need as high of pressure but does require greater overall airflow, as the goal of the condenser fans 72 is to move as much external atmosphere air as possible along the surface of the condenser 80 in order to cool the refrigerant in the condenser 80. Accordingly, forward curved or inclined blades 73 are preferably used for the condenser fans 72, as forward curved or inclined blades are optimal for high-flow, low-pressure applications. One of ordinary skill in the art would appreciate that in addition to using different backward curved or inclined and forward curved or inclined blades 53, 73 on the evaporator and condenser fans 52, 72, additional optimizations may be achieved by varying other attributes of the fan blades to suit specific operational parameters, including without limitation blade size, spacing, number, shape, cross-sections, and materials. For example and without limitation, a number of different straight and backward curved or inclined blade configurations are shown in FIGS. 44 and 47*a*-47*e*, assuming the fans is rotating in a clockwise rotation as shown by the arrow in the images. FIG. 47*a* shows a fan having backward inclined blades, FIG. 44 shows a fan having backward curved blades, and FIG. 47*b* shows a fan having backward curved airfoil blades, which have cross-sections in the shape of airfoils. The backward inclined and curved blades, as well as the backward curved airfoil blades, are optimal for high pressure low velocity applications, with the backward curved air foil blades being more efficient than the other two arrangements. FIG. 47*c* shows a fan having straight radial blades, which is optimal for very high pressure applications but is also the most inefficient. FIG. 47*d* shows a fan having backward curved radial tip airfoil blades, which have airfoil cross-sections that are oriented differently from those in the backward curve airfoil blades. FIG. 47*e* similarly shows a fan having backward curved radial tip blades. The radial tip blades shown in FIGS. 47*d* and 47*e* are best suited for moderate pressure and moderate air flow applications, with the backward curved radial tip airfoil blades being more efficient than the backward curved radial tip blades. These are only some examples of different types of blades that may be utilized in the evaporator and condenser fans 52, 72 of the present application, and one of ordinary skill would understand that the performance characteristics of the backward curved or inclined blades deserved above would similarly apply to forward curved or included blades of the same types.

Figure 43:
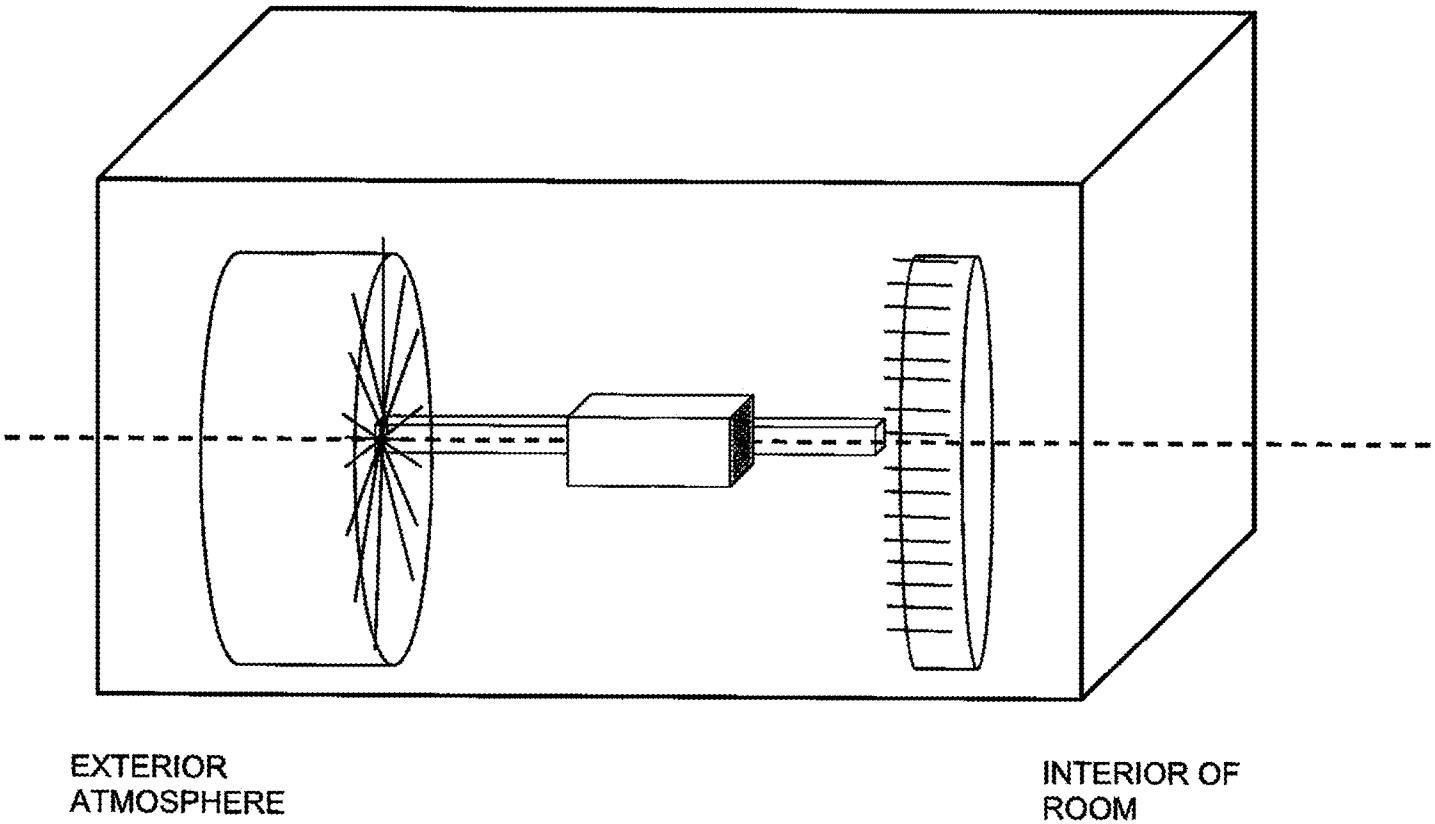
FIG. 43 is a simplified schematic of the fan assembly in a prior art window air conditioner.

Although the use of centrifugal fans in air conditioning systems is well known in the art, in known window air conditioners usually only a single centrifugal fan is used as the evaporator fan and is arranged coaxially with an axial fan that acts as the condenser fan, so that both fans can be driven by a single motor as shown in the prior art fan assembly of FIG. 43. Furthermore, as shown in FIG. 43, the centrifugal evaporator fan in known window air conditioners is oriented differently by an approximate 90° angle from the evaporator fans 52 in the present compact air conditioner 20, where instead of being aligned with the horizontal direction X, the rotational axis of the prior art centrifugal evaporator fan is aligned with the longitudinal direction Y along the length (i.e., depth) of the window air conditioner. As will be explained in further detail below, the present evaporator assembly 50 and evaporator fan 52 arrangement is advantageous over the prior art fan system in a number of ways, many of which are attributable to the different orientation of the evaporator fans 52 and the independent operation of the evaporator and condenser fans 52, 72.

As further shown in FIGS. 10-17, the evaporator fans 52 drive the interior room air IA against and through the evaporator 60 along the longitudinal direction Y. The evaporator 60 includes a substantially rectangular body 61 that extends and is arranged along a vertical direction Z, which is substantially perpendicular to both the horizontal direction X and the longitudinal direction Y. The evaporator 60 also includes evaporator piping or tubing 62 that coils through the body 61, preferably in a serpentine path so as to maximize the path of the refrigerant that flows through the tubing 62 and the evaporator 60. As discussed above, the body 61 of the evaporator 60 is a heat sink, which includes a plurality of fins that may be formed out of a material having good heat transfer properties, such as a highly thermally conductive metal such as aluminum or copper. One of ordinary skill in the art would appreciate that heat sink fins may be formed in a variety of shapes, such as pins, straight fins, or flared fins. The advantages and optimizations of the different types of fin shapes and arrangements will not be discussed in detail here, except to state that in known window air conditioners, the evaporator and condenser generally utilizing straight fins, which are thin plates that are arranged vertically such that the face of the face/plates are perpendicular to the tubing that coils through the evaporator and condenser. In the present compact air conditioner 20, the body 61 of the evaporator 60 is made up of a number of fins arranged in a straight fin configuration, such that the surface of each fin extends along the longitudinal direction Y and is substantially perpendicular to the evaporator tubing 62, which extend through holes formed in adjacent fins and aid in keeping the fins together. The body 61 of the evaporator 60 may be further configured to include what is commonly known as "offset interrupted fins" or "louvered fins." In the offset interrupted fins configuration, each "fin" or "plate" of the evaporator body 61 includes a plurality of slits (the "interruptions") that are generally placed close together at regular intervals. As airflows along the longitudinal direction Y between two fins of the evaporator body 61, the air enters and exits the plurality of slits/interruptions formed in the fins, which increases heat transfer and causes the airflow to become turbulent, thus ensuring that the cooled air immediately mixes with the surrounding air. To further optimize performance of the evaporator 60 and increase heat transfer, the material between adjacent slits/interruptions in the fins may be stamped to create an "offset," adjacent offsets being stamped in opposite directions. The offsets interrupt the boundary condition of the airflow and further increase air turbulence, which improves the heat transfer capabilities of the evaporator 60. In the louvered fins configuration, the offsets are stamped at an angle, and adjacent offsets are formed with opposing angles, so that air flowing through one offset out through a slot is forced to change angles before entering an adjacent slot to flow through the next offset, once again increasing turbulence and improving heat transfer.

As shown in FIGS. 12 and 15-19, the body 61 of the evaporator 60 may be curved towards the front portion 33*a* of the internal cavity 32 of the housing 30, such that the distance between the bottom of the evaporator 60 and the evaporator fan 62 (D1) is greater than the distance between the bottom of the evaporator 60 and the evaporator fan 62 (D2). The curved profile of the evaporator 60 maximizes airflow as the evaporator fans 52 blow interior room air IA in the radial direction towards the evaporator 60. As shown in FIG. 17, the radial direction in which interior room air IA exits the evaporator fan 52 is not always aligned with the horizontal direction Y, but instead is at an angle θ with respect to the horizontal direction, the angle θ increasing upwardly along the vertical direction Z along the body 61 of the evaporator 60. Accordingly, the curvature of the evaporator 60 is selected to match as closely as possible the angle at which interior room air IA is blown towards the evaporator body 61, so that the air flows directly into the fins of the evaporator body 61 instead of at an angle, which would decrease the efficiency of the evaporator 60. The interior room air IA is cooled by the relatively colder surfaces of the fins of the evaporator body 61 due to the cold boiling liquid refrigerant flowing through the evaporator tubing 62. As the cooled interior room air IA exits the back of the evaporator body 61, the cooled air IA is guided upwards and back into the interior of the room or building by an air guide assembly 64 through the cold air exit vent 39 located at the top portion 35*a* of the housing. The thermal energy (i.e. heat) from the cooled interior room air IA is transferred into the refrigerant that flows through the evaporator tubing 62 of the evaporator 60, which is in turn warmed from a low-pressure cold boiling liquid into a low-pressure cold gas as the refrigerant flows from the evaporator 60 through the accumulator 96 and into the compressor 90 to be pressurized and heated. The accumulator 96 ensures that any liquid left in the refrigerant is removed before the refrigerant enters the compressor 90, so as not to damage the compressor 90 when the gaseous refrigerant is pressurized and heated. The air guide assembly 64 may include a cowling 66 that is adapted to be arranged around the evaporator fans 52 and the front motor 54. The cowling 66 may further include an integral or separate motor housing 67 that is adapted to be arranged around the front motor 54. The motor mount 55 for the front motor 54 may be associated with the motor housing 67 or the cowling 66. As shown in FIGS. 7-17, the air guide assembly 64 may further include a plurality of turning vanes 68 arranged directly behind the evaporator 60, such that air exiting the evaporator is guided upwardly by the turning vanes 68 through the cold air exit vent 39 at the top portion 35*a* of the housing 30. As shown in FIG. 17, the curvature of each turning vane 68 can be individually selected as to optimize airflow by matching the curvature of the back of the evaporator body 61, so that as air exits the evaporator 60 at various positions along the height of the evaporator body 61 at differing angles, the turning vanes 68 located at those positions are arranged at a similar angle to direct the air upwards in the most efficient manner. As further shown in FIG. 17, a curved surface 85 of the scroll housing 84 that physically and thermodynamically separates the evaporator assembly 50 and condenser assembly 70 may also form part of the air guide assembly 64. The curved surface 85 of the scroll housing 84 faces towards the evaporator 60, and guides the cooled interior room air IA upwards towards the cold air exit vent 39.

Although the evaporator assembly 50 of the present compact air conditioner 20 has been described with the evaporator fan 52 being arranged in front of the evaporator 60, as to blow interior room air IA through the evaporator 60 to be cooled, one of ordinary skill in the art would recognize that it is also possible to arrange the evaporator fan 52 behind the evaporator 60 instead, such that the evaporator fan 52 "sucks" air through the evaporator 60 to be cooled and then blows the cooled air out through the cold air exit vent 39. An example of this alternate configuration is shown in FIG. 44, which is a left elevation view of an evaporator assembly 50 in which the evaporator fan 52 is arranged behind the evaporator 60. The evaporator fan 52 rotates in a clockwise direction to draw interior room air IA through the room air intake grate 38 inwardly through the evaporator 60 into the internal cavity 32 of the housing 30. As the interior room air IA passes through the fins of the evaporator body 61, it is cooled and becomes cold air CA, which is then drawn into the axial ends of the evaporator fans 52 along the front rotational axis R1 and then expelled radially out and upwards through the cold air exit vent 39 arranged at a top portion 35*a* of the outer surface 34 of the housing 30.

Similarly, the condenser fan 72 may be arranged behind the condenser 80 to suck external air EA through the fins 83 in the body 81 of the condenser 80 in order to cool the refrigerant circulating through the condenser tubing 82. The condenser fan 72 may then expel the hot air HA out through the hot air exit vent 41 located at the back portion 33*b* of the housing 30. Another example of this alternative configuration is shown in FIGS. 52-56, which show an alternative embodiment of a compact air conditioner 200, with a slightly modified shape for its housing 30, face plate 36, air intake grate 38, cold air exit vent 39, hot air exit vent 41, control interface 46, and display screens 47. The compact air conditioner 200 shown in FIGS. 52-56 further utilizes the alternate arrangement of the evaporator and condenser assemblies 50, 70 as described above, in which the evaporator 60 is arranged at the front portion 33*a* of the housing 30, with the evaporator fan 52 arranged behind the evaporator 60 to suck room temperature internal air IA through the evaporator 60 to be cooled and blown out through the cold air exit vent 39 into the room. Similarly, the condenser 80 is arranged at the back portion 33*b* of the housing 30, with the condenser fan 72 arranged in front of the condenser 80 to suck external air EA through the condenser 80, and then expelled as hot air HA through the hot air exit vent 41. In this embodiment, the evaporator fans 52 rotate in the clockwise direction about the front rotational axis R1 towards the front portion 33*a* of the internal cavity 32 of the housing 30, and the condenser fans 72 rotate in the counterclockwise direction about the back rotational axis R2 towards the back portion 33*b* of the internal cavity 32 of the housing 30. In this manner, the evaporator and condenser fans 52, 72 sucks air through the evaporator 60 and condenser 80 to be cooled and heated, respectively.

Accordingly, even though the majority of figures in the present application show the evaporator and condenser fans 52, 72 being arranged in front of the evaporator 60 and condenser 80, respectively, such an arrangement should not interpreted as being limiting and the present application fully contemplates an alternative arrangement in which one, or both, of the evaporator and condenser fans 52, 72 are arranged behind the evaporator 60 and condenser 80 as discussed above. As long as the fans 52, 72 are arranged adjacent to the evaporator 60 or condenser 80 in sufficient proximity to either blow or suck air through the evaporator 60 or condenser 80, the specific order of these elements may be switched without interfering with or changing the configuration of remaining elements in the present compact air conditioner 20.

The configuration of the evaporator assembly 50 in the present compact air conditioner 20 has various advantages over those of known window air conditioners. As discussed above, the use of two separate evaporator fans 52 arranged coaxially and driven by a single front motor 54 allows for more air to be drawn in through the axial ends of the evaporator fans 52. Furthermore, the unique layout of the evaporator fans 52 so that the front rotational axis R1 is substantially parallel to the horizontal direction X is markedly different from existing centrifugal fans in window air conditioners, and allows the present compact air conditioner 20 to have a much lower profile and compact form factor, while ensuring sufficient airflow and cooling capacity. Furthermore, the arrangement of the evaporator fans 52 ensures that there is no wasted surface area between the fans 52 and the evaporator 60. As shown in FIGS. 10-20, when viewed from the front the cross-sectional area of the evaporator fans 52 is substantially rectangular, and matches that of the body 61 of the evaporator 60 positioned behind the evaporator fans 52. Accordingly, substantially all of the air that is expelled from the evaporator fans 52 in a radial direction along the longitudinal direction Y is blown directly into the fins of the evaporator 60. In contrast, in existing window air conditioners the centrifugal evaporator fan is arranged perpendicular to the present evaporator fans 52, such that when viewed from the front the cross-sectional area of the evaporator fan is circular, and thus does not match the rectangular body of the evaporator positioned behind the fan, resulting in "wasted" areas of the evaporator (usually at the four corners) that does not receive direct airflow from the evaporator fan. By taking full advantage of the surface area of the evaporator 60, the present evaporator assembly 50 configuration is able to utilize a smaller evaporator 60, which also contributes to the overall smaller size of the compact air conditioner 20. By using two sets of centrifugal fans instead of an axial fan as the condenser fan, the present configuration also allows the evaporator and condenser assemblies 50, 70 to be more evenly balanced along the longitudinal direction Y, and thus the entire compact air conditioner 20 to be better balanced on the windowsill, which improves stability, safety, and the installation experience. The configuration of the present compact air conditioner 20 results in less of the unit hanging outside of the building once it is installed in a window, and thus reducing the moment arm once a weight is applied to the outside portion of the unit as required to pass standard safety tests such as the Underwriters Laboratory test, where a 400 pound load is applied to the back outside edge of the air conditioner.

Further advantages of the present evaporator assembly 50 include a reduction in noise. Since there is no direct line of sight from the face plate 36 and room air intake grate 38 at the front of the housing 30 into the blades 53 of the evaporator fans 52 due to the orientation of the evaporator fans 52, the sound of the evaporator fans 52 during operation is decreased for a user inside of the room or building to be cooled. In addition, the positioning of the cold air exit vent 39 on the top portion 35*a* of the housing 30 reduces re-ingestion of cold air back into the room air intake grate, thus increasing the efficiency and effectiveness of the present compact air conditioner 20. In known air conditioner units, the cold air exit vent is usually located on the front of the housing, such as near the top edge of the face plate. As cold air is expelled through such a cold air exit vent, the air "sinks" in the downward direction due to the higher density of cooler air, and in the process of sinking some of the already-cooled air is re-ingested into the air conditioner through the room air intake grate located on the front of the housing, resulting in inefficiencies for the system. The present compact air conditioner 20 addresses this issue by positioning the cold air exit vent 39 on the top portion 35*a* of the housing 30 a sufficient distance away from the face plate 36 and room air intake grate 38 located at the front of the housing 30, and utilizes the curved turning vanes 68 to expel the cooled air upwardly at an angle into the room. The specific curvatures of the evaporator body 61 and the turnings vanes 68 are also selected to ensure laminar flow as the cooled interior room air IA exits the cold air exit vent, as laminar airflow is easier to direct and move. In contrast, known window air conditioners usually redirect the exiting cooled air through an approximately 90° angle from how the air exits the evaporator to how the air is expelled out through the front of the housing. This redirection causes turbulent flow in the cooled air, which requires more energy to move and thus results in a less efficient air conditioning system overall.

As shown in FIG. 42, the refrigerant that exits the compressor 90 is in a high-pressure hot gaseous state, and flows through the condenser 80 within the condenser tubing 82. Like the evaporator 60, the condenser 80 includes a substantially rectangular body 81 that extends and is arranged along the vertical direction Z, and condenser piping or tubing 82 that coils through the body 81, preferably in a serpentine path. The body 81 of the condenser 80 is a heat sink having a plurality of fins 83, which may be arranged like the fins in the evaporator body 61 and configured as "offset interrupted fins" or "louvered fins." An example of the fins 83 of the condenser 80 is shown in FIGS. 45 and 46. Although the condenser body 81 shown in FIGS. 12-20 has a substantially straight rectangular profile without any curvature, one of ordinary skill in the art would understand that the body 81 of the condenser 80 may also be curved in a way to optimize airflow between the external air (EA) drawn in through the external air intake grates 40, the condenser fans 72, the condenser 80, and the hot air exit vent 41. Furthermore, the exact form and extent of the curvature for the condenser body 81 can be determined based on specific operational parameters, which will not be discussed in detail herein. As shown in FIGS. 22-30, connection tubing 92 may be associated with the evaporator tubing 62 and the condenser tubing 82 to allow for the flow of refrigerant from the compressor 80 to the evaporator 60. The connection tubing 92 may be coiled in a serpentine path, and may further include an expansion valve 93 located adjacent to the condenser 80, which may be for example and without limitation a capillary expansion valve. As discussed above with respect to FIG. 42, the expansion valve 93 quickly decreases the cross-sectional flow area of the connection tubing 92 and thus drops the pressure of the refrigerant flowing out of the condenser 80, which changes the state of the refrigerant form a high-pressure hot liquid to a low-pressure cold boiling liquid. As shown in FIGS. 22-26, the compressor 90 may be associated with the evaporator 60 and condenser 80 through a series of compressor tubing 94, which is preferably arranged in a coiled configuration so as to act as a spring between the compressor 90 and the rest of the components in the compact air conditioner 20. By acting as a spring, the compressor tubing 94 mechanically isolates the compressor 90 from the evaporator and condenser assemblies 50, 60, which is desirable because the compressor causes a large amount of vibration during operation, which may damage the other components if not isolated. Where a thermoelectric heat pump is used in place of a compressor 90, the connection tubing 92 between the evaporator 60 and condenser 80 is not required, as the coolant remains within the evaporator tubing 62 and condenser tubing 82 separately. Instead, in that embodiment the thermoelectric heat pump is thermally associated with and arranged between the evaporator 60 and the condenser 80, such that the cold side of the thermoelectric heat pump is thermally associated with the evaporator 60 to cool the coolant contained in the evaporator tubing 62, while the hot side of the thermoelectric heat pump is thermally associated with the condenser 80 to transfer heat into the coolant contained in the condenser tubing 82. In such an arrangement, the evaporator and condenser tubing 62, 82 may each be formed as a heat pipe, which is well known heat transfer device, and the coolant used may be, for example and without limitation, a liquid such as methanol or acetone.

As discussed above with respect to the simplified refrigeration cycle shown in FIG. 42, the refrigerant that leaves the compressor 90 is in a high-pressure hot gaseous state as it enters the condenser 80, which is cooled by drawing in external air from the ambient atmosphere (EA) outside of the room or building to be cooled, and utilizing the condenser fans 72 to move the relatively cooler external air EA through the condenser 80. As shown in FIGS. 7-10 and 15-17, the external air EA is drawn in to the back portion **33*b* of the internal cavity 32 of the housing 30 through one or more external air intake grates 40. The external air intake grates 40 may be located at locations of the housing 30 best suited for ingestion by the condenser fans 72, such as at the top portion 35*a* of the housing 30, the side portions of the housing 30, and on the bottom portion 35*b* of the housing 30 as shown in FIGS. 1-11. The relatively cooler external air EA is drawn in at the axial ends of the condenser fans 82 substantially along the horizontal direction X, which is aligned with the back rotational axis R2, as shown in FIGS. 14-17 by the arrows EA. In a similar manner as described above with respect to the evaporator fans 52, the condenser fans 72 accelerate the airflow of the external air EA radially to change the direction of airflow by approximately 90°, such that the external air EA is expelled towards the condenser 80 to cool the condenser body 81 and the refrigerant circulating within the condenser tubing 82. As the external air EA is blown along the longitudinal direction Y through the body 81 of the condenser 80, the high-pressure hot gaseous refrigerant flowing through the condenser tubing 82 is cooled by the relatively cooler external air EA, and leaves the condenser 80 in a less hot liquid state. The external air EA that exits the back of the condenser body 81 is now hot air (HA), and is expelled outwardly along the longitudinal direction Y through the hot air exit vent 41 located at the back of the housing 30 to the external atmosphere. The hot air exit vent 41 may be formed as a grate that takes up a large portion of the back of the housing 30 as shown in FIGS. 5-7**.

There are some advantages to having the evaporator and condenser fans 52, 72 rotate in a clockwise direction. Convenient routing of the compressor tubing 94 and condenser tubing 82, such as in the arrangement shown in FIGS. 22-24, results in the hottest refrigerant entering the condenser 80 at the bottom, thus the bottom condenser tubing 82 is at the highest temperature. To optimize performance of the condenser 80, it is desirable to have the highest air flow rates over the hottest condenser tubing 82. Having the condenser fans 72 rotate in a clockwise direction achieves this objective as the air with the greatest velocity is moved over the hottest condenser tubing 82 at the bottom of the condenser 80. This eliminates the need to route the condenser tubing 82 in a less convenient way to ensure that the hottest portion of the tube is at a location of the condenser 80 with the greatest fan velocity, which is the case in known air conditioner units where extra effort must be taken to place the hottest condenser tube towards the center of the condenser where the fan velocity is the highest. The configuration of the present compact air conditioner 20 eliminates this need, as the highest fan velocity and the hottest condenser tubing are both naturally located at the bottom portion of the condenser 80. In addition, condensation that forms in the evaporator 50 flow through gaps at the bottom of the evaporator 50 due to gravity, resulting in water that collects at the bottom. Orienting the evaporator fan 52 to rotate in a clockwise direction induces the water to follow out of the evaporator 50 and further causes the water to be a source of evaporator cooling via a "misting" effect, thus further reducing the ambient temperature of the air blowing over the evaporator 50, particularly on the hottest evaporator tubing 62 where it is most effective. Accordingly, the present configuration increases the overall cooling effectiveness of the system.

Although the evaporator and condenser assemblies 50, 70 have been described above in a configuration wherein the evaporator and condenser fans 52, 72 rotate in the clockwise direction, one of ordinary skill in the art would appreciate that the present compact air conditioner 20 may be configured such that either the evaporator or condenser fans 52, 72 (or both) rotate instead in the counterclockwise direction, in which case the cold air exit vent 39 would be located on the bottom portion 35*b* of the housing 30 instead of the top portion 35*a*. In addition, the curvature of the evaporator 60 would be adjusted to optimize airflow as interior room air IA is drawn in by the evaporator fan 52 and blown through the body 61 of the evaporator 60, and then out towards the cold air exit vent 39. If the evaporator fans 52 were configured to rotate in the counterclockwise direction, the evaporator 60 may be arranged in front of the evaporator fans 52 (as shown in FIG. 44), instead of behind, such that the interior room air IA is drawn in by the evaporator fan 52 and then blown through the evaporator 60 to be cooled and then directly into the room. Furthermore, the routing of the condenser tubing 80 would be changed so that the hottest tubing is located at the top of the condenser 80, where the air velocity is the greatest.

The electrical control system 24 and user control interface 46 have been described above generally. One of ordinary skill in the art would appreciate that there are many different ways of configuring the electrical control system 24 and providing a user control interface 46 that works with the electrical control system 24 to adjust the settings of the compact air conditioner 20. For example and without limitation, the user control interface 46 may include a display component, such as the display screens 47 built into the knobs of the control interface 46 shown in FIGS. 1 and 2, to display relevant information to the user regarding operation of the compact air conditioner 20 and the available settings. Using the control interface 46, the user may make selections regarding powering the compact air conditioner 20 on or off, fan speed settings, set the desired temperature to be maintained by the compact air conditioner 20, set a timer for the compact air conditioner 20, along with other applicable settings. The electrical control system 24 or control interface 46 may also have wireless connectivity so that it can be associated with the user's local wireless network, and may be configured to communicate with computing or mobile devices, such as smartphones. For example and without limitation, the present compact air conditioner 20 may be controlled by a user using an application on the user's mobile phone, such as a smart phone, so the user can adjust the settings of the compact air conditioner 20 remotely from a different room or even when away from the home. If the user leaves the home and forgets to turn off the AC or adjust it to maintain a higher temperature, the user can do so using the mobile device that communicates with the compact air conditioner 20. Similarly, if the user is returning home and wants to turn the air conditioner 20 to begin cooling the house before the user arrives, the user can do so by adjusting the temperature through the user's mobile device. The electrical control system 24 or user interface of the present compact air conditioner 20 may further be configured to communicate with the user's power company or another third party, provided that the user has given the requisite consent, to share information regarding the user's use and interaction with the compact air conditioner 20, such as energy use, preferred temperature, normal operation hours and settings, etc. This can help power companies or other third-party companies analyze various users' AC usage, track usage trends, monitor power availability, and provide the user with feedback regarding their AC usage. In addition, power companies may obtain the user's consent to automatically reduce the user's power usage during high demand periods such as on very hot summer days, such as by giving the power company control to adjust the temperature of the compact air conditioner within a given range. In exchange, the power company may reward the user with credits towards the user's energy bill, or in the form of rebate checks or payments in a cryptocurrency such as Bitcoin. The electrical control system 24 or user control interface 46 may further be in communication with other electronic systems in the user's home, such as a home control system or a wireless compatible thermostat, so that the compact air conditioner 20 can be controlled by the user through those systems as well as the control interface 46 on the unit itself.

Figure 8:
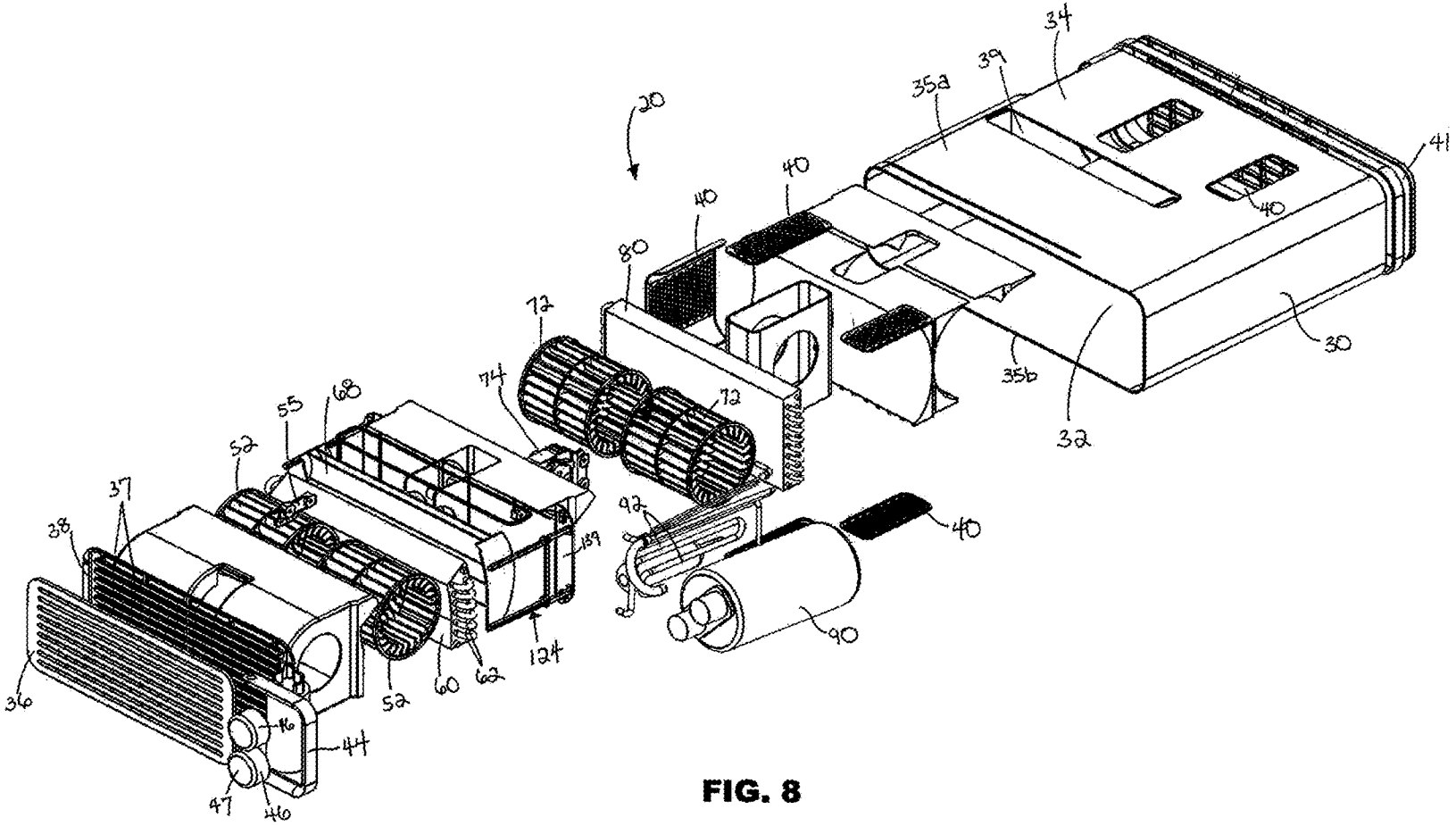
Figure 9:
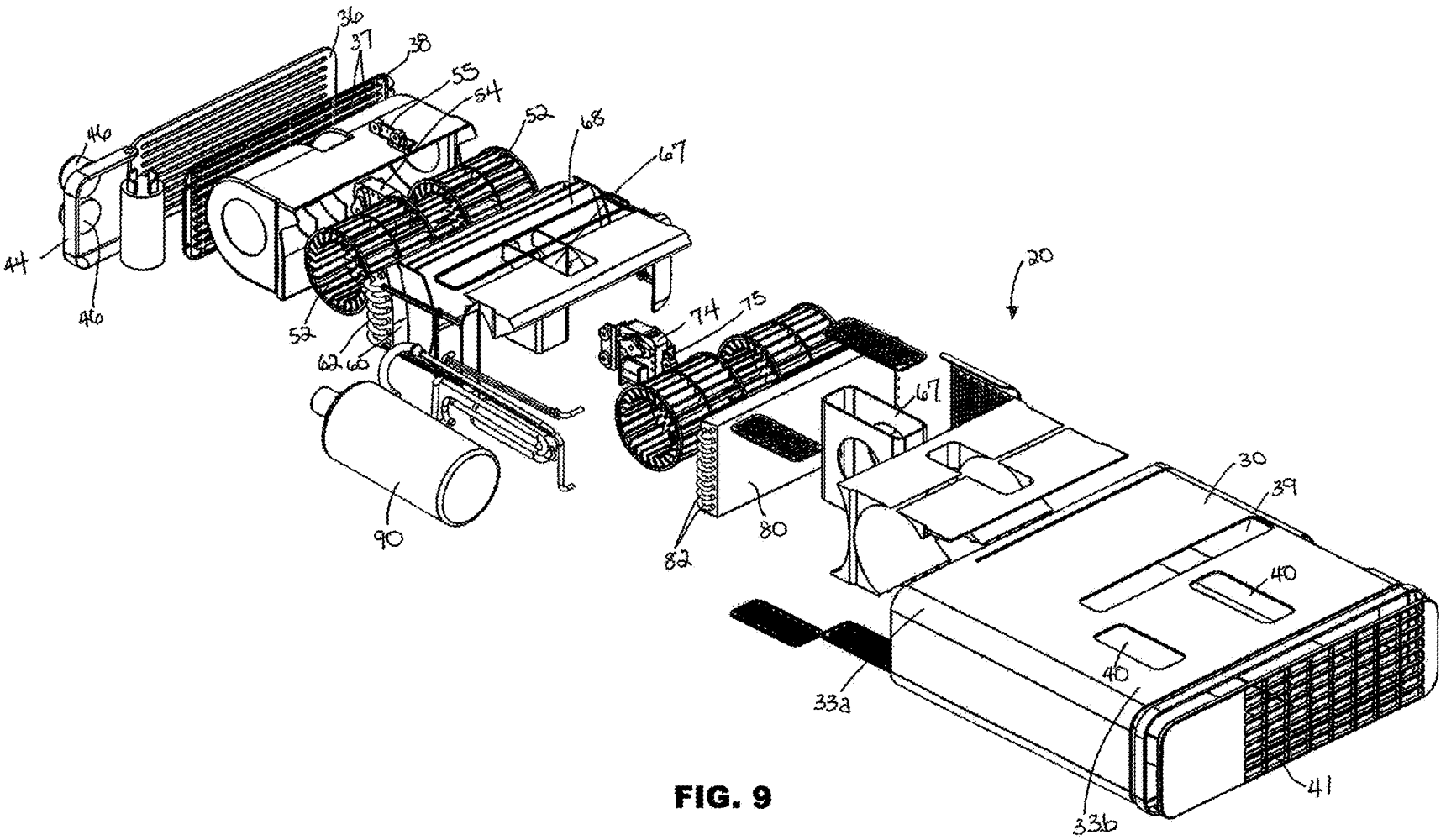
Figure 10:
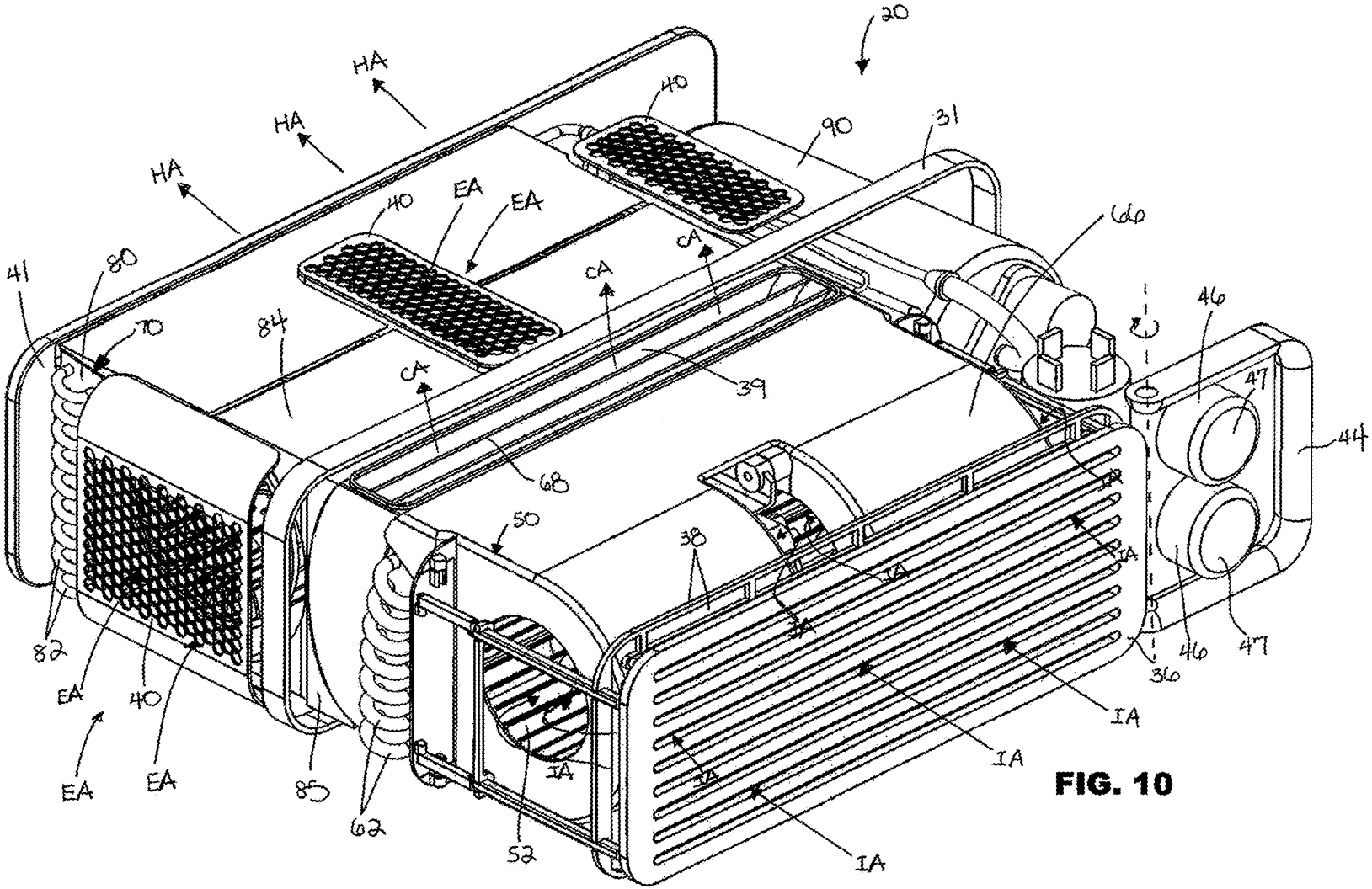
FIGS. 10 and 11 are front perspective views of the compact air conditioner shown in FIG. 1, with certain portions of the housing removed.
Figure 11:
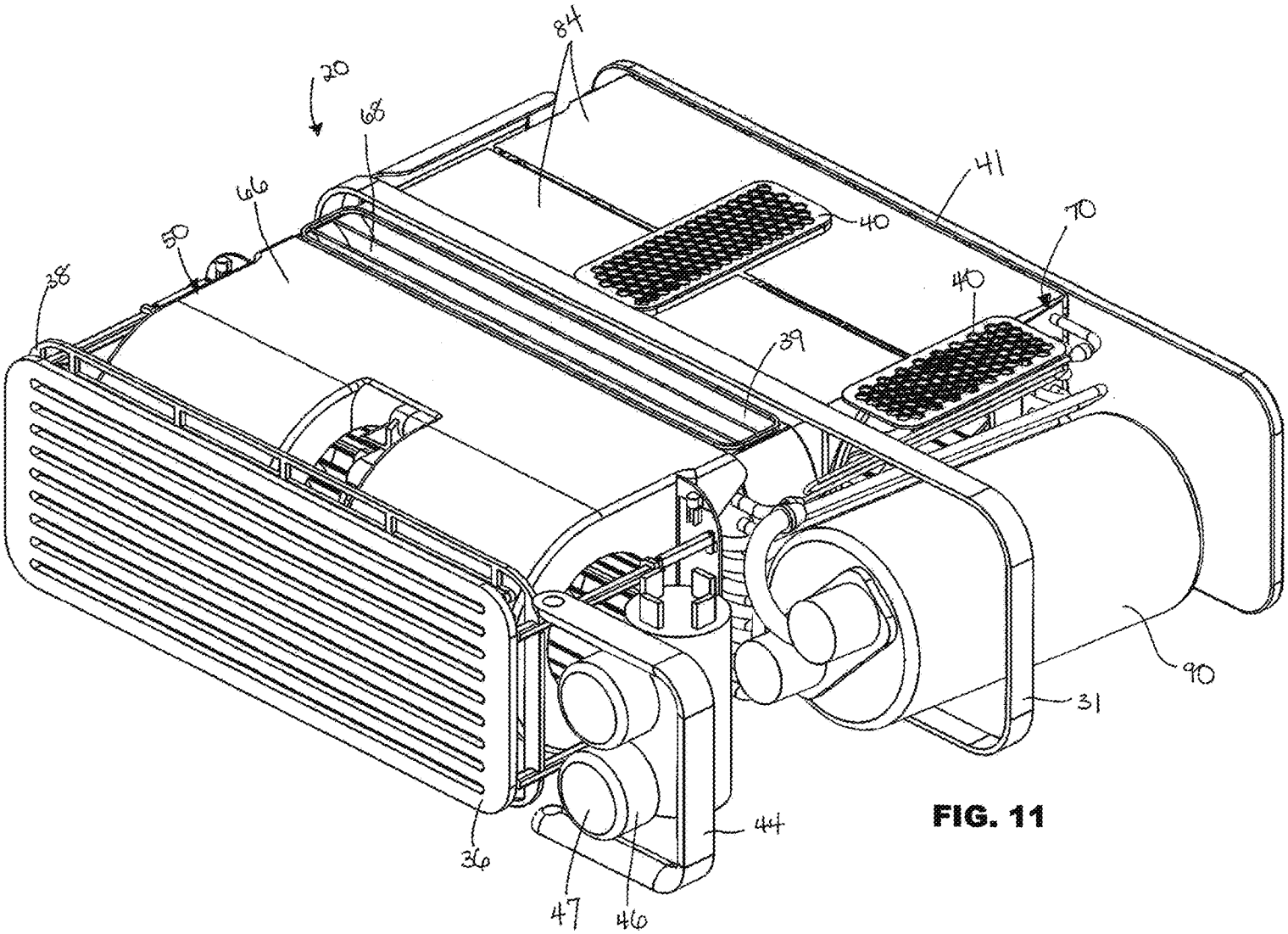

As shown in FIGS. 7-9, the present compact air conditioner 20 may include one or more sensors 26 in communication with the electrical control system 24. One of ordinary skill in the art would appreciate that a variety of sensors 26 may be used in the present compact air conditioner 20 to measure various parameters and performance, including without limitation temperature, humidity, occupancy, pressure, and gases such as carbon dioxide or monoxide. For example, a temperature sensor may be located towards the front portion 33*a* of the housing 30 to measure the temperature within the interior of the room, so that the compact air conditioner 20 can automatically shut off or adjust fan speed once it approaches or reaches a desired temperature set by the user. Although known air conditioners often have temperature sensors that perform this function, those sensors generally measure the air temperature directly on the air conditioner itself or right in front of the air conditioner, where the temperature is the coldest because of the proximity to the exiting cold air, resulting in the air conditioner stopping cooling before the rest of the room reaches the user's desired temperature. To address this problem, the present air conditioner 20 may include an infrared sensor that measures the air temperature at a location that is some distance away from the air conditioner 20, such as the temperature of an opposite wall in the room. This ensures that the compact air conditioner 20 does not cease cooling or turn off before the room has reached the desired temperature set by the user. Furthermore, the present air conditioner 20 may include an exterior temperature sensor located on the back portion 33*b* of the housing 30, which is configured to measure the temperature of the external air outside of the room or building to be cooled. The exterior temperature sensor is preferably configured to also measure the temperature at some distance away from the compact air conditioner 20, as the hot air HA exiting the hot air exit vent 41 may skew the readings too high. By using both interior and exterior temperature sensors, the electrical control system 24 may record and analyze these temperatures to identify trends and predict periods during which cooling is most desired and the amount of time it would take to reach the user's preferred temperature. This information may be provided to the user via the user control interface 46, or through an online dashboard or smartphone application within the user's account. Using this information, the user can make better decisions and be educated regarding optimal settings for the compact air conditioner 20, energy consumption, and may further be guided to allow the electrical control system 24 to automatically operate the compact air conditioner 20 to cool the room based on interior and exterior temperature readings and temperature trends. For example, if based on past temperature readings the electrical control system 24 knows the predicted temperature profile during a hot summer day, the electrical control system 24 can begin cooling the interior of the room before the user would normally start the cooling process so that less time and energy is required as the outside temperature rapidly raises during the day. Likewise, where a user may forget to turn the compact air conditioner 20 off or turn the temperature down at night, the electrical control system 24 can automatically sense that the outside temperature is dropping, and adjust the fan speed and cooling settings automatically to help conserve energy.

In addition to the advantages discussed above, the configuration of the components within the present compact air conditioner 20 also allows the overall weight of the system to be distributed more evenly, which is desirable when the compact air conditioner 20 is shipped, stocked, or moved, as well as when it is handled, installed, uninstalled, or stored by a user. In addition to being very heavy, known window air conditioners are often very unbalanced in weight, as the compressor is the heaviest component (approximately 60% of the entire unit's weight) and is positioned on the side of the air conditioner and usually oriented vertically. In order to move or install the window air conditioner, the user must pick up the air conditioner by the sides, and due to the presence of the compressor one side of the unit will be significantly heavier than the other. Furthermore, in known window air conditioners the vertically-oriented compressor is located towards the back of the unit, such that when the unit is installed in a window the majority of the compressor's weight is outside of the windowsill. This increases the difficulties to the user during the installation process, as the heavy weight of the compressor is pulling the entire unit out and downwards out the window. To address these issues, the present compact air conditioner 20 reorients the compressor 90 so it is arranged horizontally along the longitudinal direction Y, and is further located towards the center of the housing 30 such that when the compact air conditioner 20 is installed in a window, the compressor 90 is located at approximate the same location as the windowsill. This allows the majority of the compressor's weight to be supported directly by the windowsill, and reduces the difficult of installation as the user does not need to tight the weight of the compressor 90 while securing the compact air conditioner 20 to the window. Furthermore, as shown in FIGS. 1-2 and 7-14, the housing 30 of the compact air conditioner 20 may include a handle 44, which is rotatably connected to the front of the housing 30 in a position along the horizontal direction X that is substantially aligned with the center of gravity of the compact air conditioner. As shown in FIGS. 1-2 and 7-14, when the compressor 90 is located on the right side of the compact air conditioner 20, the center of gravity is also skewed towards the right along the horizontal direction X, so the handle 44 is located to the right of the face plate 36. The handle is normally located in a recess of the housing 30, but when a user needs to move the compact air conditioner 20, such as to pull it out from the window during uninstallation or for transportation, the handle 44 rotates along a vertical axis H in order to be easily grasped by the user. In other words, the handle 44 is movable between a retracted position in which it does not substantially extend from the housing 30, and an extended position in which it substantially extends from the housing 30 as to be easily grasped. One of ordinary skill in the art would appreciate that although the handle 44 in the figures have been illustrated as being rotatably connected to the front of the housing 30, it may be connected in alternative ways, such as via a sliding connection in which the handle 44 slides within the internal cavity 32 of the housing 30 when not in use, and can be grasped and slid out by the user substantially along the longitudinal direction Y when moved to the extended position. Using the handle 44, the user can easily move and carry the compact air conditioner 20 as the weight is evenly distributed with respect to the location of the handle 44. Although not shown in the figures, the housing 30 of the compact air conditioner 20 may further include a retractable power cord, which may be retracted into the internal cavity 32 of the housing 30 when the compact air conditioner 20 is being stored, or so that no extra cord is hanging out of the housing 30 when the air conditioner 20 is plugged in and operational.

Figure 49A:
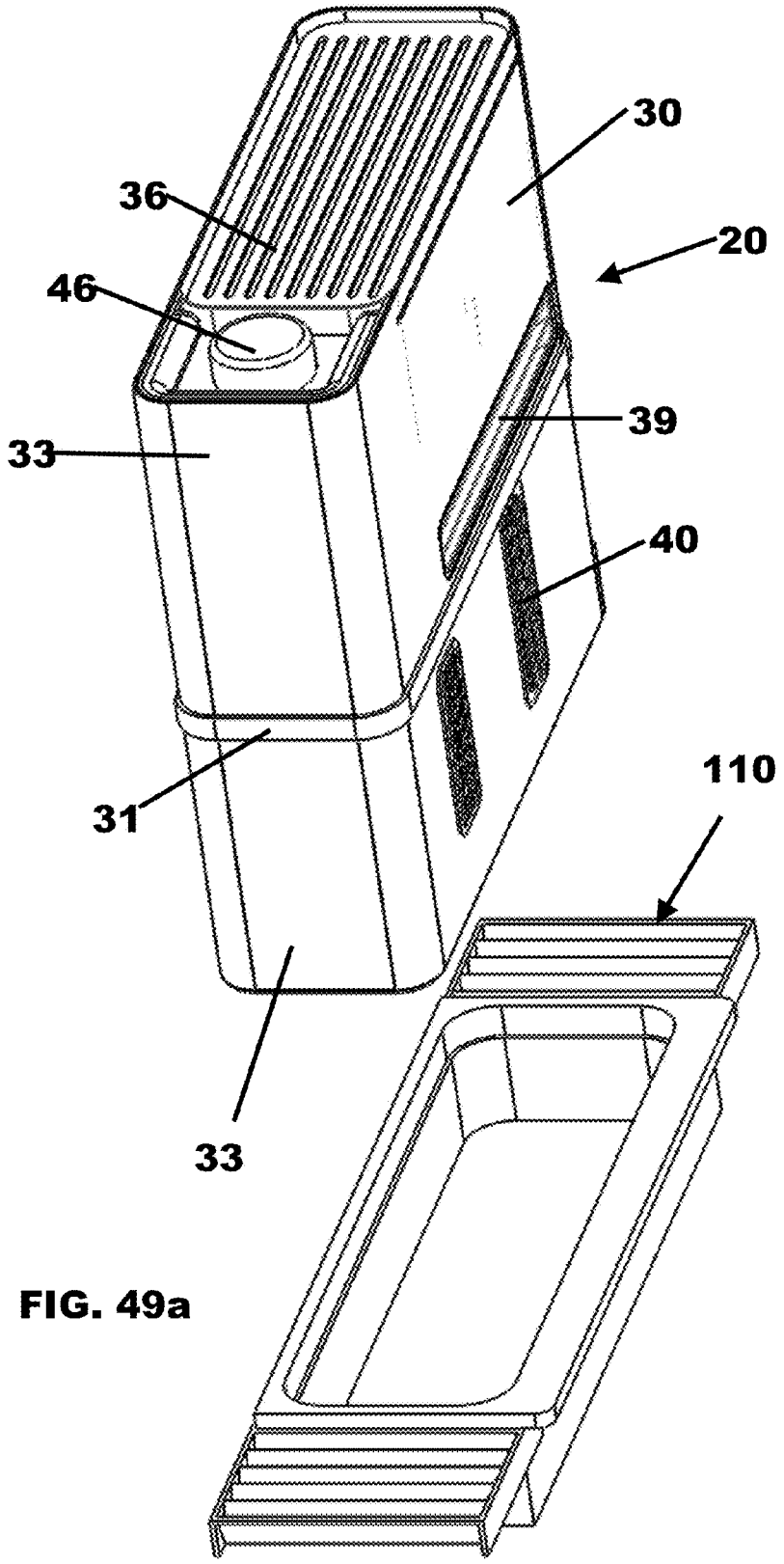
FIGS. 49*a* and 49*b* are perspective views of the compact air conditioner shown in FIG. 1 with a window installation frame.
Figure 49B:
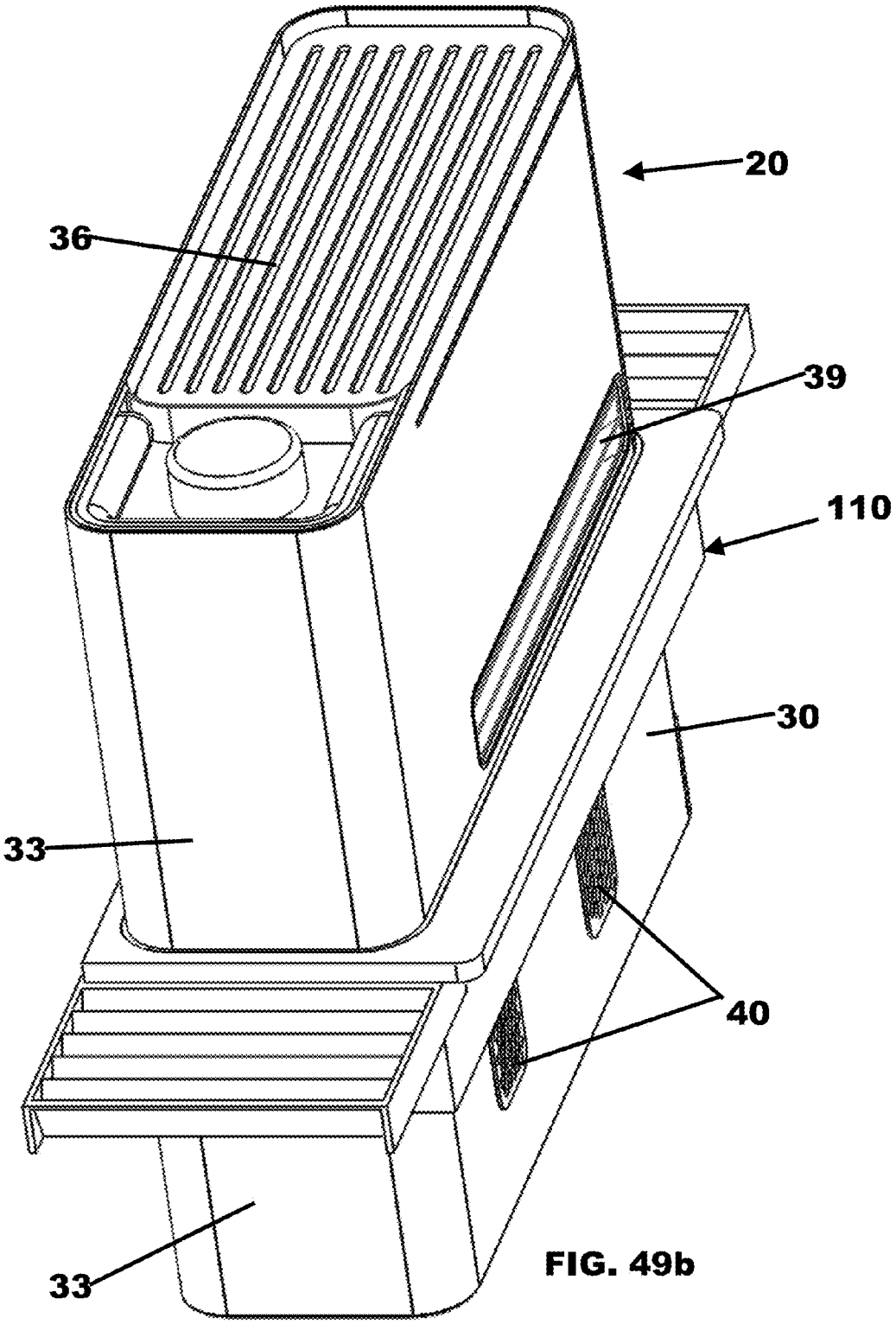

As discussed above, one of the advantages of the present compact air conditioner 20 is the ease of installation and uninstallation, which improves the user experience and also improves the safety of the device. Placing the handle 44 in the front of the housing 30 substantially at the center of the gravity allows the user to easily carry, lift, and install the present compact air conditioner 20. As shown in FIGS. **49*a*-49*b*, the compact air conditioner 20 may be used with a window installation frame 110, which is a separate assembly that may be individually mounted to the windowsill before the compact air conditioner 20 is also placed on the windowsill. The present window installation frame 110 shown in FIGS. 49*a*-49*b* is lightweight and can be easily attached to the windowsill through a plurality of fasteners or fixation mechanism, including without limitation screws, bolts, clasps, latches, etc. Furthermore, the size of the window installation frame 110 may be easily adjusted to fit different window sizes, such as through an accordion feature built into the frame. Once the user has securely attached the window installation frame 110 to the windowsill, the user can easily lift the compact air conditioner 20 using the handle 44 and slide the compact air conditioner 20 into place within the window installation frame 110, and then securing the air conditioner 20 to the installation frame 110 using any suitable fastener or fixation mechanism, which would be provided to the user a part of the installation package and explained in the installation directions. For example and without limitation, the compact air conditioner 20 may be secured to the window installation frame 110 using screws, bolts, dowels, pins, clasps, latches, clips, ties, joints, flanges, interference fits, or a combination of the foregoing. As shown in FIGS. 1-6, the housing 30 of the compact air conditioner 20 may include a retainer strap 31, which may be in the form of a slightly raised flange or protrusion that extends along part of, or all of, the circumference of the housing 30. The retainer strap 31 is preferable arranged substantially at the center of gravity along the longitudinal direction (depth) Y of the compact air conditioner 20, such that the weight between the front and the back of the compact air conditioner 20 is substantially balanced. During installation, the user would first secure the window installation frame 110 to the windowsill, and then slide the compact air conditioner 20 into the window installation frame along the horizontal direction Y until the retainer strap 31 engages with a corresponding retaining element in the window installation frame 110, such as a groove that corresponds to the retainer strap 31. This lets the user know that the compact air conditioner 20 is now in the proper position, and further helps to keep the air conditioner 20 in position while the user uses additional fasteners or fixation mechanisms to further secure the air conditioner 20 to the window installation frame 110 and, in turn, the windowsill. The placement of the retainer strap 31 at the center of gravity of the compact air conditioner 20 also helps to stabilize the unit during and after installation, as the user does not need to exert a great deal of effort to keep the compact air conditioner 20 from falling out the window during installation, and can have greater peace of mind after installation is complete. The compact size of the present air conditioner 20 also contributes to the ease of installation and uninstallation, as the air conditioner can be easily slid into and out of the window installation frame 110 by pushing or pulling on the handle 44. Furthermore, the significantly reduced height of the present compact air conditioner 20** means that less of the user's view out of the window is obstructed by the unit, thus improving the user experience overall.

When the user is ready to uninstall the compact air conditioner, the user may simply unfasten the fasteners or other fixation mechanisms securing the unit to the window installation frame 110, then use the handle 44 to pull the compact air conditioner 20 out of the window installation frame 110 such that the retainer strap 31 is disengaged. The compact air conditioner 20 may then be easily transported and stored, and the window installation frame is removed separately until the next installation. If the user lives in a climate that does not get extremely cold so that the loss of heat through windows is not a major concern, the user may opt to leave the compact air conditioner 20 installed during the colder months. Alternatively, the window installation frame 110 may include a shielding component configured to close the opening that the compact air conditioner 20 usually sits in, such as an accordion mechanism, a sliding plate, or a snap on plate, which acts to close off the opening in the window installation frame 110. The shielding component may take different forms, and may include multiple shielding components each suited to different climates and weathers. For example and without limitation, the shielding component may include a screen for the warmer months when no air conditioner is required, but the outside ambient air is still a comfortable temperature, so that fresh air can enter the interior through the screen. Alternatively, the shielding component may be made out of a material having thermal insulation properties, such that during the colder months heat inside of the room is not lost significantly through the window installation frame 110 to the outside. This would eliminate the need for a user to install and uninstall the window installation frame every year when air conditioner is required, but instead a single installation that remains in place during the year. With current known window air conditioners, many users elect to keep the unit installed year-round due to the complexity and difficulty of the installation and uninstallation process, which results in the view from the window being obstructed year-round and significant heat loss during the colder months through the air conditioner unit and the gaps between the unit and the window frame. The present compact air conditioner 20 and window installation frame 110 addresses this problem by ensuring that installation and uninstallation is a painless and uncomplicated process, and by providing the user with a way to keep the window installation frame 110 in place without resulting in significant heat loss.

In addition to the advantages discussed above, the present compact air conditioner 20 may further provide a fresh air circulation mode to bring in fresh air from outside of the room or building without utilizing the cooling components, which is desirable when the outside temperature is cooler and no significant cooling is required. When known window air conditioning units are run on a fan only mode, both the evaporator and condenser fans are driven by the single motor even though no cooling is occurring and there is no need for the condenser fan to run, which results in increase noise and inefficient energy use. Furthermore, existing window air conditioners' "fresh air" intake or fan modes generally do not truly circulate fresh air from the external environment, but rather only draws in a small amount of outside air from a limited vent, and then draws in additional internal air that is mixed with the outside air and blown back into the room. The present compact air conditioner 20 addresses these issues by providing a true fresh air circulation mode that only draws in air from the external atmosphere into the interior of the room or building, and by selectively actuating only the evaporator fans 52 to blow the fresh outside air into the interior, thus reducing energy consumption and noise.

Figure 31:
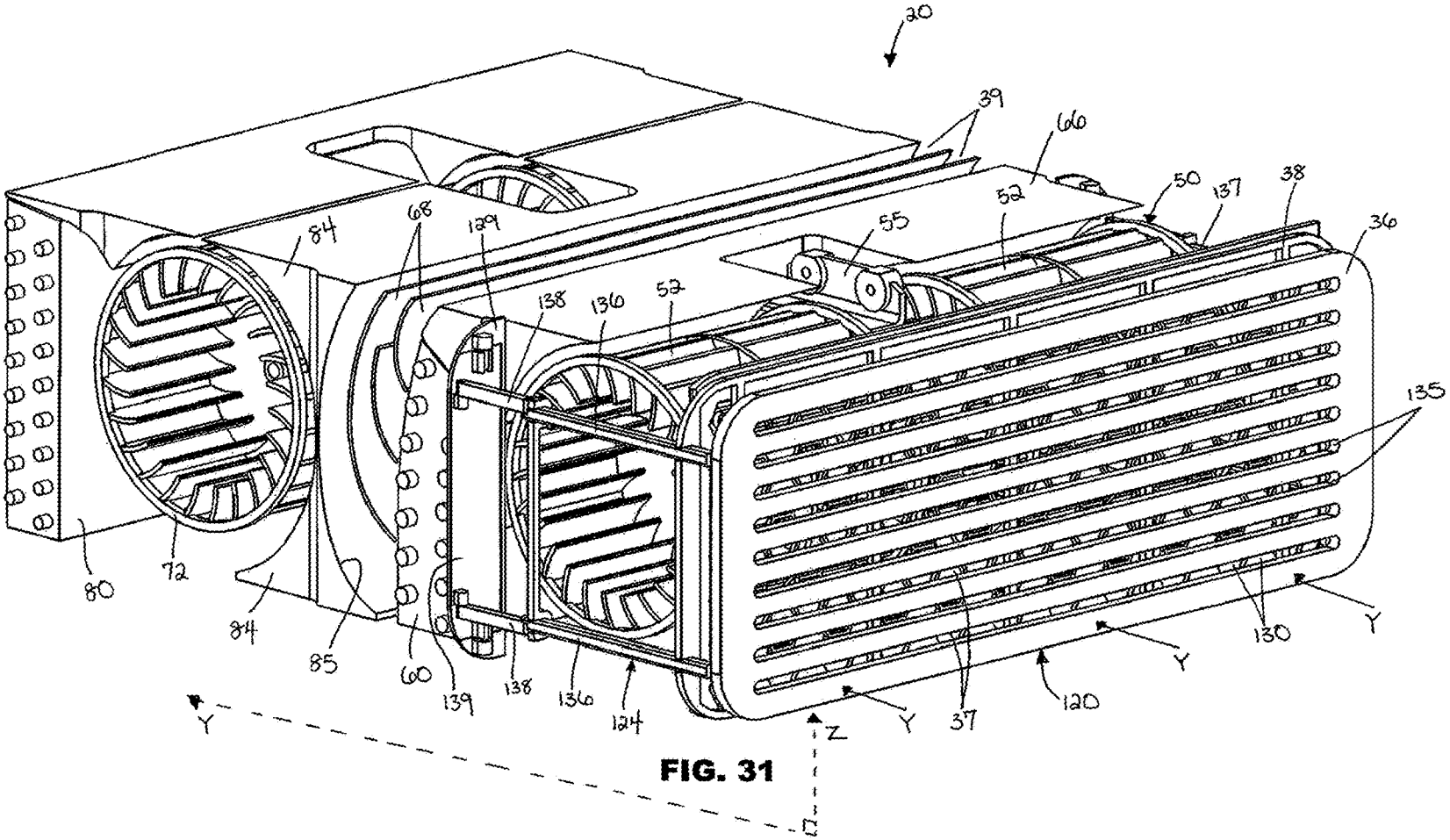
FIG. 31 is a front perspective view of the compact air conditioner shown in FIG. 1 having a fresh air intake assembly, with certain portions of the housing removed and the fresh air intake assembly in a non-active state.
Figure 32:
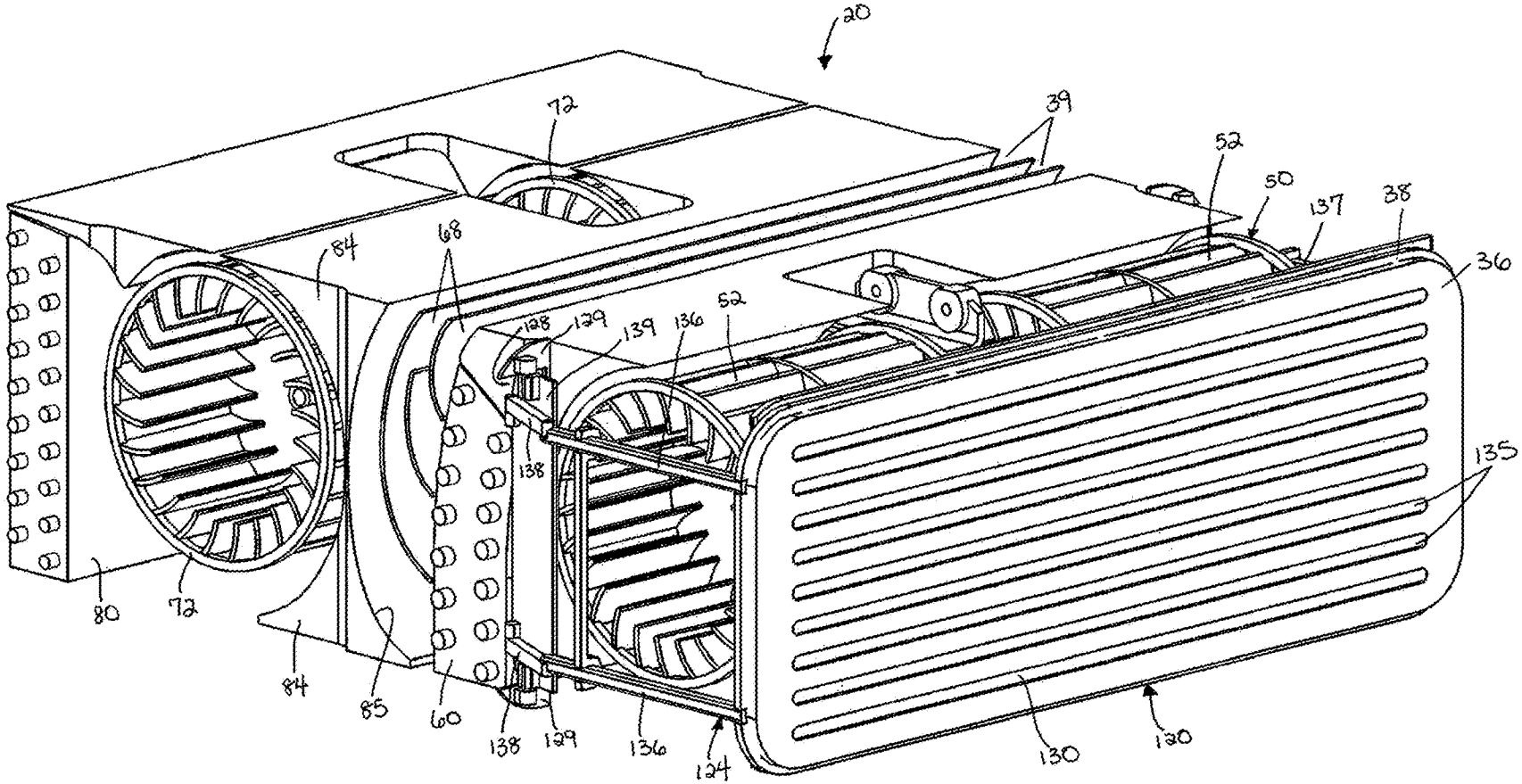
FIG. 32 is a front perspective view of the compact air conditioner shown in FIG. 31, with the fresh air intake assembly in an active state.

As shown in FIGS. 31-41, an embodiment of the present compact air conditioner 20 may include a housing 30, an evaporator assembly 50, a condenser assembly 70, a compressor 90 or thermoelectric heat pump, and an electrical control system 24 as discussed above. The compact air conditioner 20 may further include a fresh air intake assembly 120 configured to circulate fresh air, which may be operated independently of the coo ling components of the compact air conditioner 20. One of ordinary skill in the art would understand that the present fresh air intake assembly 120 may be adapted to be used with different window air conditioner as well with only slight modifications, and is not restricted to use with the specific evaporator assembly 50, condenser assembly 70, and compressor 90 discussed herein and shown in the drawings. As shown in FIGS. 31-32, the fresh air intake assembly 120 may be configured to circulate fresh air by drawing in external air EA from the external air intake grate 40 located at the back portion 33*b* of the outer surface 34 of the housing 30, directing the external air EA through the housing 30, and expelling the external EA out through an air exit vent (which may be the cold air exit vent 39) located at the front portion 33*a* of the housing 30. The fresh air intake assembly 120 may include an actuation mechanism 124, a sensor 126, and an air valve 128.

As discussed above and shown in FIGS. 31-32 and 35-41, the housing 30 may include a room air intake grate 38 having a plurality of openings 37, which may be located at the front portion 33*a* of the housing 30. The housing 30 may further include a face plate 36 that is movably associated with the room air intake grate 38, and a coupling component 130 that is associated with the room air intake grate 38 and the face plate 36. For example, the coupling component 130 may be made a part of the room air intake grate 38 and the face plate 36. In one embodiment, the coupling component 130 may include a plurality of male members arranged on one of the room air intake grate 38 or the face plate 36, and a plurality of female members arranged on the other one of the room air intake grate 38 or the face plate 36 in alignment with the male members. In other words, one of the air intake grate 38 and the face plate 36 would have a plurality of male members, and the other would have corresponding female members that would mate with the male members when the air intake grate 38 and the face plate 36 are brought adjacent to each other, or put in contact with each other. Although FIGS. 39-41 show an example in which the male members 132 are located on the room air intake grate 38 as a plurality of flanges or protrusions 133 interposed between the plurality of openings 37 of the room air intake grate 38, and the female members 134 are located on the face plate 36 as a plurality of elongated slots or through-holes 135, one of ordinary skill in the art would understand that the location of the male and female members 132, 134 may be reversed on the room air intake grate 38 and the face plate 36 without departing from the spirit of this application. In fact, where the male members 132 are located on the face plate 36 instead of the room air intake grate 38, the female member 134 may be the same as the plurality of openings 37 located on the room air intake grate 38, such that the male members 132 of the face plate 36 would correspond to and engage with the plurality of openings 37 of the room air intake grate 38. Similarly, one of ordinary skill in the art would recognize that the pluralities of male and female members 132, 134 need not be formed as the flanges 133 and corresponding open slots 135 as shown in the figures, but can take any form in which the male member 132 is received into the female member 134 to form a coupling, including for example and without limitation embodiments in which the male members 132 are pegs or other types of protrusions, and the female members 134 are smaller through-holes that correspond to the cross-sectional area of the pegs or other protrusions, instead of the elongated slots 135 shown in FIGS. 39-41. Similarly, the plurality of openings 37 of the room air intake grate 38 may be formed in any shape or size, provided that sufficient airflow is achieved therethrough.

Figure 38:
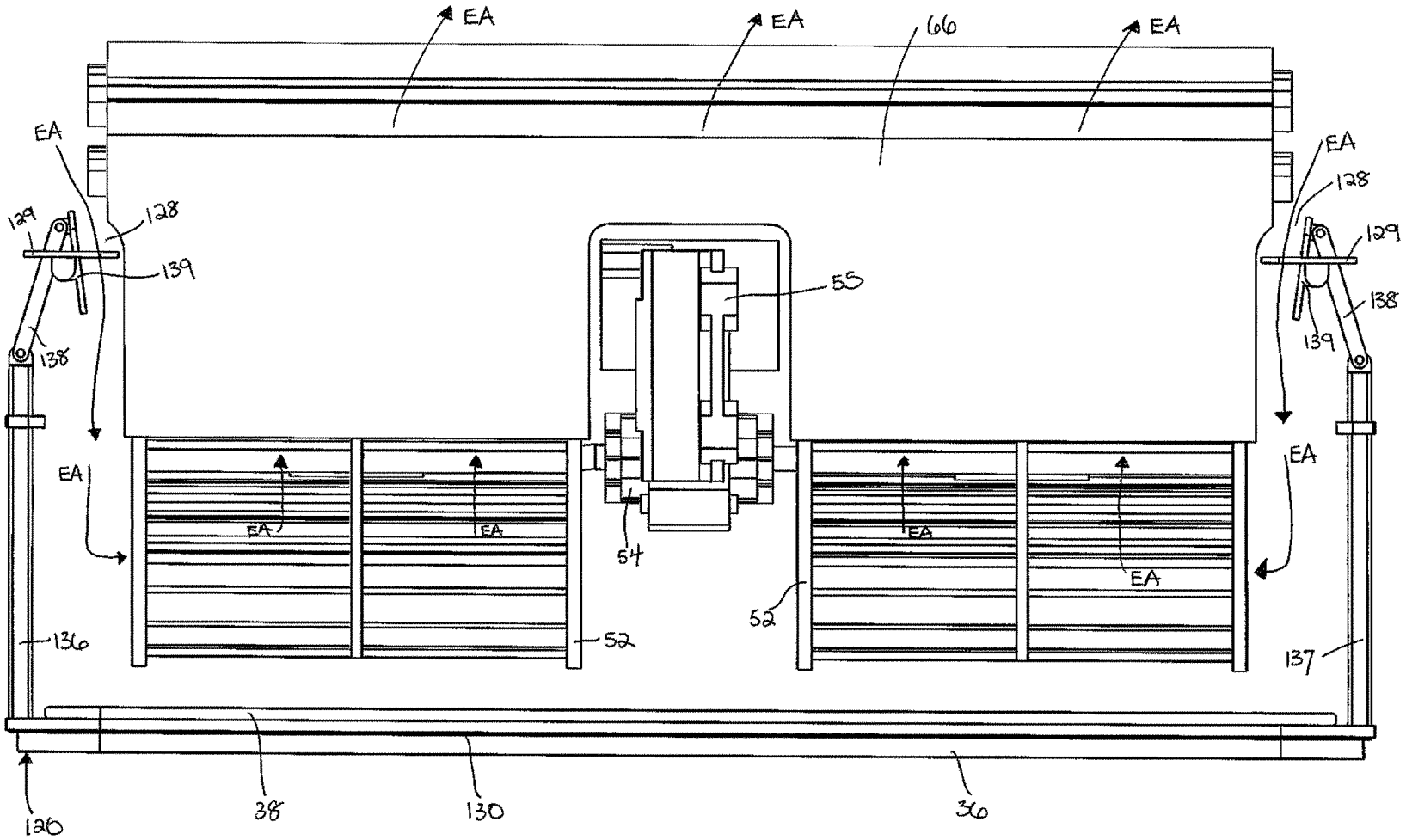
FIG. 38 is a top plan view of an enlarged detail of the compact air conditioner shown in FIG. 31, with the fresh air intake assembly in an active state.
Figure 39:
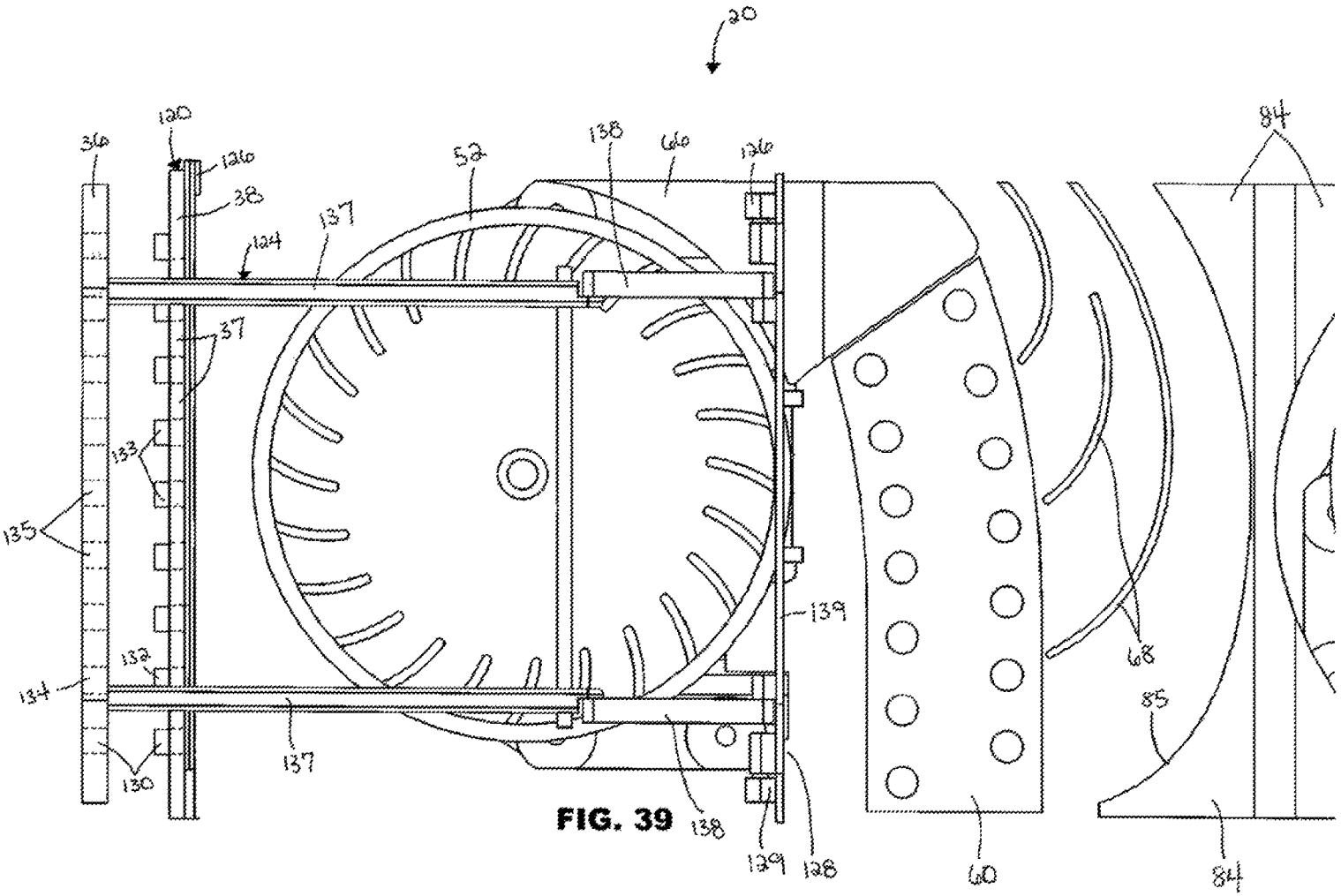
FIG. 39 is a right elevation view of the compact air conditioner shown in FIG. 37, with the fresh air intake assembly in a non-active state.
Figure 40:
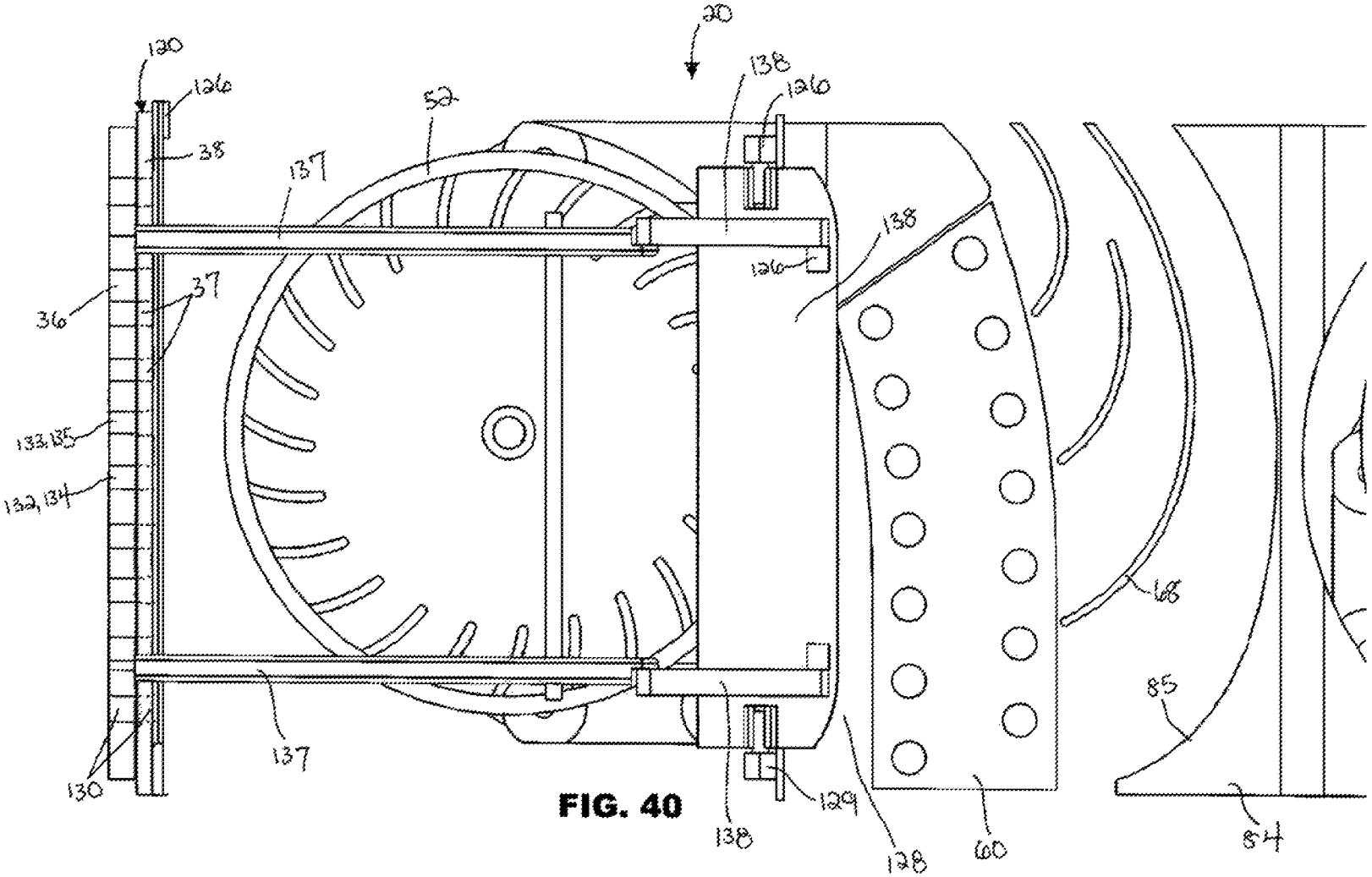
FIG. 40 is a right elevation view of the compact air conditioner shown in FIG. 38, with the fresh air intake assembly in an active state.
Figure 41:
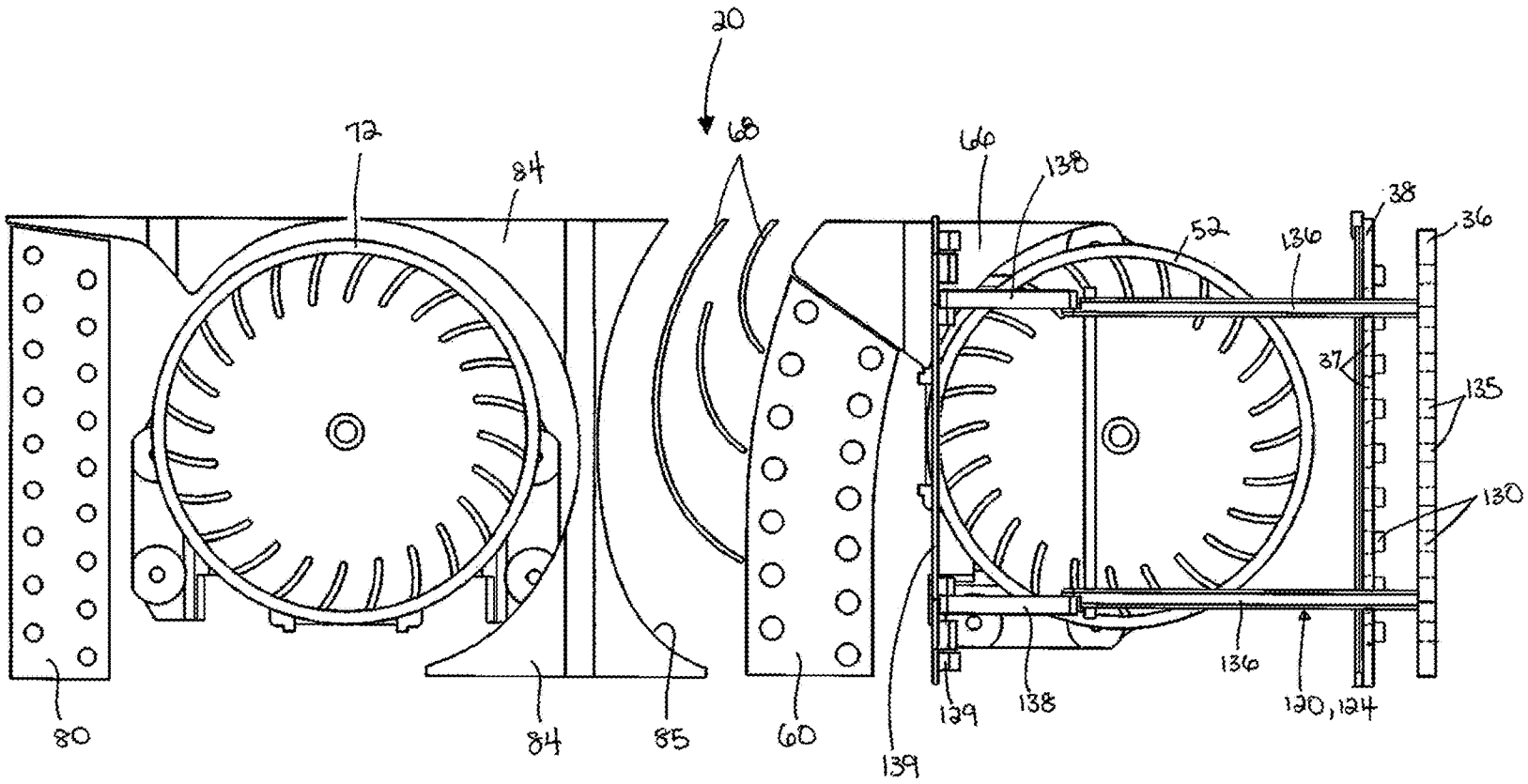
FIG. 41 is a left elevation view of the compact air conditioner shown in FIG. 31, with the fresh air intake assembly in a non-active state.

In the exemplary embodiment shown in FIGS. 31-41, the face plate 36 is movable along the longitudinal direction Y between an open position in which the male members 132 and female members 134 are not engaged and there is a gap between the face plate 36 and room air intake grate 38, such that air can flow between the plurality of openings 37 in the room air intake grate 38 into the internal cavity 32 of the housing 30 (as shown in FIGS. 31, 33, 35-37, 39, and 41), and a closed position in which the male members 132 and female members 134 are engaged, such that air cannot flow into the internal cavity 32 of the housing 30 (as shown in FIGS. 32, 38, and 40). As shown in FIGS. 39 and 41, when the face plate 36 is in the open position, air may flow through the gap between the face plate 36 and the room air intake grate 38 and through the female members 134 in the form of slots 135 formed in the face plate 36 and then through the plurality of openings 37 formed in the room air intake grate 38 into the internal cavity 32 of the housing. When the face plate 36 is moved to the closed position as shown in FIG. 40, the plurality of openings 37 in the room air intake grate 38 are blocked by the face plate 36 (specifically, the portions of material between the slots 135 formed in the face plate 36), and the male members 132 in the form of flanges 133 located on the room air intake grate 38 are engaged with the female members 134 in the form of slots 135 located on the face plate 36. The face plate 36 may be associated with the actuation mechanism 124 of the fresh air intake assembly 120 such that wen the face plate 36 is in the open position, the fresh air intake assembly 120 is in a non-active state in which the air valve 128 (as discussed in further detail below) is closed, and when the face plate 36 is moved to the closed position, the fresh air intake assembly 120 is in an active state in which the air valve 128 is open.

The sensor 126 may be located at or associated with at least one of the face plate 36, the room air intake grate 38, the actuation mechanism 124, or the air valve 128 and may be configured to detect when the face plate 36 is in the open position or the closed position, or to detect when the fresh air intake assembly 120 is in an active or non-active state. The sensor 126 may further be in communication with the electrical control system 24, which may be configured to selectively activate the actuation mechanism 124 of the fresh air intake assembly 120 such that when the face plate 36 is in the open position, the fresh air intake assembly 120 is in a non-active state in which the air valve 128 is closed, and when the face plate 36 is in the closed position, the fresh air intake assembly 120 is in an active state in which the air valve 128 is open. For example and without limitation, the sensor 126 may be or include a Hall effect sensor, which is a transducer that varies its output voltage in response to a magnetic field. Where a Hall effect sensor is used, at least one of the face plate 36 or the room air intake grate 38 may be associated with the Hall effect sensor, while the other one of the face plate 36 or the room air intake grate 38 is associated with a magnetic element. When the face plate 36 and room air intake grate 38 are brought into close proximity with each other as the face plate 36 is moved to the closed position, the Hall effect sensor detects the presence of the magnetic element, and may trigger the electrical control system 24 to activate the fresh air intake mode, stop cooling the interior room air, or activate the actuation mechanism 124 of the fresh air intake assembly 120.

Figure 33:
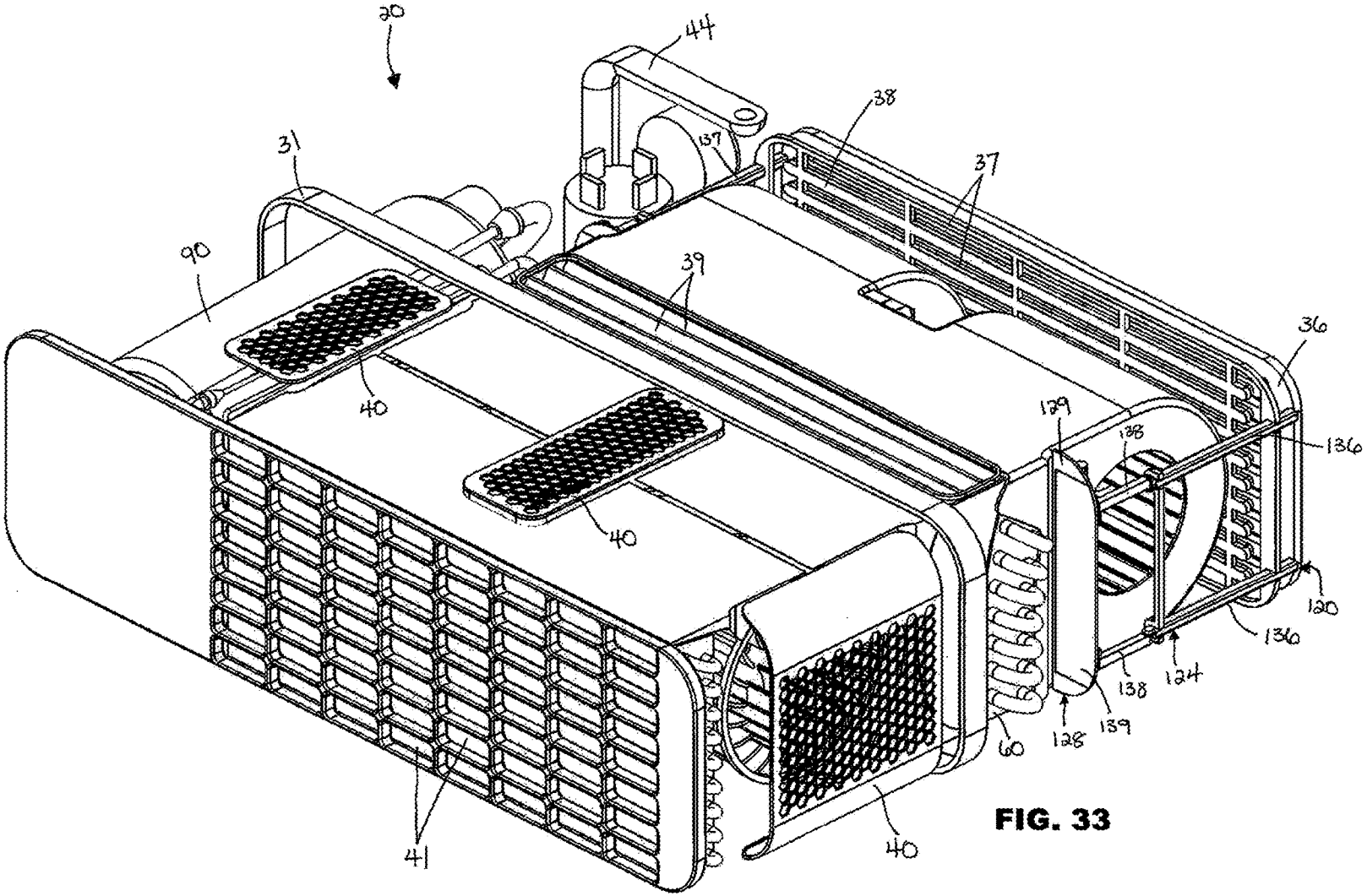
FIGS. 33 and 34 are back perspective views of the compact air conditioner shown in FIG. 1 having a fresh air intake assembly, with certain portions of the housing removed and the fresh air intake assembly in a non-active state.
Figure 34:
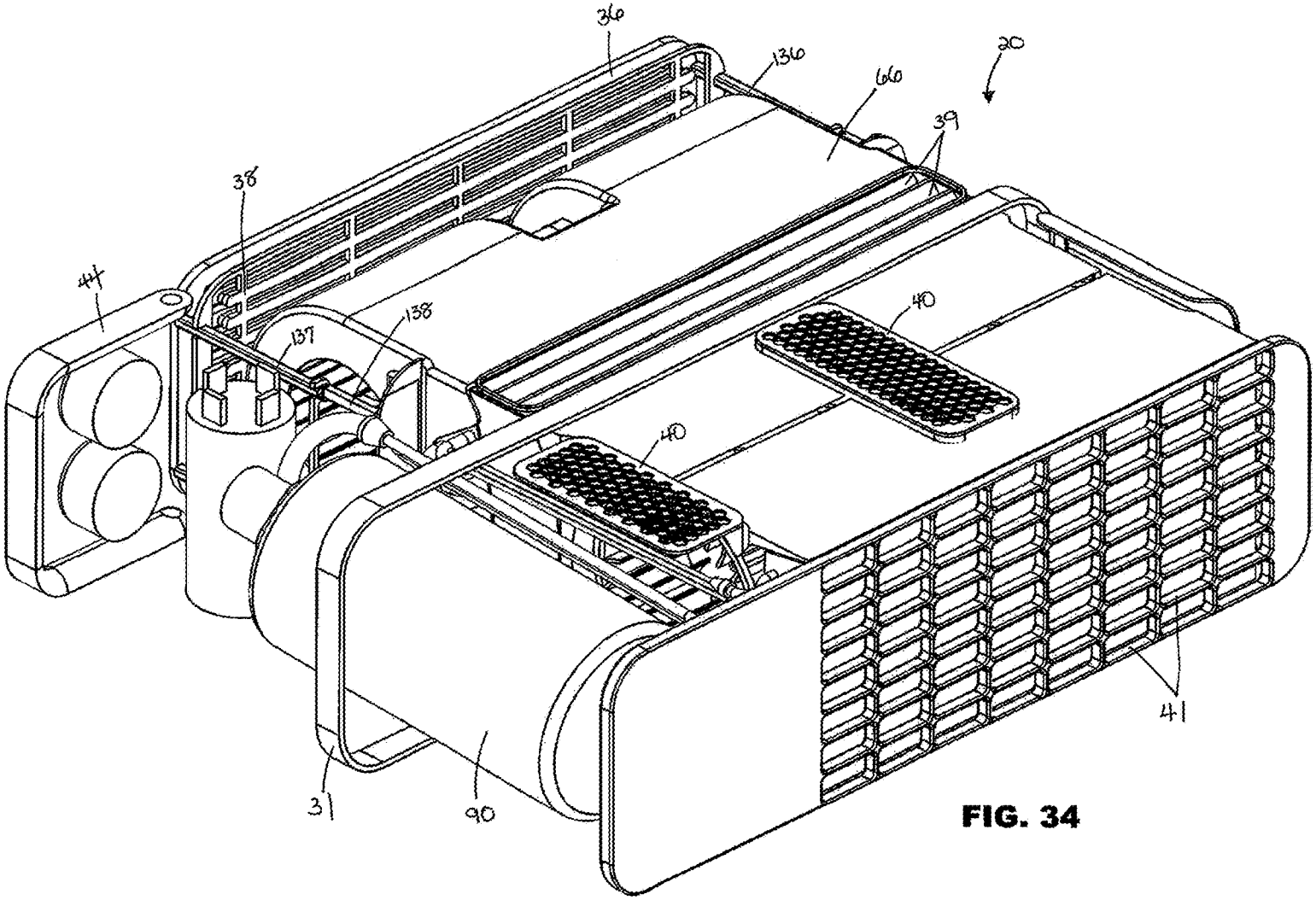
Figure 35:
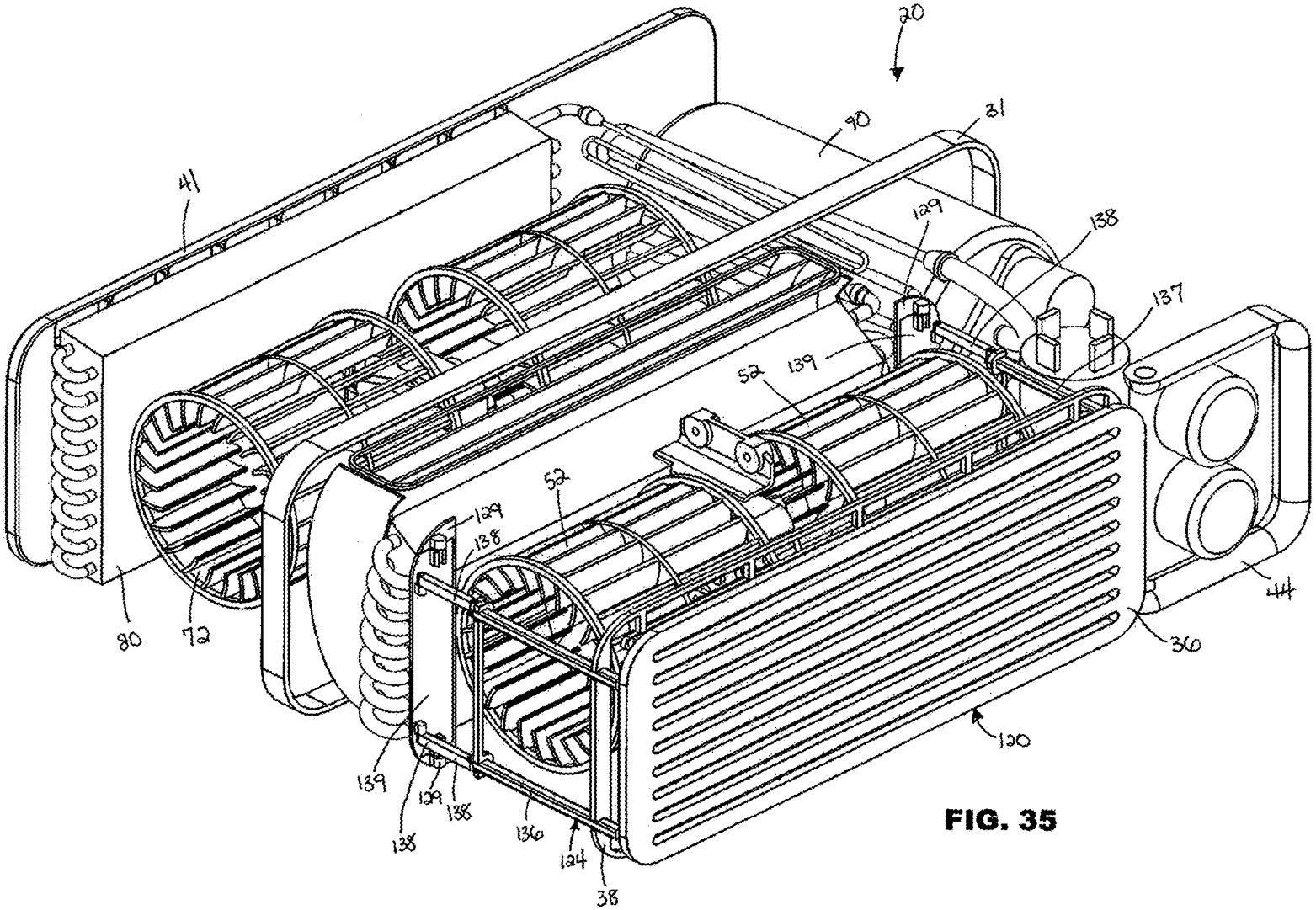
FIG. 35 is a front perspective view of the compact air conditioner shown in FIG. 1 having a fresh air intake assembly, with certain portions of the housing and internal fairings removed, and the fresh air intake assembly in a non-active state.
Figure 36:
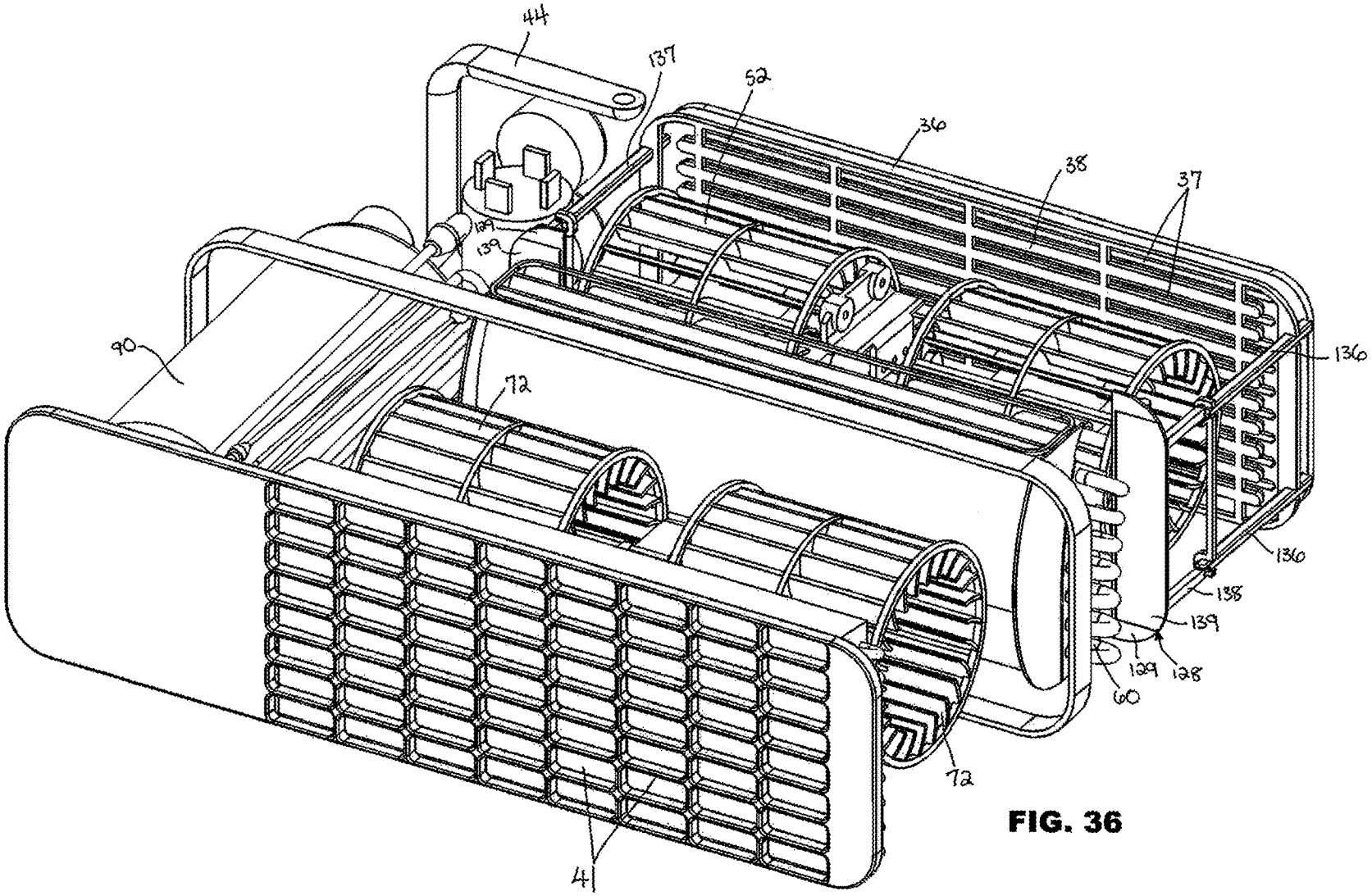
FIG. 36 is a back perspective view of the compact air conditioner shown in FIG. 35, with the fresh air intake assembly in a non-active state.
Figure 37:
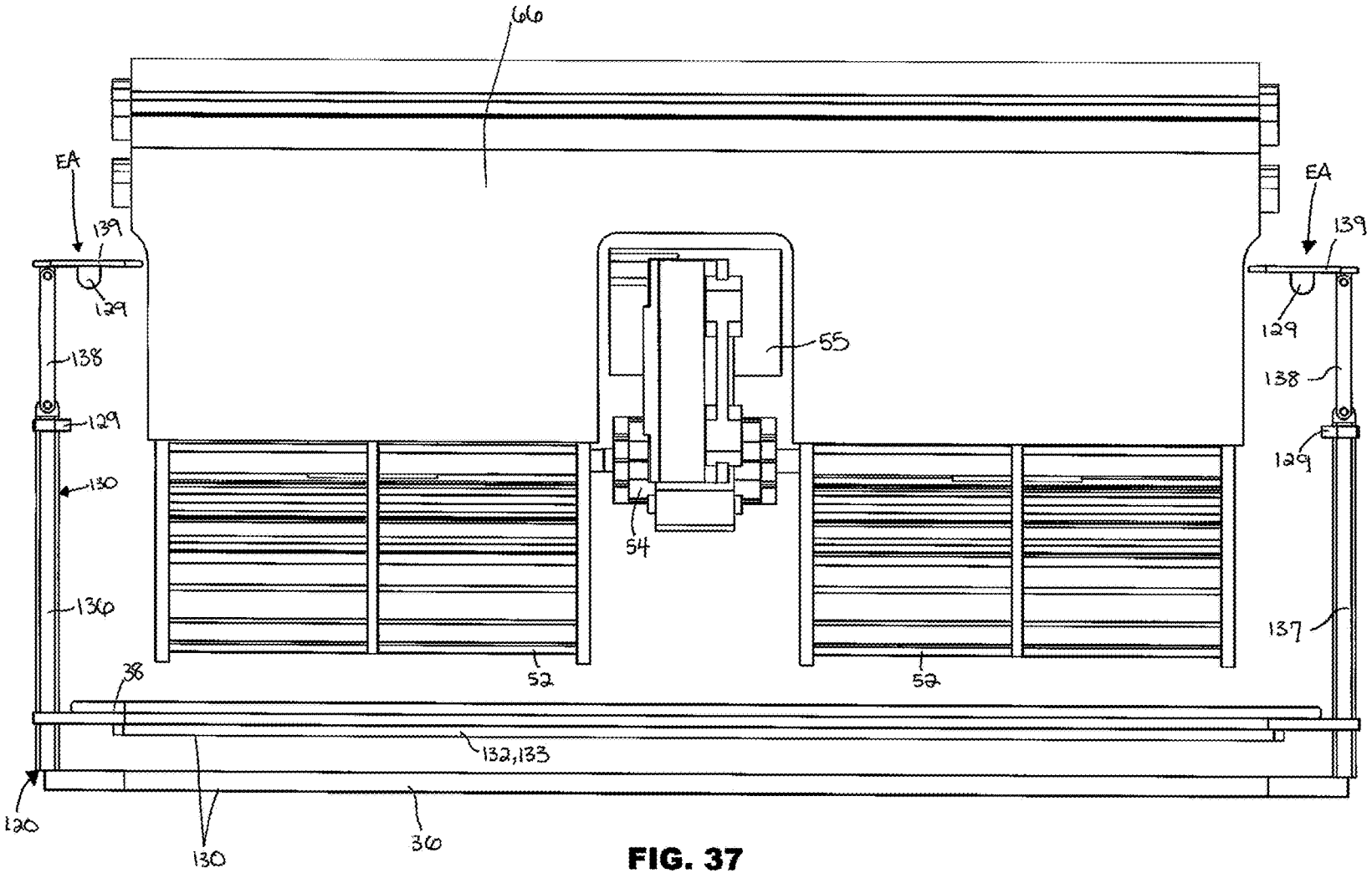
FIG. 37 is a top plan view of an enlarged detail of the compact air conditioner shown in FIG. 31, with the fresh air intake assembly in a non-active state.

As shown in FIGS. 31-41, the actuation mechanism 124 of the fresh air intake assembly 120 may include a left arm 136 and a right arm 137, which are each associated with the face plate 36. Each one of the left and right arms 136, 137 may be pivotally connected to a linkage bar 138 that is in turn pivotally connected to a flap 139 that moves in relation to an air valve frame 129 associated with the housing 30. While a single left arm 136 and a single right arm 137 and a single linkage bar 138 associated with each arm 136, 137 may be utilized, as shown in FIGS. 31-33 each of the left and right arms 136, 137 may include two separate arms that are driven concurrently by the movement of the face plate 36, each of the two sets of left and right arms 136, 137 being pivotally connected to its own linkage bar 138, which act together to actuate the flap 139. The flap 139 is movable to close the air valve 128 when the face plate 36 is in the open position (as shown in FIGS. 31, 33, 35-37), and to open the air valve 128 when the face plate 36 is in the closed position (as shown in FIGS. 32, 38, and 40). When the air valve 128 is closed, external air EA drawn in from the external air intake grate 40 cannot enter the front portion 33*a* of the internal cavity 32 of the housing 30. However, when the air valve 128 is open, external air EA can enter the front portion 33*a* of the internal cavity 32 of the housing 30 through the air valve 128. When the user wishes to change the fresh air intake assembly 120 from the active state to the non-active state, such as when the user no longer desire fresh air circulation or when the user wants to turn on the air conditioning capabilities of the unit, the user may manually actuate the actuation mechanism 124 and move the face plate from the closed position back to the open position, which may be done by pulling the face plate 36 outwardly along the longitudinal direction Y, or by pushing the face plate 36 further inwardly along the longitudinal direction Y to activate a spring mechanism located in the front portion 33*a* of the housing 30 (not shown), which would act to move the face plate 36 outwardly towards the open position. Such spring mechanisms are well known in the art, and are often used to actuate components that are opened and closed along the same direction, and when used gives tactile feedback to the user in the form of a "clicking" sensation when the spring mechanism is actuated. As discussed above, the electrical control system 24 may be in communication with the sensor 126, and may be further configured to selectively activate the evaporator assembly 50, the condenser assembly 70, and the compressor 90 such that when the fresh air intake assembly 120 is in the active state, the compressor 90 and back motor 74 are turned off, and the front motor 54 is turned on to drive the evaporator fan 52 to move external air EA drawn in from the external air intake grate 40 through the internal cavity 32 of the housing 30 and out through the air exit vent 39 located at the front portion 33*a* of the outer surface 34 of the housing 30. This allows the present compact air conditioner 20 to offer a true fresh air circulation mode in which approximately all of the air being drawn in and blown into the room is fresh external air, as opposed to recycled interior air. In addition, only the evaporator fan 52 is powered and operating during the fresh air circulation mode when the fresh air intake assembly 120 is in the active state, as compared to known window air conditioners with a single motor that require both the condenser and evaporator fans 72, 52 to be rotating even when the condenser fans 72 are not necessary for circulating fresh air. Compared to such known systems, the present compact air conditioner 20 is able to reduce energy use and fan noise while providing fresh air circulation when no air conditioning is required.

Although the fresh air intake assembly 120 has been described as being manually actuated by a user, as discussed above the electrical control system 24 may be configured to selectively activate the actuation mechanism 124 of the fresh air intake assembly 120 such that when the face plate 36 is in the open position, the fresh air intake assembly 120 is in a non-active state in which the air valve 128 is closed, and when the face plate 36 is in the closed position, the fresh air intake assembly 120 is in an active state in which the air valve 128 is open. Where the electrical control system 24 is used to selectively activate the actuation mechanism 124, no user action is required to switch the compact air conditioner 20 from a cooling mode to a fresh air intake mode or vice versa. Instead, the user may direct the electrical control system 24 to selectively activate the actuation mechanism 124 via the control interface 46, or via a device that communicates with the control interface 46 or the electrical control system 24, such as a remote or personal computing device as discussed above. Once the electrical control system 24 receives a command from the user to activate the actuation mechanism 124, the electronic control system 24 may actuate at least one of the face plate 36, the left and right arms 136, 137, the linkage bars 138, or the flap 139 of the air valve 128 to switch the fresh air intake assembly 120 between the active and non-active states. One of ordinary skill in the art would appreciate that there are many ways for the electronic control system 24 to actuate the face plate 36 and components of the actuation mechanism 124, such as, for example and without limitation, by utilizing servos associated with the face plate 36 or components of the actuation mechanism 124. Alternatively, instead of utilizing left and right arms 136, 137 each connected to a linkage bar 138 that in turn actuates the flap 139 of the air valve 128, the electrical control system 24 may be in communication with a servos or other mechanical actuator connected directly to the air valve 128 itself to selectively open and close the air valve. Similarly, the electrical control system 24 may control a separate servos or other mechanical actuator connected directly to the face plate 36 to move it between the open and closed positions. In other words, the actuation mechanism may be made up of different mechanical actuators controlled by the electrical control system 24, instead of the specific linkages shown in FIGS. 31-41 that allow the user to manually actuate the air valve 128 via the face plate 36. Furthermore, the specific embodiment of the actuation mechanism 124 shown in FIGS. 31-41 may be used in conjunction with a separate actuation mechanism controlled and activated by the electrical control system 24 as described above, so that the user has the option of either manually activating the fresh air intake assembly 120, or doing so automatically via a remote control or personal computing device such as a smart phone.

Figure 50:
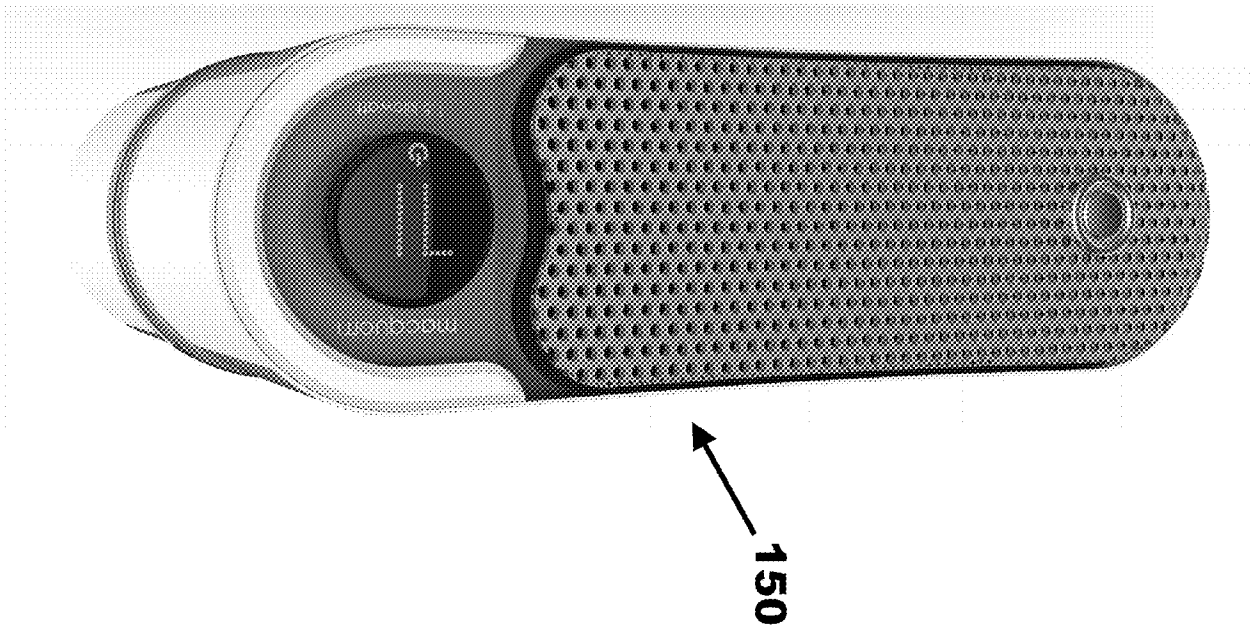
FIG. 50 is a perspective view of another alternative embodiment of a compact air conditioner.

One of ordinary skill in the art would appreciate that various aesthetic changes may be made to the present compact air conditioner 20 without departing from the inventive features and components discussed herein. For example and without limitation, an alternative embodiment of the present compact air conditioner 150 is shown in FIG. 50, the alternative compact air conditioner 150 having a face plate with a different overall shape and different openings than the face plate 36 shown in the other figures. Additionally, the compact air conditioner 150 utilizes a single adjustment knob instead of multiple adjustment knobs 46, and as discussed above, the display 47 is built into the single adjustment knob shown in FIG. 50. The user control interface of the compact air conditioner 150 also includes a power button located on the left side of the face plate. The shape of the housing of the compact air conditioner 150 is also different from that of the compact air conditioner 30 shown in FIGS. 1-49*b*, and has a more rounded profile on the edges, including a rounded handle 44. Given the different profile of the compact air conditioner 150, the window installation frame 110 would have a corresponding opening shape to accommodate the rounded profile. The alternate embodiment of the compact air conditioner 150 shown in FIG. 50 is merely one of many different embodiments that the present compact air conditioner can take.

Figure 51:
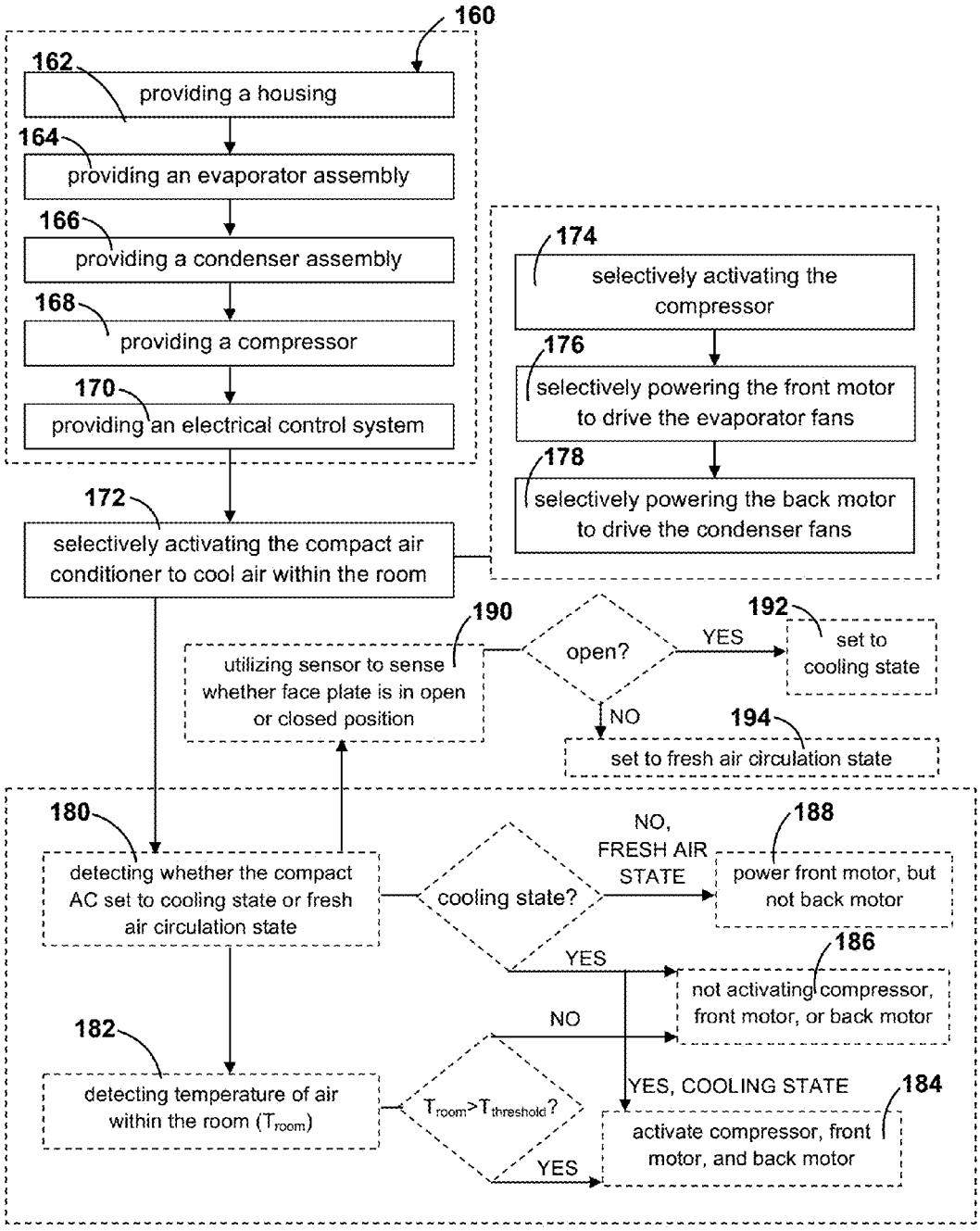
FIG. 51 is a flow diagram illustrating a method of cooling air within a room using a compact air conditioner.
Figure 53:
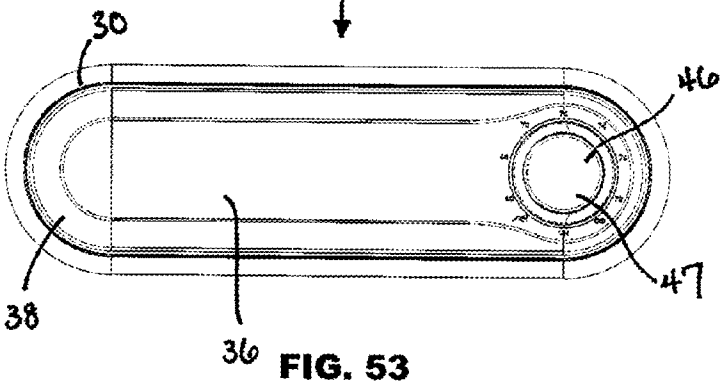
FIG. 53 is a front elevation view of the compact air conditioner shown in FIG. 52.
Figure 52:
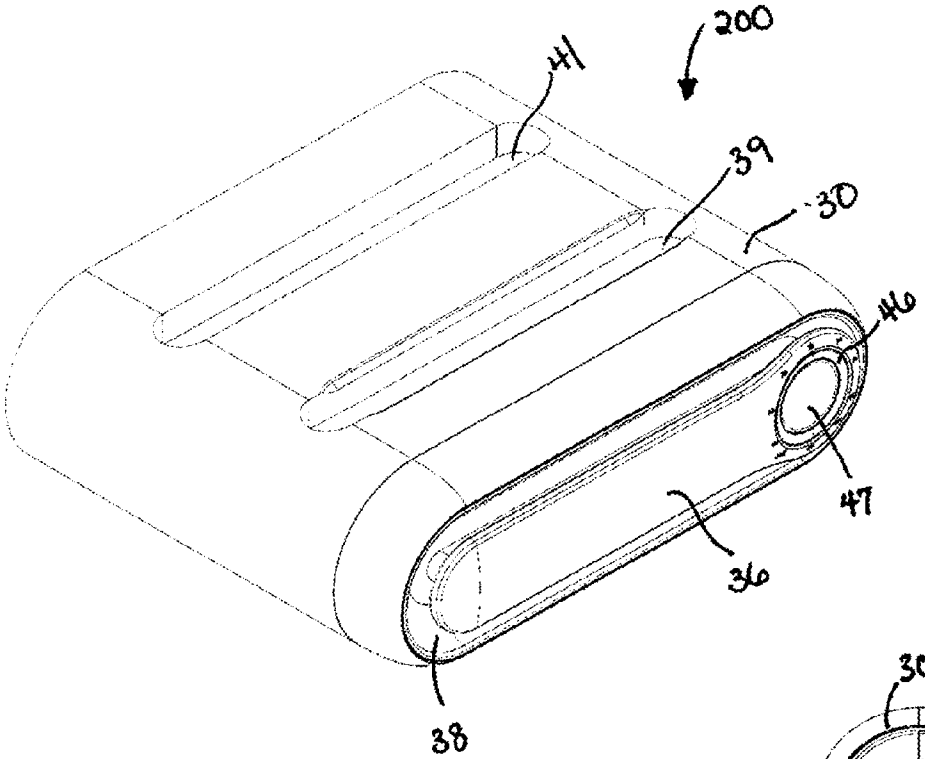
FIG. 52 is a perspective view of another alternative embodiment of a compact air conditioner.
Figure 54:
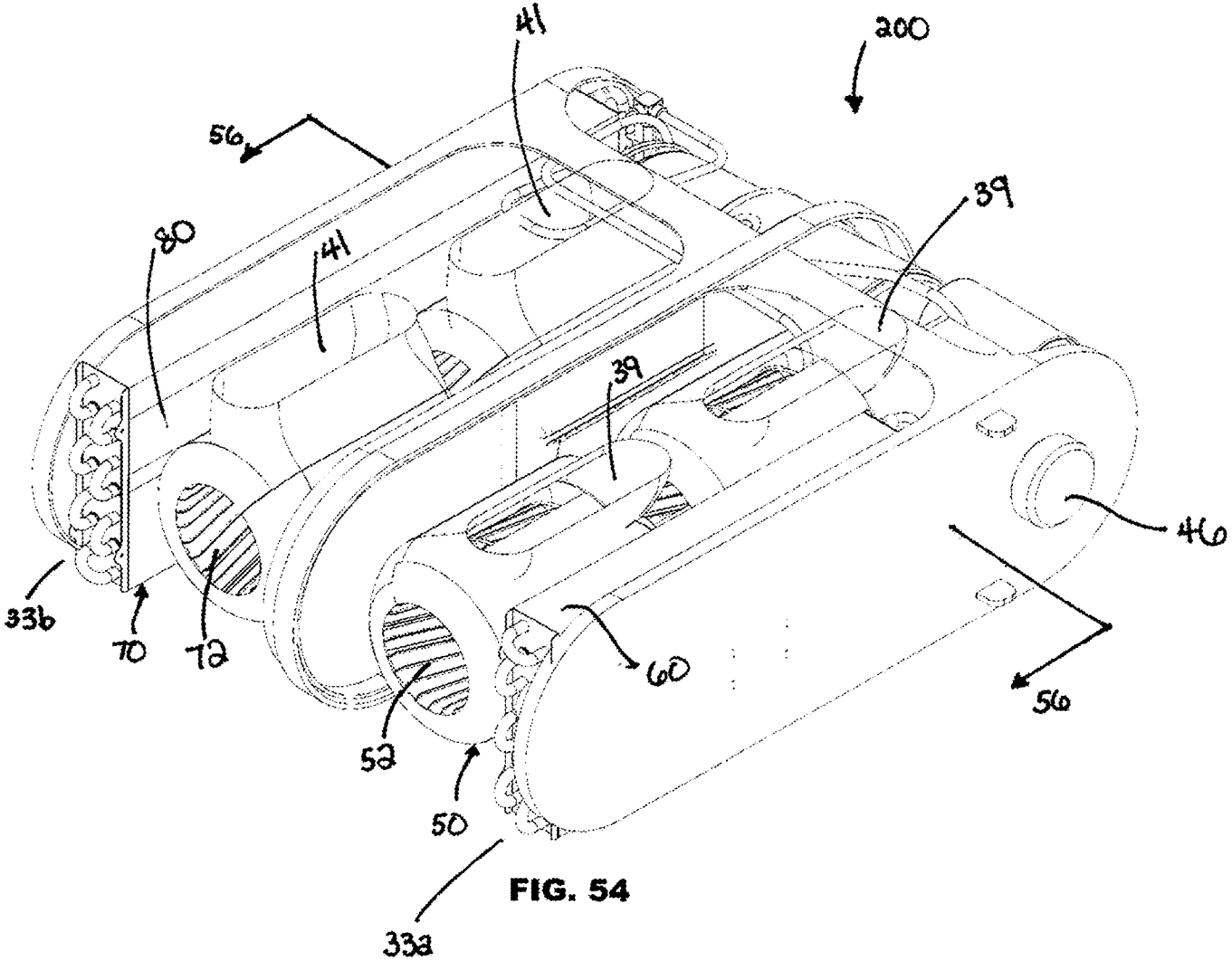
FIG. 54 is a perspective view of the compact air conditioner shown in FIG. 52, with certain portions of the housing removed.

A method of cooling air within a room using a compact air conditioner 160 is also disclosed, as illustrated by the flow diagram of FIG. 51. Reference numerals for the elements shown in FIGS. 1-41 and discussed above are used for the same elements below, and detailed descriptions of those elements are omitted for sake of brevity. The present method 160 may be implemented, for example and without limitation, using the housing 30, evaporator assembly 50, condenser assembly 70, compressor 90, and electrical control system 24 shown in FIGS. 1-41 and discussed above, or using any other housing, evaporator assembly, condenser assembly, compressor, and electrical control system having comparable suitable properties and functionalities. Portions of the flow diagram shown in dotted lines represent optional steps or grouping of steps. One of ordinary skill in the art would recognize that while each step of the flow diagram of FIG. 51 is shown and described separately, multiple steps may be executed in a different order than what is shown, in parallel with each other, or concurrently with each other.

The present method 160 of cooling air within a room using a compact air conditioner 20 includes a step 162 of providing a housing 30 of the compact air conditioner 20, the housing 30 having an internal cavity 32 and an outer surface 34 with a length that extends long a longitudinal direction Y, and a width that extends long a horizontal direction X that is substantially perpendicular to the longitudinal direction Y. The present method further includes a step 164 of providing an evaporator assembly 50 arranged within a front portion 33*a* of the internal cavity 32 of the housing 30, the evaporator assembly 50 having at least one centrifugal evaporator fan 52 (or two separate centrifugal evaporator fans 52) arranged coaxially along a front rotational axis R1 that is substantially aligned with the horizontal direction X. The evaporator assembly 50 may further include a front motor 54 associated with the evaporator fan or fans 52, and an evaporator 60 arranged adjacent to the evaporator fan or fans 52, the evaporator 60 having a substantially rectangular body 61 that extends along a vertical direction Z that is substantially perpendicular to both the horizontal and longitudinal directions X, Y. The method also includes a step 166 of providing a condenser assembly 70 arranged within a back portion 33*b* of the internal cavity 32 of the housing 30, the condenser assembly 70 having at least one centrifugal condenser fan 72 (or two separate centrifugal condenser fans 72) arranged coaxially along a back rotational axis R2 that is substantially aligned with the horizontal direction X and substantially parallel to the front rotational axis R1. The condenser assembly 70 may also include a back motor 74 associated with the condenser fan or fans 72, and a condenser 80 arranged adjacent to the condenser fans 72, the condenser 80 comprising a substantially rectangular body 81 that extends along the vertical direction Z. The present method also includes a step 168 of providing a compressor 90 associated with the evaporator assembly 50 and the condenser assembly 70, the compressor 90 having a refrigerant adapted to circulate between the evaporator 60 and the condenser 80. The present method further includes a step 170 of providing an electrical control system 24 associated with the evaporator assembly 50, the condenser assembly 70, and the compressor 90, and a step 172 of selectively activating the compact air conditioner 20 to cool air within the room. The step 172 of selectively activating the compact air conditioner 20 may include the following specific steps: a step 174 of selectively activating the compressor 90 to move refrigerant between the evaporator 60 and the condenser 80; a step 176 of selectively powering the front motor 54 to drive the centrifugal evaporator fan or fans 52 concurrently to rotate about the front rotational axis R1, to draw air from within the room through a room air intake grate 38 located at the front portion 33*a* of the housing 30 into the internal cavity 32 of the housing 30, to drive air from within the room along the evaporator 60 to be cooled by the evaporator 60, and to expel the cooled air through a cold air exit vent 39 located on the front portion 33*a* of the housing 30; and a step 178 of selectively powering the back motor 74 to drive the centrifugal condenser fan or fans 72 concurrently to rotate about the back rotational axis R2, to draw ambient air from outside of the room through an external air intake grate 40 located at the back portion 33*b* of the housing 30 into the internal cavity 32 of the housing 30, to drive ambient air along the condenser 80 to remove heat from the condenser 80, and to expel the heated air outwardly along the longitudinal direction Y through a hot air exit vent 41 located on the back portion 33*b* of the housing 30.

The step 172 of selectively activating the compact air conditioner 20 to cool air within the room may further include the following specific steps: a step 180 of detecting whether the compact air conditioner 20 is set to a cooling state or a fresh air circulation state; and a step 182 of detecting whether a temperature of the air from within the room is above a predetermined threshold temperature. In a case that the compact air conditioner 20 is set to the cooling state and the temperature of the air from within the room is above the predetermined threshold temperature, the present method includes a step 184 of utilizing the electrical control system 24 to proceed with a activating the compressor 90, powering the front motor 54, and powering the back motor 74. In a case that the compact air conditioner 20 is set to the cooling state and the temperature of the air form within the room is not above the predetermined threshold temperature, the present method includes a step 186 of not activating the compressor 90, not powering the front motor 54, and not powering the back motor 74. In a case that the compact air conditioner 20 is set to the fresh air circulation state, the present method includes a step 188 of utilizing the electrical control system 24 to proceed with activating the front motor 54, but not activating the compressor 80 and not powering the back motor 74. While the step 182 of detecting whether the temperature of the air from within the room is above a predetermined threshold temperature may be with respect to a specific predetermined temperature ($T_{threshold}$), the predetermined threshold temperature may instead be a specific predetermined temperature range. This helps ensure that the compact air conditioner 20 is not selectively activating or shutting down repeatedly due to small temperature fluctuations as the air in the room is approaching the appropriate temperature at which the cooling process begins or stops. Determining whether the temperature from within the room is above or below a predetermined temperature range instead of a specific exactly temperature is advantageous in that it extends the life of the components, including the front and back motors 54, 74, the compressor 90, the evaporator and condenser fans 52, 72 by reducing the number of activation and shutdowns, reduces energy usage, and reduces noise from repeated activations of the compact air conditioner 20.

The step 180 of detecting whether the compact air conditioner 20 is set to the cooling state or the fresh air circulation state may include a step 190 of utilizing a sensor 126 configured to sense whether a face plate 36 located at the front portion 33*a* of the housing 30 is in an open position such that air from within the room can enter the internal cavity 32 of the housing 30, or a closed position such that the air from within the room cannot enter the internal cavity 32 of the housing 30. In a case that the face plate 36 is in the open position, the air conditioner 20 is determined to be set to the cooling state in a step 192. In a case that the face plate 36 is in the closed position, the air conditioner 20 is determined to be set to the fresh air circulation state in a step 194. As discussed above, this allows the air conditioner 20 to be utilized in a fresh air circulation mode when no cooling of the interior air is required, but the user wishes to draw fresh air from the external atmosphere into the room or building. The movement of the face plate 36 between the open and closed positions may be manually actuated by the user by physically moving the face plate 36, or may be actuated by the electronic control system 24, which responds to user input and communicates with one or more mechanical actuators such as servos to move the face plate 36 or the actuation mechanism 124 of the fresh air intake assembly 120.

While various methods, configurations, and features of the present compact air conditioner have been described above and illustrated in the drawings, one of ordinary skill will appreciate from the disclosure that any combination of the above features can be used without departing from the scope of the present application. It is also recognized by those of ordinary skill in the art that many changes, only a few of which are exemplified in the detailed description above, may be made to the above described methods and embodiments without departing from the broad inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A compact air conditioner comprising:

a housing having an internal cavity and an outer surface with a length that extends along a longitudinal direction, and a width that extends long a horizontal direction that is perpendicular to the longitudinal direction;

an evaporator assembly arranged within a front portion of the internal cavity of the housing, the evaporator assembly comprising an evaporator fan having a front rotational axis aligned with the horizontal direction, a front motor that drives the evaporator fan, and an evaporator arranged adjacent to the evaporator fan;

a condenser assembly arranged within a back portion of the internal cavity of the housing, the condenser assembly comprising a condenser fan having a back rotational axis aligned with the horizontal direction, a back motor that drives the condenser fan, and a condenser arranged adjacent to the condenser fan, the back rotational axis being parallel to the front rotational axis;

a compressor associated with the evaporator assembly and the condenser assembly;

an electrical control system;

a fresh air intake assembly configured to circulate fresh air by drawing in external air from an external air intake grate located at a back portion of the outer surface of the housing, directing the external air through the housing, and expelling the external air out through an air exit vent located at a front portion of the outer surface of the housing, the fresh air intake assembly comprising an actuation mechanism, a sensor, and an air valve;

the housing further comprises a room air intake grate having a plurality of openings, a face plate movably associated with the room air intake grate, and a coupling component associated with the room air intake grate and the face plate, the coupling component comprising a plurality of male members arranged on one of the room air intake grate or the face plate, and a plurality of female members arranged on the other one of the room air take grate or the face plate in alignment with the male members; wherein the face plate is movable between an open position in which the male members and female members are not engaged and there is a gap between the face plate and the room air intake grate, such that air can flow through the plurality of openings in the room air intake grate into the cavity of the housing, and a closed position in which the male members and female members are engaged, such that air cannot flow into the cavity of the housing.

2. The compact air conditioner of claim 1, wherein the plurality of female members are arranged on the face plate, and the plurality of male members are arranged in between the plurality of openings on the room air intake grate, and when the face plate is in the closed position, the plurality of openings on the room air intake grate are blocked by the face plate; and wherein the face plate is associated with the actuation mechanism of the fresh air intake assembly such that when the face plate is in the open position, the fresh air intake assembly is in a non-active state in which the air valve is closed, and when the face plate is in the closed position, the fresh air intake assembly is in an active state in which the air valve is open.

3. The compact air conditioner of claim 1, wherein the sensor is configured to detect when the face plate is in the open position or the dosed position, and is in communication with the electrical control system, which is configured to selectively activate the actuation mechanism of the fresh air intake assembly such that when the face plate is in the open position, the fresh air intake assembly is in a non-active state in which the air valve is closed, and when the face plate is in the closed position, the fresh air intake assembly is in an active state in which the air valve is open.

4. The compact air conditioner of claim 2, wherein the face plate is associated with a left arm and a right arm, each one of the left and right arms being pivotally connected to a linkage bar that is in turn pivotally connected to a flap that moves in relation to an air valve frame connected to the housing, the flap being movable to close the air valve when the face plate is in the open position, and to open the air valve when the face plate is in the closed position; wherein when the air valve is closed, external air drawn in from the external air intake grate cannot enter the front portion of the internal cavity of the housing, and when the air valve is open, external air drawn in from the external air intake grate can enter the front portion of the internal cavity of the housing through the air valve.

5. The compact air conditioner of claim 2, wherein the sensor is associated with at least one of the face plate, the room air intake grate, the actuation mechanism, or the air valve and is configured to detect when the fresh air intake assembly is in the non-active state or the active state, and is in communication with the electrical control system, which is configured to selectively activate the evaporator assembly, the condenser assembly, and the compressor such that when the fresh air intake assembly is in the active state, the compressor and back motor are turned off, and the front motor is turned on to drive the evaporator fan to move external air drawn in from the external air intake grate through the internal cavity of the housing and out through the air exit vent located at the front portion of the outer surface of the housing.

6. The compact air conditioner of claim 1, wherein the housing further comprises a handle located at the front portion of the outer surface of the housing, the handle being positioned along the horizontal direction as to be aligned with a center of gravity of the compact air conditioner, the handle being movable between a retracted position in which it does not extend from the housing, and an extended position in which it extends from the housing as to be easily grasped.

7. A method of cooling air within a room using a compact air conditioner, the method comprising the steps of:

providing a housing of the compact air conditioner, the housing having an internal cavity and an outer surface with a length that extends along a longitudinal direction, and a width that extends along a horizontal direction that is perpendicular to the longitudinal direction;

providing an evaporator assembly arranged within a front portion of the internal cavity of the housing, the evaporator assembly comprising two centrifugal evaporator fans arranged coaxially along a front rotational axis that is aligned with the horizontal direction, a front motor associated with the evaporator fans; and an evaporator arranged adjacent to the evaporator fans, the evaporator comprising a rectangular body that extends along a vertical direction that is perpendicular to both the horizontal and longitudinal directions;

providing a condenser assembly arranged within a back portion of the internal cavity of the housing, the condenser assembly comprising two centrifugal condenser fans arranged coaxially along a back rotational axis that is aligned with the horizontal direction and parallel to the front rotational axis, a back motor associated with the condenser fans, and a condenser arranged adjacent to the condenser fans, the condenser comprising a rectangular body that extends along the vertical direction;

providing a compressor associated with the evaporator assembly and the condenser assembly, the compressor comprising a coolant adapted to circulate between the evaporator and the condenser;

providing an electrical control system associated with the evaporator assembly, the condenser assembly, and the compressor; and selectively activating the compact air conditioner to cool air within the room, comprising the sub-steps of:

selectively activating the compressor to move coolant between the evaporator and the condenser;

selectively powering the front motor to drive the two centrifugal evaporator fans concurrently to rotate about the front rotational axis, to draw air from within the room through a room intake grate located at the front portion of the housing into the internal cavity of the housing, to drive the air from within the room through the evaporator to be cooled by the evaporator, and to expel the cooled air through a cold air exit vent located on the front portion of the housing;

selectively powering the back motor to drive the two centrifugal condenser fans concurrently to rotate about the back rotational axis, to draw ambient air from outside of the room through an external air intake grate located at the back portion of the housing into the internal cavity of the housing, to drive the ambient air through the condenser to remove heat from the condenser, and to expel the heated air outwardly along the longitudinal direction through a hot air exit vent located on the back portion of the housing; and wherein the step of selectively activating the compact air conditioner to cool air within the room further comprises:

detecting whether the compact air conditioner is set to a cooling state or a fresh air circulation state; and detecting whether a temperature of the air from within the room is above a predetermined threshold temperature;

in a case that the compact air conditioner is set to the cooling state and the temperature of the air from within the room is above the predetermined threshold temperature, utilizing the electrical control system to proceed with activating the compressor, powering the front motor, and powering the back motor;

in a case that the compact air conditioner is set to the cooling state and the temperature of the air from within the room is not above the predetermined threshold temperature, not activating the compressor, not powering the front motor, and not powering the back motor; and in a case that the compact air conditioner is set to the fresh air circulation state, utilizing the electrical control system to proceed with powering the front motor, but not powering the compressor and not powering the back motor.

8. The method of claim 7, wherein the step of detecting whether the compact air conditioner is set to the cooling state or the fresh air circulation state comprises utilizing a sensor configured to sense whether a face plate located at the front portion of the housing is in an open position such that air from within the room can enter the internal cavity of the housing, or a closed position such that air from within the room cannot enter the internal cavity of the housing;

in a case that the face plate is in the open position, determining that the air conditioner is set to the cooling state; and in a case that the face plate is in the closed position, determining that the air conditioner is set to the fresh air circulation state.

* * * * *